US005985508A

United States Patent [19]

Ito et al.

[11] Patent Number: 5,985,508

[45] **Date of Patent: *Nov. 16, 1999**

[54] SILVER HALIDE PHOTOGRAPHIC MATERIAL

[75] Inventors: Tadashi Ito; Takahiro Goto; Shoji Yasuda, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,715

[22] Filed: Jan. 3, 1997

Related U.S. Application Data

[63] Continuation of application No. 08/530,755, Sep. 19, 1995, abandoned.

[30] Foreign Application Priority Data

| | | | |
|---|---|---|---|
| Sep. 20, 1994 | [JP] | Japan | 6-250136 |
| Sep. 20, 1994 | [JP] | Japan | 6-250156 |
| Sep. 20, 1994 | [JP] | Japan | 6-250159 |

[51] Int. Cl.[6] ..... G03C 1/06

[52] U.S. Cl. ..... 430/264; 430/598; 430/599; 430/600; 430/601; 430/603; 430/604; 430/605; 430/567

[58] Field of Search ..... 430/264, 598, 430/599, 600, 601, 603, 604, 605, 502, 567

[56] References Cited

U.S. PATENT DOCUMENTS

| | | | |
|---|---|---|---|
| 4,851,321 | 7/1989 | Takagi et al. | 430/264 |
| 5,166,043 | 11/1992 | De Prijcker | 430/598 |
| 5,478,696 | 12/1995 | Arai | 430/264 |

*Primary Examiner*—Geraldine Letscher
*Attorney, Agent, or Firm*—Sughrue, Mion, Zinn, Macpeak & Seas, PLLC

[57] ABSTRACT

A silver halide photographic material is disclosed, comprising a support having thereon at least one silver halide emulsion layer, wherein said emulsion layer contains a heavy metal selected from Ir, Ru, Rh, Re and Cr in an amount of at least $1\times10^{-5}$ mol per mol of silver halide and (1) silver halide grains having a silver chloride content of 95 mol % or more, said grains being formed under acidic conditions and then subjected to gold-sulfur sensitization, (2) a silver halide having a silver chloride content of 95 mol % or more and then subjected to Se or Te sensitization or (3) silver halide grains having a silver chloride content of 95 mol % or more and conatianing at least one iron compound, and at least one of said emulsion layer and other hydrophilic colloid layers contains at least one hydrazine derivative and at least one nucleation accelerator. Also, disclosed is a method for producing the above-described silver halide photographic material.

20 Claims, No Drawings

SILVER HALIDE PHOTOGRAPHIC MATERIAL

This is a Continuation of application Ser. No. 08/530,755 filed Sept. 19, 1995 now abandoned,

FIELD OF THE INVENTION

The present invention relates to a silver halide black-and-white photographic material for forming a silver image as a final image, more specifically, it relates to a silver halide black-and-white photographic material for dot-to-dot working and suitable for use in the field of photomechanical process, which can be handled under such an environment as can be considered to be a substantially bright room and can form a high contrast negative silver image.

BACKGROUND OF THE INVENTION

Out of the photomechanical process in the field of printing duplication, the page make-up stage and the dot-to-dot working stage are improved in the operation efficiency and the operation environment by carrying out the operation under a brighter environment and a silver halide light-sensitive material for plate making capable of handling under such an environment as can be considered to be substantially as a bright room is provided.

A well known method for producing a light-sensitive material having low sensitivity to visible light and capable of handling in a bright room comprises the use of a silver halide emulsion mainly consisting of silver chloride and having added thereto an inorganic or organic desensitizer such as rhodium salt, iridium salt, pinakryptol yellow and phenosafranine. In a particularly preferred method, a rhodium salt and/or an organic desensitizer is used together with fine particle silver chloride or fine particle silver chlorobromide emulsion having a particle size of from 0.05 to 0.5 $\mu$m and not subjected to chemical sensitization. Further, a method is also used where, in combination with the above-described emulsion, a yellow dye or an ultraviolet absorbing dye is incorporated into the light-sensitive material for the purpose of adjusting the sensitivity and imparting safety to the safe light.

On the other hand, the light-sensitive material for use in the page make-up stage or the dot-to-dot working stage is demanded to have a so-called superhigh contrast photographic properties such as high blacking density capable of clearly distinguishing the image area from the non-image area so as to provide good reproduction of a line image or a halftone image. In particular, when a halftone image and a line original are superposed on exposure (so-called superimposed letter image formation), the light-sensitive material is demanded to have a good reproduction property of a line image (letter image quality).

A known method for imparting a superhigh contrast photographic property to a light-sensitive material comprises the incorporation of a hydrazine derivative or a tetrazolium compound into the light-sensitive material, however, when this is used in combination with the above-described method where an inorganic or organic desensitizer, a yellow dye or an ultraviolet absorbing dye is incorporated into the light-sensitive material, there arise problems such that the high contrast effect given by the hydrazine derivative or the tetrazolium compound may be inhibited or the good reproduction property of a line image may be lost.

JP-A-60-140338 (the term "JP-A" as used herein means an "unexamined published Japanese patent application"), JP-A-61-238049, JP-A-63-183438, JP-A-63-296034, JP-A-61-198147, JP-A-61-198148 and JP-A-61-240235 disclose an image system where a silver halide black-and-white photographic material for dot-to-dot working can have superhigh contrast photographic properties. However, the developer used in these publications has a pH of 11 or more.

The developer having a pH of 11 or more is susceptible to air oxidation and unstable and as a result, cannot endure a long-term storage. Accordingly, a system is demanded therefor where a silver halide photographic material containing a hydrazine derivative is developed with a developer having a lower pH to obtain a high contrast image.

However, if the pH of the developer is low, the high contrast effect due to the hydrazine derivative is reduced and a high contrast image cannot be obtained.

In order to achieve higher contrast, investigations on more active hydrazine derivatives and nucleation accelerators have been made, however, the photographic material is sometimes obliged to undergo reduction in the long-term storage stability.

SUMMARY OF THE INVENTION

A first object of the present invention is to provide a silver halide photographic material for dot-to-dot working capable of handling under a bright safe light (substantially bright room) and having a superhigh contrast photographic properties.

A second object of the present invention is to provide a photographic material capable of handling under a bright safe light (substantially bright room) and having good reproduction properties of a line image (letter image quality).

A third object of the present invention is to provide a photographic material capable of providing superhigh contrast photographic properties even in the processing with a low pH developer insusceptible to air oxidation having a pH of 11 or less and excellent in the letter image quality.

A fourth object of the present invention is to provide a photographic material having good stability in a long-term storage.

These objects of the present invention have been achieved by a silver halide photographic material comprising a support having thereon at least one silver halide emulsion layer, wherein at least one of said emulsion layer and other hydrophilic colloid layers constituting said photographic material contains at least one hydrazine derivative represented by formula (I) and at least one nucleation accelerator represented by formula (XII), (XIII), (XIV) or (XV), and said emulsion layer comprises (a) an emulsion which contains silver halide grains containing a heavy metal selected from Ir, Ru, Rh, Re and Cr in an amount of at least $1\times10^{-5}$ mol per mol of silver halide and having a silver chloride content of 9.5 mol % or more, said grains being formed under acidic conditions and then subjected to gold-sulfur sensitization, (b) an emulsion which contains silver halide grains containing a heavy metal selected from Ir, Ru, Rh, Re and Cr in an amount of at least $1\times10^{-5}$ mol per mol of silver halide and having a silver chloride content of 95 mol % or more, said grains being subjected to chemical sensitization with at least one compound represented by formula (VI), (VII), (VIII), (IX) and (X), or (c) an emulsion which contains silver halide grains containing a heavy metal selected from Ir, Ru, Rh, Re and Cr in an amount of at least $1\times10^{-5}$ mol per mol of silver halide and at least one iron compound and having a silver chloride content of 95 mol % or more. The formulae (I), (VI), (VII), (VIII), (IX), (X), (XII), (XIII), (XIV) and (XV) will be described later in detail.

The silver halide emulsion for use in the bright room does not require high sensitivity and so, it is, in general, not subjected to chemical sensitization. In view of the safe light property, a silver halide emulsion having a high silver chloride content is used, but since such an emulsion readily undergoes increase in the fog due to chemical sensitization or the storability of the emulsion is deteriorated, it is difficult in practice to carry out chemical sensitization thereon.

The present invention has found that the above-described problems can be solved by incorporating a large amount of a heavy metal described above into a silver halide emulsion and also carrying out the grain formation under an acidic condition.

Further, it is found that superhigh contrast photographic properties can be obtained by using a hydrazine derivative represented by formula (I) and a nucleation accelerator represented by formula (XII), (XIII), (XIV) or (XV) in combination with the above-described silver halide emulsion. These findings are given beyond all expectations.

DETAILED DESCRIPTION OF THE INVENTION

The present invention will be described below in detail.

The silver halide emulsion of the present invention contains at least one heavy metal selected from Ir, Ru, Rh, Re and Cr.

Among these heavy metals, preferred is a metal coordination complex which is a six coordination complex represented by formula (II):

$$[M'(NY)_{m'}L'_{6-m'}]^{n'} \quad \text{(II)}$$

wherein M' represents a heavy metal selected from Ir, Ru, Rh, Re and Cr, L' represents a crosslinked ligand, Y represents oxygen or sulfur, m' represents 0, 1 or 2 and n' represents 0, −1, −2 or −3.

Specific preferred examples of L include a halide ligand (e.g., fluoride, chloride, bromide, iodide), a cyanide ligand, a cyanate ligand, a thiocyanate ligand, a selenocyanate ligand, a tellurocyanate ligand, an acido ligand and an aquo ligand. When an aquo ligand is present, it is preferred that one or two ligands are an aquo ligand.

Specific examples of the metal coordination complex are set forth below.

1. $[Rh(H_2O)Cl_5]^{-2}$
2. $[RuCl_6]^{-3}$
3. $[Ru(NO)Cl_5]^{-2}$
4. $[RhCl_6]^{-3}$
5. $[Ru(H_2O)Cl_5]^{-2}$
6. $[Ru(NO)\ (H_2O)Cl_4]^{-1}$
7. $[Re(NO)Cl_5]^{-2}$
8. $[Ir(NO)Cl_5]^{-2}$
9. $[Ir(H_2O)Cl_5]^{-2}$
10. $[Re(H_2O)Cl_5]^{-2}$
11. $[RhBr_6]^{-3}$
12. $[ReCl_6]^{-3}$
13. $[IrCl_6]^{-3}$
14. $[Re(NS)Cl_4(SeCN)]^{-2}$
15. $[Cr(CN)_6]^{-3}$

The metal complex can be incorporated into a silver halide by adding the complex at the preparation of grains.

The silver halide grain of the present invention contains the heavy metal in an amount of from $1\times10^{-5}$ to $1\times10^{-2}$ mol, preferably from $1\times10^{-5}$ to $3\times10^{-4}$ mol, per mol of silver halide. The above-described heavy metals may also be used in combination of two or more. The heavy metal distribution in the silver halide grain is not particularly restricted, however, it is preferred that the heavy metal is present in a larger amount on the outer part than the inside of a grain.

The silver halide emulsion of a silver halide photographic material for use in the present invention is silver chlorobromide, silver chloroiodobromide or silver chloride each having a silver chloride content of 95 mol % or more, preferably 99 mol % or more. If the proportion of silver bromide or silver iodide increases, the safe light safety in a bright room is worsened or the γ value is reduced, thus this is not preferred.

The selenium sensitizer used in the emulsion (b) of the present invention may be a selenium compound disclosed in conventionally known patents. More specifically, a labile selenium compound and/or non-labile selenium compound is usually added and the emulsion is stirred at a high temperature, preferably at 40° C. or higher, for a definite time. Preferred examples of the labile selenium compound include the compounds described in JP-B-44-15748 (the term "JP-B" as used herein means an "examined Japanese patent publication"), JP-B-43-13489, JP-A-4-25832, JP-A-4-109240 and JP-A-5-40324. Specific examples of the labile selenium sensitizer include isoselenocyanates (e.g., aliphatic isoselenocyanates such as allylisoselenocyanate), selenoureas, selenoketones, selenoamides, selenocarboxylic acids (e.g., 2-selenicpropionates, 2-selenolactic acid), selenoesters, diacylselenides (e.g., bis(3-chloro-2,6-dimethoxybenzoyl) selenide), selenophosphates, phosphine selenides and colloidal metal selenium. The preferred species of the labile selenium compound are described above but the present invention is by no means limited thereto. As a general understanding for a person skilled in the art, the labile selenium compound as a sensitizer of a photographic emulsion plays no role other than to let selenium carried on the organic moiety of the selenium sensitizer molecule be present in an emulsion in a labile form and the structure of the compound is not so important as long as the selenium is labile. In the present invention, a labile selenium compound in such a wide concept is advantageously used. The non-labile selenium compound for use in the present invention includes the compounds described in JP-B-46-4553, JP-B-52-34492 and JP-B-52-34491. Examples of the non-labile selenium compound include selenious acid, potassium selenocyanide, selenazoles, a quaternary salt of selenazoles, diaryl selenide, diaryl diselenide, dialkyl selenide, dialkyl diselenide, 2-selenazolidinedione, 2-selenaoxazolidinethione and a derivative of these. Among these selenium compounds, preferred are those represented by formulae (VI) and (VII):

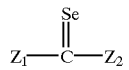

(VI)

wherein $Z_1$ and $Z_2$, which may be the same or different, each represents an alkyl group (e.g., methyl, ethyl, t-butyl, adamantyl, t-octyl), an alkenyl group (e.g., vinyl, propenyl), an aralkyl group (e.g., benzyl, phenetyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), —$NR_{21}(R_{22})$, —$OR_{23}$ or —$SR_{24}$, wherein $R_{21}$, $R_{22}$, $R_{23}$ and $R_{24}$, which may be the same or different, each represents an alkyl group, an aralkyl group, an aryl group or a heterocyclic group.

Examples of the alkyl group, the aralkyl group, the aryl group or the heterocyclic group include those described for $Z_1$. In addition, $R_{21}$ and $R_{22}$ may also be a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl). Preferably, in formula (VI), $Z_1$ is an alkyl group, an aryl group or —$NR_{21}$ ($R_{22}$) and $Z_2$ is —$NR_{21'}$($R_{22'}$), wherein $R_{21}$, $R_{22}$, $R_{21'}$ and $R_{22'}$, which may be the same or different, each is a hydrogen atom, an alkyl group, an aryl group or an acyl group. Among the compounds represented by formula (VI), more preferred are N,N-dialkylselenourea, N,N,N'-trialkyl-N'-acylselenourea, tetraalkylselenourea, N,N-dialkylarylselenoamido and N-alkyl-N-arylarylselenoamido.

(VII)

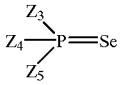

wherein $Z_3$, $Z_4$ and $Z_5$, which may be the same or different, each represents an aliphatic group, an aromatic group, a heterocyclic group, —$OR_{25}$—$NR_{26}$ ($R_{27}$), —$SR_{28}$, —$SeR_{29}$, $X_{11}$ or a hydrogen atom, wherein $R_{25}$, $R_{28}$ and $R_{29}$ each represents an aliphatic group, an aromatic group, a heterocyclic group, a hydrogen atom or a cation, $R_{26}$ and $R_{27}$ each represents an aliphatic group, an aromatic group, a heterocyclic group or a hydrogen atom and $X_{11}$, represents a halogen atom. In formula (VII), the aliphatic group represented by $Z_3$, $Z_4$, $Z_5$, $R_{25}$, $R_{26}$, $R_{27}$, $R_{28}$ or $R_{29}$ is a linear, branched or cyclic alkyl, alkenyl, alkynyl or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenetyl). In formula (VII), the aromatic group represented by $Z_3$, $Z_4$, $Z_5$, $R_{25}$, $R_{26}$, $R_{27}$, $R_{28}$ or $R_{29}$ is a monocyclic or condensed ring aryl group (e.g., phenyl, pentafluorophenyl, 4-chlorophenyl, 3-sulfophenyl, α-naphthyl, 4-methylphenyl). In formula (VII), the heterocyclic group represented by $Z_3$, $Z_4$, $Z_5$, $R_{25}R_{26}$, $R_{27}$, $R_{28}$ or $R_{29}$ is a 3-, 4-, 5-, 6-, 7-, 8-, 9- or 10-membered, saturated or unsaturated heterocyclic group containing at least one of a nitrogen atom, an oxygen atom and a sulfur atom (e.g., pyridyl, thienyl, furyl, thiazolyl, imidazolyl, benzimidazolyl). In formula (VII), the cation represented by $R_{25}R_{28}$ or $R_{29}$ is an alkali metal atom or ammonium and the halogen atom represented by $X_{11}$ is a fluorine atom, a chlorine atom, a bromine atom or an iodine atom. In formula (VII), $Z_3$, $Z_4$ and $Z_5$ each represents an aliphatic group, an aromatic group or —$OR_{25}$, wherein $R_{25}$ represents an aliphatic group or an aromatic croup. Among the compounds represented by formula (VII), more preferred are trialkylphosphine selenide, triarylphosphine selenide, trialkylselenophosphate and triarylselenophosphate. Specific examples of the compound represented by formula (VI) or formula (VII) are set forth below, but the present invention is by no means limited to these.

VI-1.

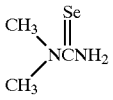

-continued

VI-2.

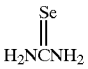

VI-3.

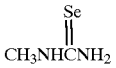

VI-4.

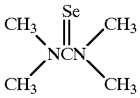

VI-5.

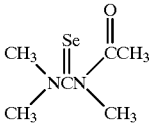

VI6.

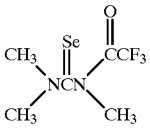

VI-7.

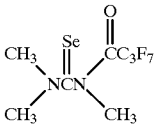

VI-8.

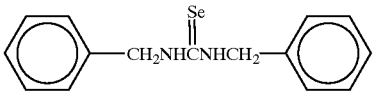

VI-9.

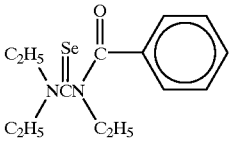

VI-10.

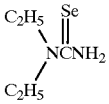

VI-11.

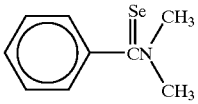

VI-12.

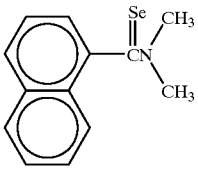

VI-13.

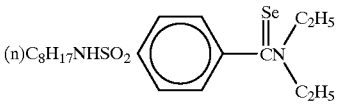

-continued
VI-14.
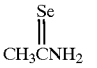
VI-15.
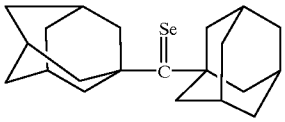
VI-16.
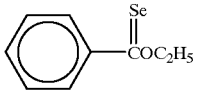
VI-17.
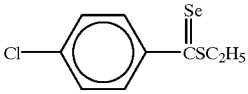
VI-18.
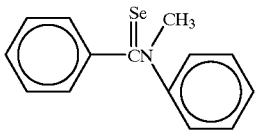
VI-19.
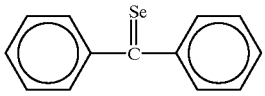
VI-20.
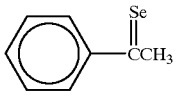
VII-21.
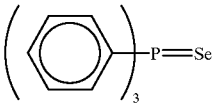
VII-22.
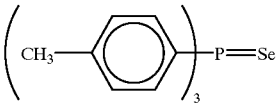
VII-23.
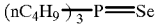
VII-24.
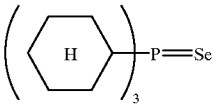
VII-25.
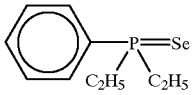
VII-26.
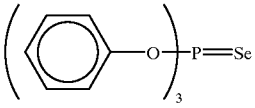
-continued
VII-27.
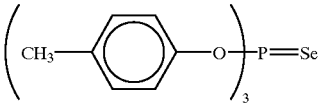
VII-28.
VII-29.
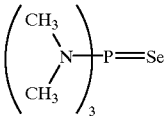
VII-30.
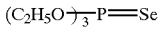
VII-31.
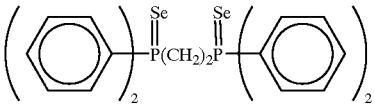
VII-32.
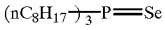
VII-33.
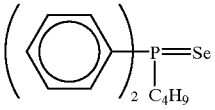
VII-34.
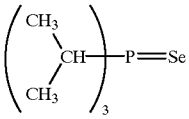
VII-35.
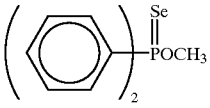
VII-36.
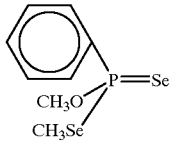
VII-37.
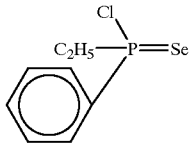
VII-38.
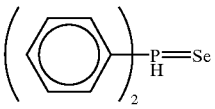
VII-39.
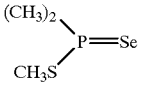

-continued

VII-40.

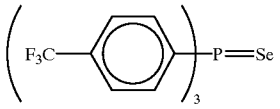

VII-41.

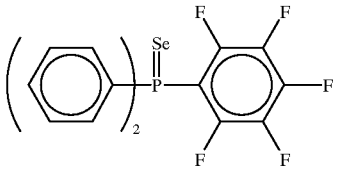

VII-42.

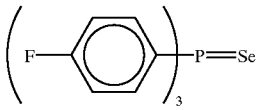

VII-43.

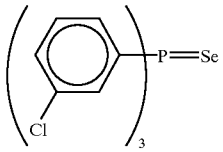

Preferred examples of the tellurium sensitizer for use in the emulsion (b) of the present invention include the compounds described in U.S. Pat. Nos. 1,623,499, 3,320,069 and 3,772,031; British Patent Nos. 235,211, 1,121,496, 1,295,462 and 1,396,696; Canadian Patent No. 800,958; JP-A-4-204640, JP-A-4-271341, JP-A-4-333043 and JP-A-5-303157; *J. Chem. Soc. Commun.,* 635 (1980); ibid., 1102 (1979); ibid., 645 (1979); *J. Chem. Soc. Perkin Trans.,* 1, 2191 (1980); S. Patai (compiler), *The Chemistry of Organic Selenium and Tellurium Compounds*, Vol. 1 (1986); and ibid., Vol. 2 (1987). Specific examples of the tellurium sensitizer include colloidal tellurium, telluroureas (e.g., allytellurourea, N,N-dimethytellurourea, tetramethyltellurourea, N-carboxyethyl-N',N'-dimethyltellurourea, N,N'-dimethylethylenetellurourea, N,N'-diphenylethylenetellurourea), isotellurocyanates (e.g., allyisotellurocyanate), telluroketones (e.g., telluroacetophenone), telluroamides (e.g., telluroacetamido, N,N-dimethyltellurobenzamido), tellurohydrazides (e.g., N,N',N'-trimethyltellurobenzhydrazide), telluroesters (e.g., t-butyl-t-hexyltelluroester), phosphine tellurides (e.g., tributyl-phosphine telluride, tricyclohexylphosphine telluride, triisopropylphosphine telluride, butyldiisopropylphosphine telluride, dibutylphenylphosphine telluride), diacyl (di)tellurides (e.g., bis(diphenylcarbamoyl)ditelluride, bis(N-phenyl-N-methylcarbamoyl) ditelluride, bis(N-phenyl-N-methylcarbamoyl) telluride, diethylcarbamoyl telluride, bis(ethoxycarbonyl) telluride), (di)tellurides and other tellurium compounds (e.g., negative-electric-charge telluride ion-containing gelatin described in British Patent 1,295,462, potassium telluride, potassium tellurocyanate, telluropentathionate sodium salt, allyltellurocyanate). Among these, preferred are those represented by formulae (VIII), (IX) and (X):

(VIII)

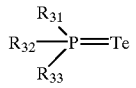

wherein $R_{31}$, $R_{32}$ and $R_{33}$each represents an aliphatic group, an aromatic group, a heterocyclic group, $OR_{34}$, $NR_{35}(R_{36})$, $SR_{37}$, $OSiR_{38}(R_{39})(R_{40})$, $X_{11}$, or a hydrogen atom (wherein $R_{34}$ and $R_{37}$ each represents an aliphatic group, an aromatic group, a heterocyclic group, a hydrogen atom or a cation, $R_{35}$ and $R_{36}$ each represents an aliphatic group, an aromatic group, a heterocyclic group or a hydrogen atom, $R_{38}$, $R_{39}$ and $R_{40}$ each represents an aliphatic group and $X_{11}$ represents a halogen atom).

The compound of formula (VIII) will be described below in detail.

In formula (VIII), the aliphatic group represented by $R_{31}$, $R_{32}$, $R_{33}$, $R_{34}$, $R_{35}R_{36}$, $R_{37}$, $R_{38}$, $R_{39}$ or $R_{40}$ is an aliphatic group having from 1 to 30 carbon atoms, preferably a linear, branched or cyclic alkyl, alkenyl, alkynyl or aralkyl group having from 1 to 20 carbon atoms. Examples of the alkyl group, the alkenyl group, the alkynyl group and the aralkyl group include methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl and phenetyl. In formula (VIII), the aromatic group represented by $R_{31}$, $R_{32}$, $R_{33}$, $R_{34}$, $R_{35}$, $R_{36}$ or $R_{37}$ is an aromatic group having from 6 to 30 carbon atoms, preferably a monocyclic or condensed ring aryl group having from 6 to 20 carbon atoms, and examples thereof Include phenyl and naphthyl. In formula (VIII), the heterocyclic group represented by $R_{31}$, $R_{32}$, $R_{33}$, $R_{34}$, $R_{35}$, $R_{36}$ or $R_{37}$ is a 3-, 4-, 5-, 6-, 7-, 8-, 9- or 10-membered, saturated or unsaturated heterocyclic group containing at least one of a nitrogen atom, an oxygen atom and a sulfur atom. The heterocyclic group may be a monocyclic or may form a condensed ring with other aromatic or heterocyclic ring. The heterocyclic group is preferably a 5- or 6-membered aromatic heterocyclic ring and examples thereof include pyridyl, furyl, thienyl, thiazolyl, imidazolyl and benzimidazolyl. In formula (VIII), the cation represented by $R_{34}$ or $R_{37}$ is an alkali metal or an ammonium. In Formula (VIII), the halogen atom represented by $X_{11}$ is a fluorine atom, a chlorine atom, a bromine atom or an iodine atom. These aliphatic, group, aromatic group and heterocyclic group each may be further substituted. Representative examples of the substituent include an alkyl group, an aralkyl group, an alkenyl group, an alkynyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amido group, diacylamino group, an imido group, an alkylthio group, an arylthio group, a halogen atom, a cyano group, a sulfo group, a carboxyl group, a hydroxyl group, a phosphono group, a nitro group and a heterocyclic group. These group may be further substituted. When two or more substituents are present, they may be the same or different. $R_{31}$, $R_{32}$ and $R_{33}$ may be combined to form a ring together with the phosphorus atom or $R_{35}$ and $R_{36}$ may be combined to form a nitrogen-containing heterocyclic ring. In formula (VIII), $R_{31}$, $R_{32}$ and $R_{33}$ each preferably represents an aliphatic group or an aromatic group and more preferably an alkyl group or an aromatic group.

(IX)

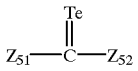

wherein $R_{51}$ represents an aliphatic group, an aromatic group, a heterocyclic group or $—NR_{53}(R_{54})$ and $R_{52}$ represents $—NR_{55}(R_{56})$, $—N(R_{57})N(R_{58})R_{59}$ or $—OR_{60}$ (wherein $R_{53}$, $R_{54}$, $R_{55}$, $R_{56}$, $R_{57}$, $R_{58}$, $R_{59}$ and $R_{60}$ each represents a hydrogen atom, an aliphatic group, an aromatic group, a heterocyclic group or an acyl group, provided that $R_{51}$and $R_{55}$, $R_{51}$, and $R_{57}$, $R_{51}$, and $R_{58}$, $R_{51}$ and $R_{60}$, $R_{53}$ and $R_{55}$, $R_{53}$ and $R_{57}$, $R_{53}$ and $R_{58}$, or $R_{53}$ and $R_{60}$ may be combined with each other to form a ring).

The compound of formula (IX) will be described below in detail. In formula (IX), the aliphatic group, the aromatic group and the heterocyclic group represented by $R_{51}$, $R_{52}$, $R_{53}$, $R_{54}$, $R_{55}$, $R_{56}$, $R_{57}$, $R_{58}$, $R_{59}$ or $R_{60}$ each has the same meaning as defined in formula (VIII). In formula (IX), the acyl group represented by $R_{53}$, $R_{54}$, $R_{55}$, $R_{56}$, $R_{57}$, $R_{58}$, $R_{59}$ or $R_{60}$ is preferably an acyl group having from 1 to 30 carbon atoms, more preferably a linear or branched acyl group having from 1 to 20 carbon atoms, and examples thereof include acetyl, benzoyl, formyl, pivaloyl and decanoyl. $R_{51}$ and $R_{55}$, $R_{51}$ and $R_{57}$, $R_{51}$ and $R_{58}$, $R_{51}$ and $R_{60}$, $R_{53}$ and $R_{55}$, $R_{53}$ and $R_{57}$, $R_{53}$ and $R_{58}$, or $R_{53}$ and $R_{60}$ may be combined with each other to form a ring through an alkylene group, an arylene group, an aralkylene group or an alkenylene group. The aliphatic group, the aromatic group or the heterocyclic group may be substituted by a substituent described in formula (VIII). Preferably, in formula (IX), $R_{51}$ is an aliphatic group, an aromatic group or $—NR_{53}(R_{54})$ and $R_{52}$ is $—NR_{55}(R_{56})$, wherein $R_{53}$, $R_{54}$, $R_{55}$ and $R_{56}$ each is an aliphatic group or an aromatic group. More preferably, in formula (IX), $R_{51}$ is an aromatic group or $—NR_{53}(R_{54})$ and $R_{52}$ is $—NR_{55}(R_{56})$, wherein $R_{53}$, $R_{54}$, $R_{55}$ and $R_{56}$ each is an alkyl group or an aromatic group. $R_{51}$ and $R_{55}$ or $R_{53}$ and $R_{55}$ may be preferably combined to form a ring through an alkylene group, an arylene group, an aralkylene group or an alkenylene group.

(X)

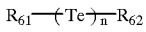

wherein $R_{61}$ and $R_{62}$, which may be the same or different, each represents an aliphatic group, an aromatic group, a heterocyclic group, $—(C{=}Y')—R_{63}$ (wherein $R_{63}$ represents a hydrogen atom, an aliphatic group, an aromatic group, a heterocyclic group, $NR_{64}(R_{65})$, $OR_{66}$ or $SR_{67}$ and Y' represents an oxygen atom, a sulfur atom or $NR_{68}$, wherein $R_{64}$, $R_{65}$, $R_{66}$, $R_{67}$ and $R_{68}$ each represents a hydrogen atom, an aliphatic group, an aromatic group or a heterocyclic group) and n represents 1 or 2.

The compound of formula (X) will be described below in detail. In formula (X), the aliphatic group, the aromatic group and the heterocyclic group represented by $R_{61}$, $R_{62}R_{63}$, $R_{64}$, $R_{65}$, $R_{66}$, $R_{67}$ or $R_{68}$ each has the same meaning as defined in formula (VIII). The aliphatic group, the aromatic group and the heterocyclic group represented by $R_{61}$, $R_{62}$, $R_{63}$, $R_{64}$, $R_{65}$, $R_{66}$, $R_{67}$ or $R_{68}$ each may be substituted by a substituent described in formula (VIII). $R_{61}$ and $R_{62}$ or $R_{64}$ and $R_{65}$ may be combined to form a ring. In formula (X), $R_{61}$ and $R_{62}$ each is preferably a heterocyclic group or $—(C{=}Y')—R_{63}$ (wherein $R_{63}$ is $NR_{64}(R_{65})$ or $OR_{66}$ and Y' is an oxygen atom, wherein $R_{64}$, $R_{65}$ and $R_{66}$ each is an aliphatic group, an aromatic group or a heterocyclic group). In formula (X), $R_{61}$ and $R_{62}$ each is more preferably $—(C{=}Y')—R_{63}$, wherein $R_{63}$ is $NR_{64}(R_{65})$ and Y' is an oxygen atom, wherein $R_{64}$ and $R_{65}$ each is an aliphatic group, an aromatic group or a heterocyclic group.

Specific examples of the compounds represented by formulae (VIII), (IX) and (X) are set forth below, but the present invention is by no means limited to these.

VIII-1.

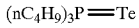

VIII-2.

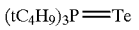

VIII-3.

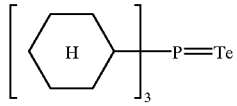

VIII-4.

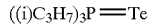

VIII-5.

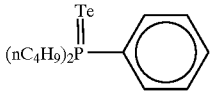

VIII-6.

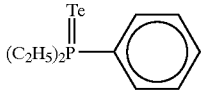

VIII-7.

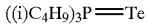

VIII-8.

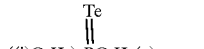

VIII-9.

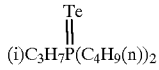

VIII-10.

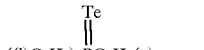

VIII-11.

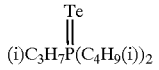

VIII-12.

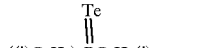

VIII-13.

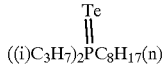

VIII-14.

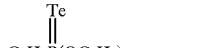

VIII-15.

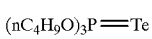

-continued
VIII-16.
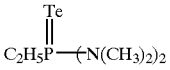
VIII-17.
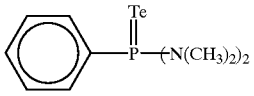
VIII-18.
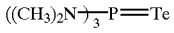
VIII-19.
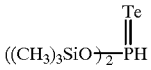
VIII-20.
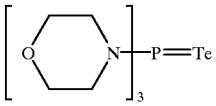
VIII-21.
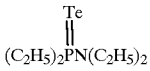
VIII-22.
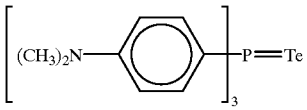
IX-23.
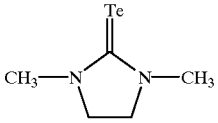
IX-24.
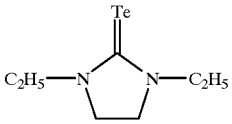
IX-25.
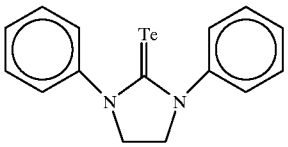
IX-26.
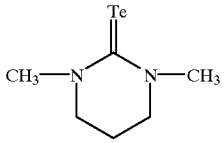
IX-27.
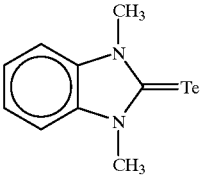
-continued
IX-28.
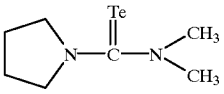
IX-29.
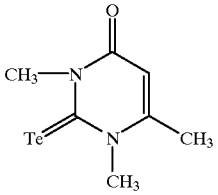
IX-30.
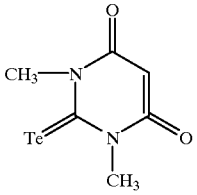
IX-31.
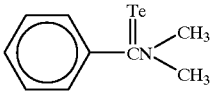
IX-32.
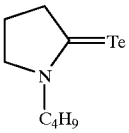
IX-33.
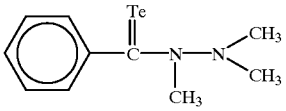
IX-34.
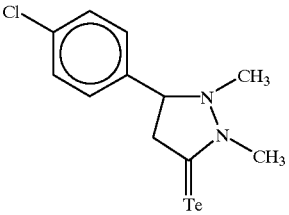
IX-35.
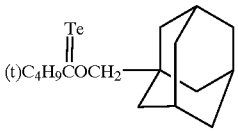

-continued
IX-36.
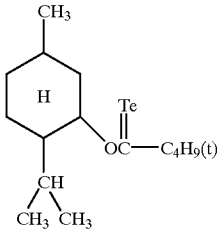
IX-37.
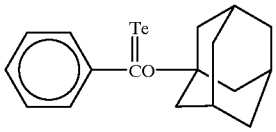
IX-38.
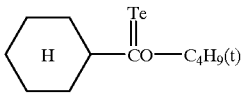
X-39.
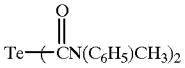
X-40.
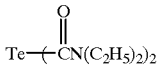
X-41.
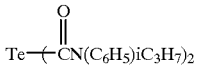
X-42.
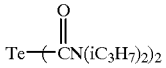
X-43.
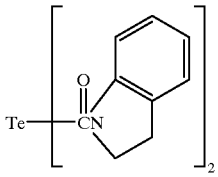
X-44.
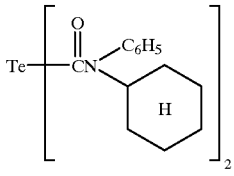
X-45.
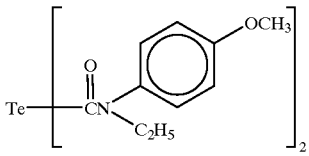
-continued
X-46.
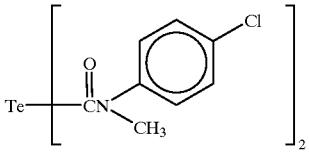
X-47.
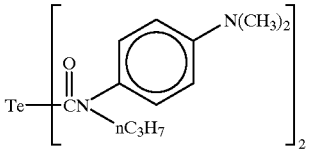
X-48.
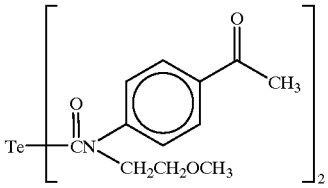
X-49.
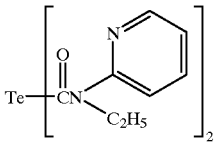
X-50.
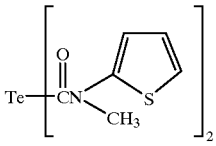
X-51.
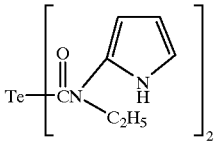
X-52.
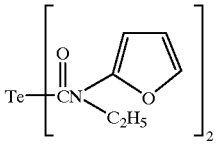
X-53.
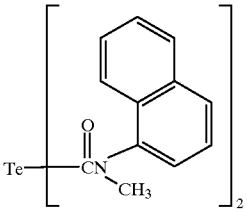
X-54.
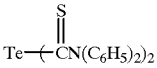

-continued

X-55.

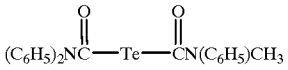

X-56.

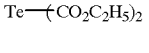

X-57.

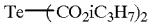

X-58.

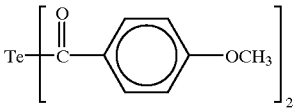

X-59.

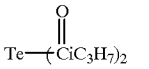

X-60.

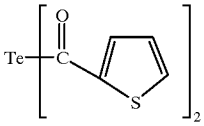

X-61.

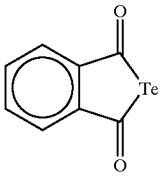

X-62.

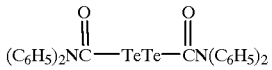

X-63.

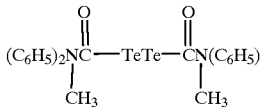

X-64.

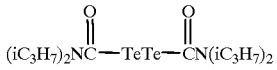

X-65.

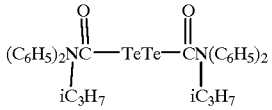

X-66.

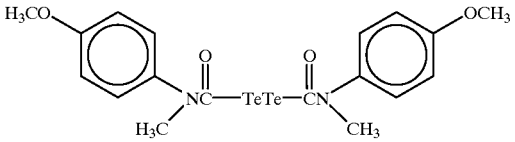

X-67.

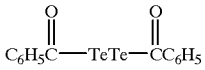

-continued

X-68.

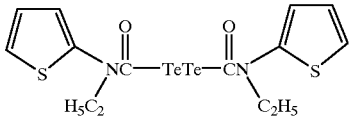

X-69.

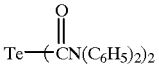

X-70.

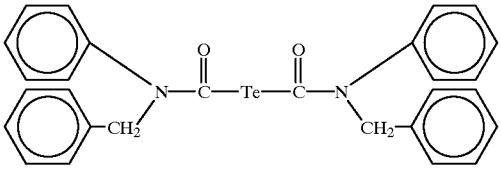

The tellurium sensitizer used in the emulsion (b) of the present invention is a compound capable of producing a silver telluride which is assumed to serve as a sensitization speck on the grain surface or inside the grain of a silver halide emulsion. The silver telluride production rate in a silver halide emulsion can be examined as follows. If the tellurium sensitizer is added in a large amount (e.g., $1\times10^{-3}$ mol/mol-Ag), the produced silver telluride has absorption in a visible region. Accordingly, the methods described on the sulfur sensitizer in E. Moisar, *Journal of Photographic Science*, Vol. 14, p. 181 (1966) and ibid., Vol. 16, p. 102 (1968) can be applied. More specifically, the relative silver telluride production rate can be easily obtained in the same manner as in the method where the produced silver sulfide amount in a silver halide emulsion is obtained by using the Kubelka-Munk formula from the infinite reflectivity of the emulsion in a visible region (at 520 nm). Further, since this reaction is prima facie approximate to a first-order reaction, a pseudo first-order reaction rate constant can also be obtained. For example, a tellurium compound dissolved in an organic solvent (e.g., methanol) is added to a silver bromide octahedral emulsion (containing 0.75 mol of AgBr and 80 g of gelatin in 1 kg of emulsion) having an average grain size of 0.5 $\mu$m in an amount of $1\times10^{-3}$ mol/mol-Ag while maintaining the pH of 6.3, the pAg of 8.3 and the temperature of 50° C. The resulting emulsion is placed in a 1 cm-thick cell by a spectrophotometer having an integrating sphere and the reflectance (R) at 520 nm is measured along the time passing by referring to a blank emulsion. The reflectance obtained is substituted to the Kubelka-Munk formula: $(1-R)^2/2R$, and the pseudo first-order reaction rate constant k ($min^{-1}$) is obtained from the variation in the resulting values. If silver telluride is not produced, R is always 1 and therefore, the Kubelka-Munk value is 0 the same as the case when a tellurium compound is absent. The compounds having a pseudo first-order reaction rate constant k determined in thoroughly the same condition as the above-described test method, of from $1\times10^{-8}$ to $1\times10^{0}$ $min^{-1}$ are preferred. In a small addition amount region where the absorption in a visible region is difficult to detect, the quantity of the produced silver telluride can be determined by separating it from the unreacted tellurium sensitizer. For example, the silver telluride produced is separated by the dipping in an aqueous halogen salt solution or an aqueous solution of a water-soluble mercapto compound and the quantity of trace Te is analyzed by an atomic absorption method or the like. The reaction rate greatly varies in the range of several figures depending upon, of course, the kind of the compound and also upon the silver halide composition of the emulsion to be tested or the temperature, the pAg or the pH on the test. The tellurium sensitizer which is preferably used in the present invention is a compound capable of forming silver telluride in a specific silver halide emulsion having a halogen composition and a crystal habit to be used. To say in general, a compound capable of forming silver telluride in the silver bromide emulsion within any range that the temperature is from 40 to 95° C., the pH is from 3 to 10 or the pAg is from 6 to 11 is preferably used and more preferred is a compound which gives a pseudo first-order reaction rate constant k according to the above-described method of from $1\times10^{-7}$ to $1\times10^{-1}$ $min^{-1}$ in this temperature, pH or pAg range.

The compounds represented by formulae (VIII), (IX) and (X) used in the emulsion (b) of the present invention can be synthesized according to the known methods, for example, the methods described in *J. Chem. Soc. (A),* 1969, 2927; *J. Organomet. Chem.,* 4, 320 (1965); ibid., 1,200 (1963); ibid., 113, C35 (1976); *Phosphorus Sulfur,* 15, 155 (1983); *Chem. Ber.,* 109, 2996 (1976); *J. Chem. Soc. Chem. Commun.,* 635 (1980); ibid., 1102 (1972); ibid., 645 (1979); ibid., 820 (1987); *J. Chem. Soc. Perkin Trans.,* 1, 2191 (1980); S. Patai (compiler), *The Chemistry of Organo Selenium and Tellurium Compounds*, Vol. 2, pp 216–267 (1987); Tetrahedron Letters, 31, 3587 (1990); *J. Chem. Res., Synopses,* 2, 56 (1990); *Bull. Chem. Soc. Japan,* 62, 2117 (1989); ibid., 60, 771 (1987); *J. Organometallic Chem.,* 338, 9 (1988); ibid., 306, C36 (1986); *Nippon Kagaku Kai Shi*, Vol. 7, 1475 (1987); *Zeitschrift Chemie,* 26, 179 (1986); *Chemistry Letters,* 3, 475 (1987); *Indian Journal of Chemistry, Section A,* 25A, 57 (1986); *Angewandte Chemie,* 97 1051 (1985); *Spectrochimica Acta, Part A,* 38A, 185 (1982); *Organic Preparations and Procedures International,* 10, 289 (1978); and *Organometallics,* 1, 470 (1982).

The use amount of the selenium or tellurium sensitizer for use in the emulsion (b) of the present invention varies depending on the silver halide grain used and the conditions for chemical ripening, however, it is generally from $1\times10^{-8}$ to $1\times10^{-2}$ mol, preferably approximately from $1\times10^{-7}$ to $5\times10^{-3}$ mol.

The conditions for chemical sensitization in embodiment (b) of the present invention are not particularly restricted, however, the pH is generally from 5 to 8, the pAg is generally from 6 to 11, preferably from 7 to 10, and the temperature is generally from 40 to 95° C., preferably from 45 to 85° C.

In embodiment (b) of the present invention, a noble metal sensitizer such as gold, platinum, palladium or iridium is preferably used in combination. In particular, a gold sensitizer is preferably used and specific examples thereof include chloroauric acid, potassium chloroaurate, potassium aurithiocyanate, gold sulfide and gold selenide. The gold sensitizer is used in an amount of approximately from $10^{-7}$ to $10^{-2}$ mol per mol of silver halide.

In embodiment (b) of the present invention, a sulfur sensitizer is also preferably used in combination and specific examples thereof include known labile sulfur compounds such as thiosulfates (e.g., hypo), thioureas (e.g., diphenylthiourea, triethylurea, allylthiourea) and rhodanines. The sulfur sensitizer is used in an amount of approximately from $10^{-7}$ to $10^{-2}$ mol per mol of silver halide.

The silver halide emulsion (c) of the present invention contains at least one iron compound.

The iron compound used in the emulsion (c) of the present invention is a compound containing a divalent or trivalent iron ion and preferably an iron salt or an iron complex salt which is water soluble in the concentration range used in the present invention. Specific examples thereof include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chlorate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexanecyanoiron(II), potassium ferrous pentacyanoammine, sodium ferric ethylenedinitrilotetraacetate, potassium hexacyanoiron(III), ferric tris(dipyridyl) chloride and potassium ferric pentacyanonitrosyl. In particular, hexacyanoferrate(II), hexacyanoferrate(III), ferrous thiocyanate and ferric thiocyanate provide outstanding effects.

The above-described iron compound can be incorporated into a silver halide by adding it during the preparation of grains. The iron distribution in a silver halide grain is not particularly restricted but the iron compound is preferably present in a larger amount in the outer part of a grain or locally present in the outer part of a grain.

The silver halide grain in the emulsion (c) of the present invention contains iron in an amount of from $1\times10^{-7}$ to $1\times10^{-2}$ mol, preferably from $1\times10^{-5}$ to $5\times10^{-3}$ mol, per mol of silver halide.

The silver halide emulsion of the silver halide photographic material for use in the present invention has an average grain size of 0.20 $\mu$m or less, preferably from 0.08 to 0.16 $\mu$m. If the grain size exceeds 0.2 $\mu$m, the $\gamma$ value is lowered and the Dmax in practical use is reduced. In preparing silver halide grains of the present invention, good results can be obtained in such a mixing condition that the reaction temperature is 50° C. or lower, preferably 40° C. or lower and the silver voltage is 70 mV or more, preferably from 300 to 500 mV when the stirring rate is sufficiently high for achieving uniform mixing, or from 80 to 120 mV in the presence of a stabilizer such as 5,6-cyclopentane-4-hydroxy-1,3,3a,7-tetrazaindene. The grain size distribution is basically not particularly restricted but it is preferably monodisperse. The term "monodisperse" as used herein means that at least 95% by weight or by number of grains has a size within the average grain size ±40%, more preferably the average grain size ±20%. The silver halide grain of the present invention preferably has a regular crystal form such as a cubic, octahedral or tetradecahedral form, more preferably a cubic form.

In the present invention, the grain formation of the silver halide emulsion (a) is carried out under an acidic condition. This is effective for suppressing fogging in the subsequent chemical sensitization with gold and sulfur sensitizers as much as possible.

The acidic condition is such that the pH is 4.0 or less, preferably from 1.5 to 3.0.

The silver halide emulsion (a) of the silver halide photographic material for use in the present invention is, after grain formation, subjected to chemical sensitization with a gold sensitizer and a sulfur sensitizer, namely, to gold-sulfur sensitization.

The gold sensitizer may have a gold oxidation number of either +1 valence or +3 valence and a gold compound in a common use as a gold sensitizer can be used. Representative examples thereof include chloroaurate, potassium chloroaurate, auric trichloride, potassium auric thiocyanate, potassium iodoaurate, tetracyanoauric acid, ammonium aurothiocyanate and pyridyltrichlorogold.

The addition amount of the gold sensitizer may vary depending upon various conditions but it is as a standard preferably from $1\times10^{-7}$ to $5\times10^{-4}$ mol per mol of silver halide.

The sulfur sensitizer may be a known sulfur sensitizer and examples thereof include thiosulfates, thioureas, allylisocyanates, cystine, p-toluenethiosulfonates and rhodanine. In addition, sulfur sensitizers described in U.S. Pat. Nos. 1,574,944, 2,410,689, 2,278,947, 2,728,668, 3,501,313 and 3,656,955, German Patent 1,422,869, JP-B-56-24937 and JP-A-55-45016 can also be used. The addition amount of the sulfur sensitizer varies over a fairly broad range depending on various conditions such as the pH, the temperature and the silver halide grain size, but it is preferably from $1\times10^{-7}$ to $5\times10^{-4}$ mol per mol of silver halide.

The chemical sensitization using these sensitizers is carried out by adding sensitizers and stirring the emulsion at a high temperature, preferably at 40° C. or higher for a fixed time.

In addition to these sensitizers, a noble metal sensitizer such as platinum or palladium or a reduction sensitizer such as stannous salt, amines, formamidinesulfinic acid or a silane compound may also be used in combination.

The silver halide emulsion (c) of the present invention may be subjected to chemical sensitization or may not be subjected to chemical sensitization. As the method for chemical sensitization of a silver halide emulsion, sulfur sensitization, reduction sensitization and noble metal sensitization are known and the chemical sensitization may be carried out using these sensitization methods individually or in combination. The gold sensitization is a representative method of the noble metal sensitization and uses a gold compound, predominantly a gold complex salt. A complex salt of a noble metal other than gold, for example, of platinum, palladium or iridium may also be contained without causing any problem. Specific examples thereof are described in U.S. Pat. No. 2,448,060 and British Patent 618,061. The sulfur sensitizer may be a sulfur compound contained in gelatin and additionally, various sulfur compounds such as thiosulfates, thioureas, thiazoles and rhodanines may also be used. The reduction sensitizer may be stannous salt, amines, formamidinesulfinic acid or a silane compound.

The silver halide emulsion (c) of the present invention contains an iron compound and therefore, the chemical sensitization thereof may be sometimes inhibited. In carrying out chemical sensitization, a zinc compound is preferably used in combination as described in EP-A-613044.

In the present invention, the grain formation of the silver halide emulsion (c) is preferably carried out under an acidic condition. The acidic condition is such that the pH is 4.0 or less, preferably from 1.5 to 3.0.

The hydrazine derivative for use in the present invention is represented by formula (I):

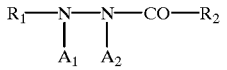

(I)

wherein $R_1$ represents an aliphatic or aromatic group substituted by a sulfonamide group, $R_2$ represents a hydrogen atom, an alkyl group, an aryl group, an unsaturated heterocyclic group, an alkoxy group, an aryloxy group, an amino group or a hydrazino group and $A_1$ and $A_2$ both represent a hydrogen atom or one represents a hydrogen atom and the other represents a substituted or unsubstituted alkylsulfonyl group, a substituted or unsubstituted arylsulfonyl group or a substituted or unsubstituted acyl group.

In formula (I), the aliphatic group substituted by a sulfonamido group and represented by $R_1$ is preferably an aliphatic group having from 1 to 30 carbon atoms, more preferably a linear, branched or cyclic alkyl group having from 1 to 20 carbon atoms. The branched alkyl group may be cyclized to form a saturated heterocyclic ring containing one or more hetero atoms therein. This alkyl group may also have a substituent.

In formula (I), the aromatic group substituted by a sulfonamido group and represented by $R_1$ is a monocyclic or bicyclic aryl group or an unsaturated heterocyclic group. This unsaturated heterocyclic group may be condensed with the monocyclic or bicyclic aryl group to form a heteroaryl group. Examples thereof include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring, with a benzene ring being preferred.

Among these, particularly preferred is an aryl group.

In formula (I), the alkyl group represented by $R_2$ is preferably an alkyl group having from 1 to 4 carbon atoms and the aryl group is preferably a monocyclic or bicyclic aryl group, for example, an aryl group containing a benzene ring.

The unsaturated heterocyclic group is a 5- or 6-membered ring containing at least one of a nitrogen atom, an oxygen atom and a sulfur atom and examples thereof include an imidazolyl group, a pyrazolyl group, a triazolyl group, a tetrazolyl group, a pyridyl group, a pyrdinium group, a quinolinium group and a quinolinyl group. Among these, particularly preferred are a pyridyl group and a pyrdinium group.

The alkoxy group is preferably an alkoxy group having from 1 to 8 carbon atoms, the aryloxy group is preferably a monocyclic aryloxy group and the amino group is preferably an unsubstituted amino group or an alkylamino or arylamino group having from 1 to 10 carbon atoms.

$R_2$ may be substituted and preferred representative examples of the substituent include an alkyl group, an alkenyl group, an alkynyl group, an aryl group, a group containing a heterocyclic ring, a pyridinium group, a hydroxy group, an alkoxy group, an aryloxy group, an acyloxy group, an alkyl- or arylsulfonyloxy group, an amino group, a carbonamido group, a sulfonamido group, a ureido group, a thioureido group, a semicarbazide group, a thiosemicarbazide group, a urethane group, a group having a hydrazide structure, a group having a quaternary ammonium structure, an alkyl- or arylthio group, an alkyl- or arylsulfonyl group, an alkyl- or arylsulfinyl group, a carboxyl group, a sulfo group, an acyl group, an alkoxy- or aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom and a group having a tertiary sulfonium structure or a quaternary sulfonium structure. The substituent is preferably a linear, branched or cyclic alkyl group (preferably having from 1 to 20 carbon atoms), an aralkyl group (preferably with the alkyl moiety being a monocyclic or bicyclic ring having from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms) or a phosphoric acid amido group (preferably having from 1 to 30 carbon atoms).

Among the groups represented by $R_2$, preferred are a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl group) and an aryl group (e.g., phenyl, 3,5-dichlorophenyl, o-methanesulfonamidophenyl, 4-methanesulfonylphenyl, 2-hydroxymethylphenyl), and particularly preferred are a hydrogen atom and a trifluoromethyl group.

Also, $R_2$ may be a group which cleaves the CO—$R_2$ moiety from the residual molecule and induces a cyclization reaction to form a cyclic structure containing the atom in the —CO—$R_2$ moiety and examples thereof include those described in JP-A-63-29751.

$A_1$ and $A_2$ each is a hydrogen atom, an alkyl- or arylsulfonyl group having 20 or less carbon atoms (preferably a phenylsulfonyl group or a phenylsulfonyl group substituted so as to give the sum of Hammett's substituent constants of −0.5 or more), an acyl group having 20 or less carbon atoms (preferably a benzoyl group, a benzoyl group substituted so as to give the sum of Hammett's substituent constant of −0.5 or more or a linear, branched or cyclic, unsubstituted or substituted aliphatic acyl group (in which examples of the substituent include a halogen atom, an ether group, a sulfonamido group, a carbonamido group, a hydroxyl group, a carboxyl group and a sulfonic acid group)).

$A_1$ and $A_2$ each is most preferably a hydrogen atom.

The substituent for $R_1$ or $R_2$ in formula (I) may further be substituted and preferred examples of the substituent include those described as the substituent for $R_2$. The substituent may be substituted in multiplicity such that the substituent of the substituent, the substituent of the substituent of the substituent . . . is substituted by a substituent and preferred examples of the substituent also include those described as the substituent for $R_2$.

In $R_1$ or $R_2$ of formula (I), a ballast group or a polymer commonly used in non-diffusible state photographic additives such as a coupler may be integrated. The ballast group is a group having 8 or more carbon atoms and relatively inactive to the photographic property and can be selected, for example, from an alkyl group, an aralkyl group, an alkoxy group, a phenyl group, an alkylphenyl group, a phenoxy group and an alkylphenoxy group. Examples of the polymer include those described in JP-A-1-100530.

In $R_1$ or $R_2$ of formula (I), a group capable of intensifying the adsorption to the silver halide grain surface may be incorporated. Examples of the adsorber include an alkylthio group, an arylthio group, a thiourea group, a heterocyclic thioamido group, a mercapto heterocyclic group and a triazole group described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The hydrazine derivative in embodiments (a) and (b) of the present invention is particularly preferably a hydrazine derivative where $R_1$ is a phenyl group having a ballast group, a group for accelerating the adsorption to the silver halide grain surface or a group having a quaternary ammonium structure of an alkylthio group through a sulfonamido group and $R_2$ is a hydrogen atom, a substituted alkyl group or a substituted aryl group (in which the substituent is preferably an electron withdrawing group or a hydroxymethyl group at the 2-position). Any combination of the above-described selection items for $R_1$ or $R_2$ can be used and is preferred.

In particular, a hydrazine derivative where $R_1$ is a group for accelerating the adsorption to a silver halide grain surface through a sulfonamido group or a phenyl group having an alkylthio group and $R_2$ is a substituted alkyl group is preferred.

The hydrazine derivative in embodiment (c) of the present invention is particularly preferably a hydrazine derivative where $R_1$ is a ballast group, a group for accelerating the adsorption to a silver halide grain surface, a group having a quaternary ammonium structure or a phenyl group having an alkylthio group and $R_2$ is a hydrogen atom, a substituted alkyl group or a substituted aryl group (in which the substituent is preferably an electron-withdrawing group or a hydroxymethyl group at the 2-position). Any combination of the above-described selection items for $R_1$ or $R_2$ can be used and is preferred.

In particular, a hydrazine derivative where $R_1$ is a group for accelerating the adsorption to the silver halide grain surface or a phenyl group having an alkylthio group and $R_2$ is a substituted alkyl group is preferred.

Specific examples of the compound represented by formula (I) are set forth below, but the present invention is by no means limited to these compounds.

I-1

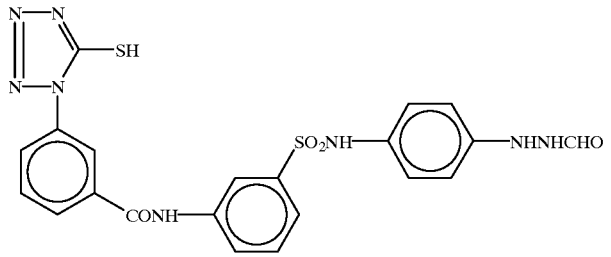

-continued
I-2
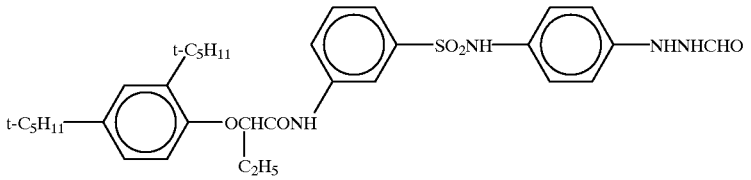
I-3
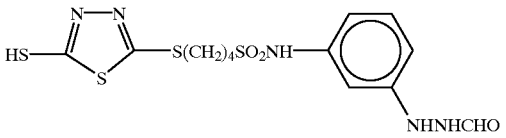
I-4
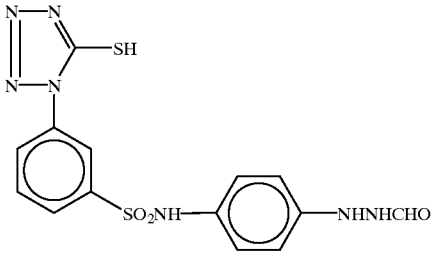
I-5
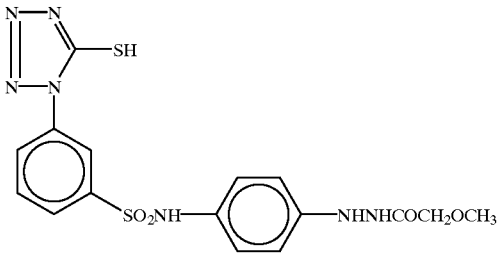
I-6
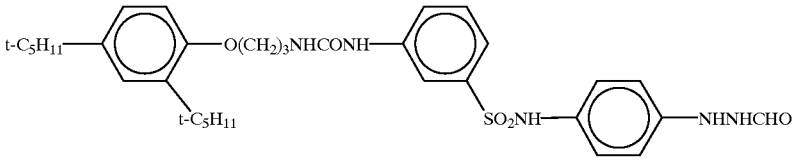
I-7
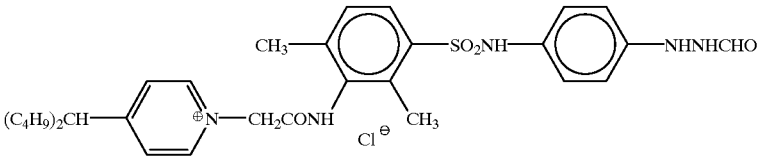
I-8
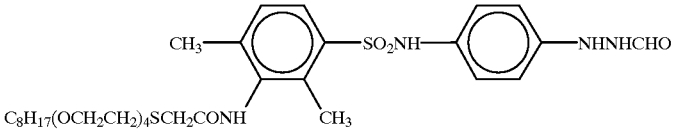

-continued
I-9
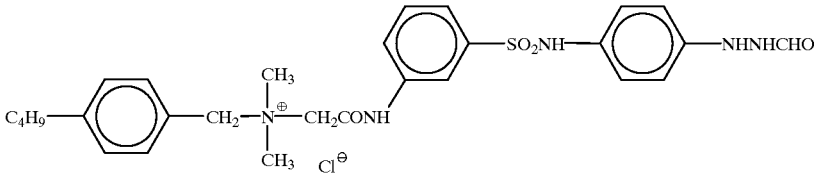
I-10
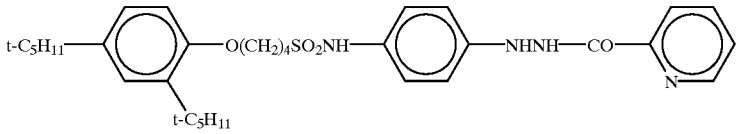
I-11
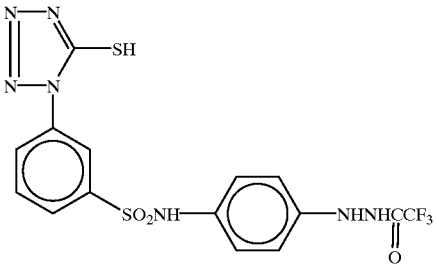
I-12
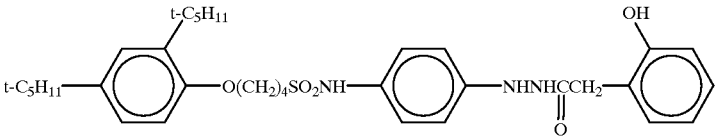
I-13
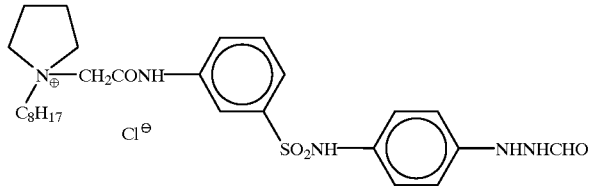
I-14
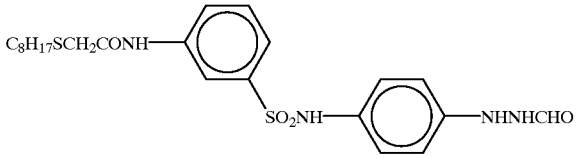
I-15
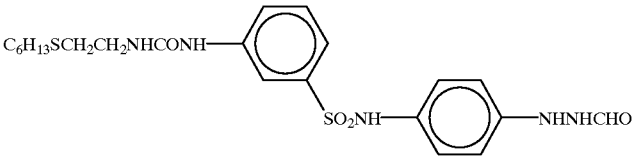
I-16
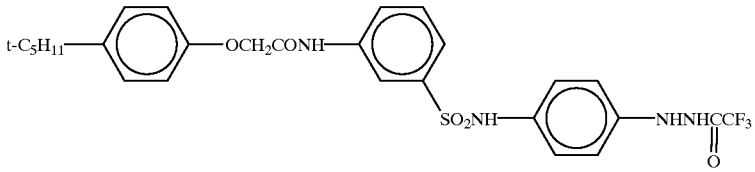

-continued
I-17
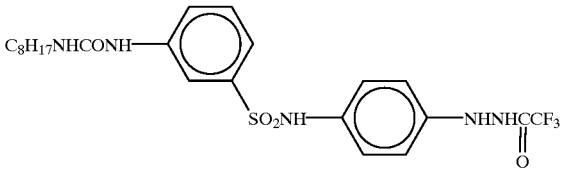
I-18
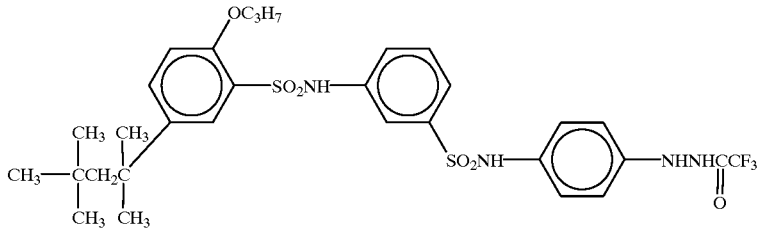
I-19
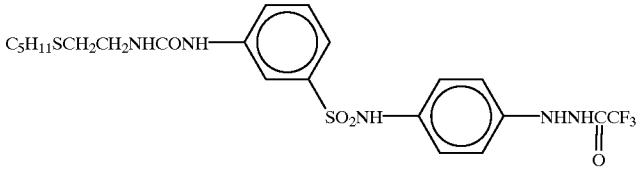
I-20
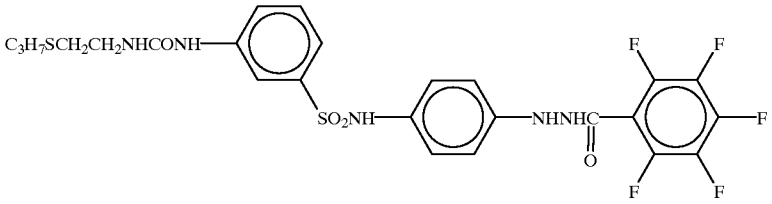
I-21
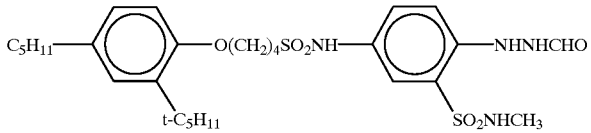
I-22
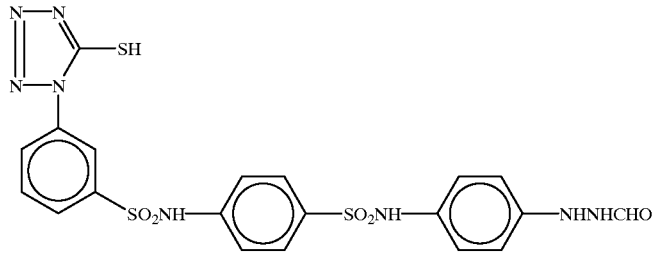
I-23
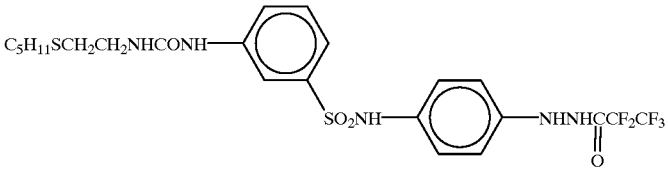

-continued
I-24
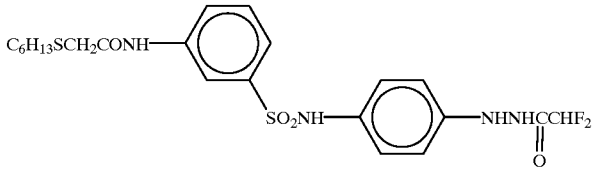
I-25
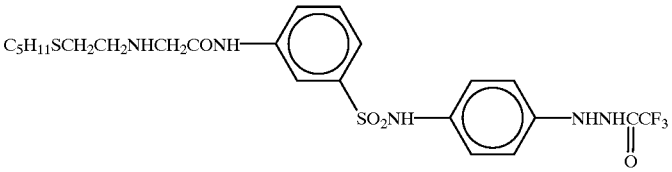
I-26
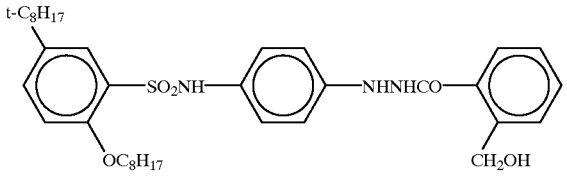
I-27
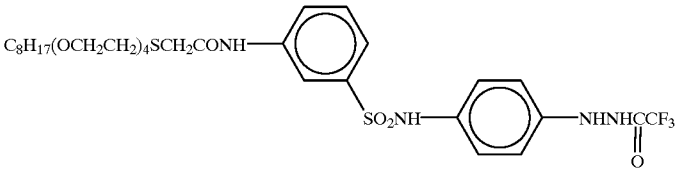
I-28
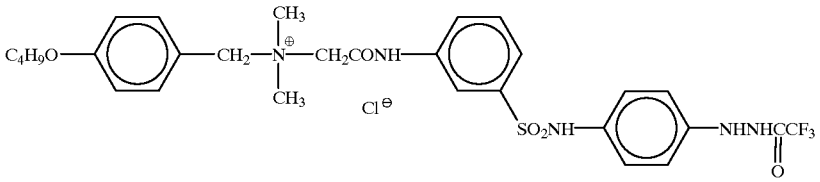
I-29
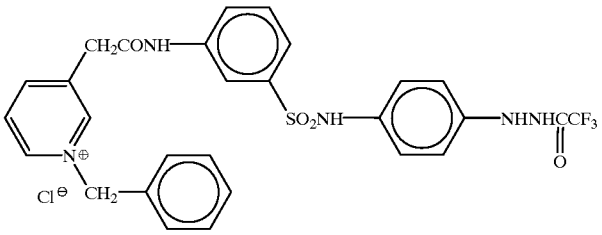
I-30
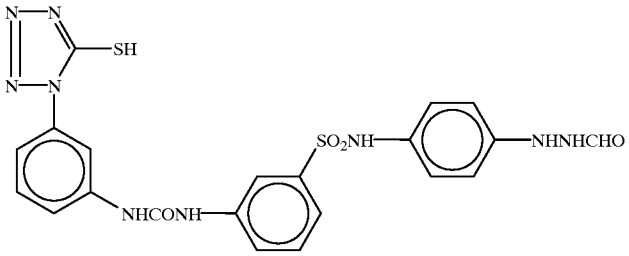

-continued
I-31
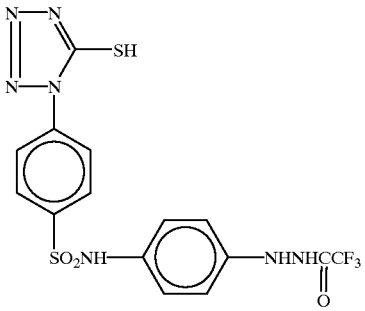
I-32
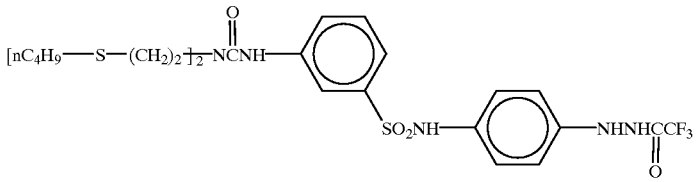
I-33
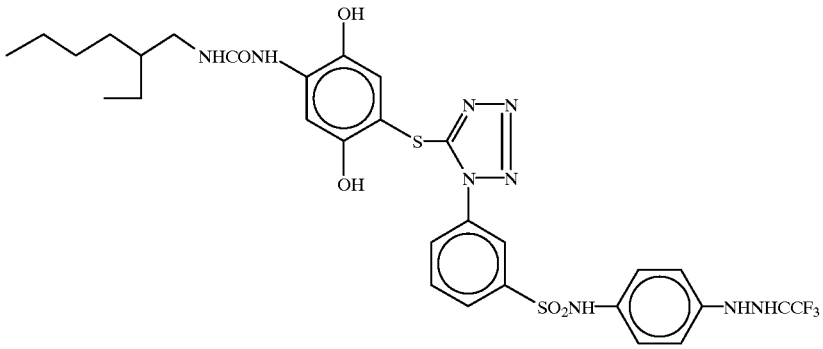
I-34
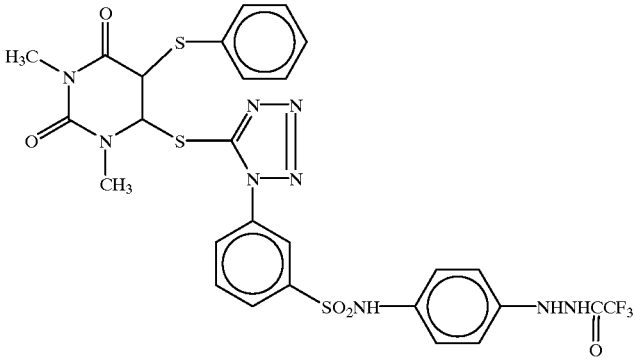

-continued

I-35

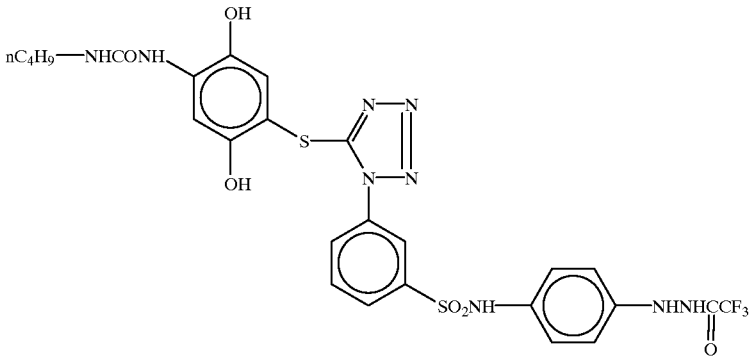

I-36

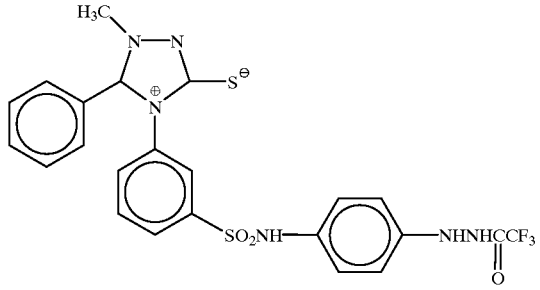

In addition to the above-described compounds, the hydrazine derivative for use in the present invention includes those described in *Research Disclosure*, Item 23516 (November, 1983, page 346) and publications cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent 2,011,391B, European Patents 217,310, 301, 799 and 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765 and JP-A-6-289254, which may be used in combination.

The addition amount of the hydrazine derivative of the present invention is preferably from $1\times10^{-6}$ to $5\times10^{-2}$ mol, more preferably from $1\times10^{-5}$ to $2\times10^{-2}$ mol, per mol of silver halide.

The hydrazine derivative of the present invention may be dissolved in an appropriate water-miscible organic solvent, such as alcohols (e.g., methanol, ethanol, propanol, fluorinated alcohol), ketones (e.g., acetone, methyl ethyl ketone), dimethylformamide, dimethylsulfoxide or methyl cellosolve, before use.

Or, the hydrazine derivative of the present invention may be dissolved by generally well-known emulsion-dispersion method using an oil such as dibutyl phthalate, tricresyl phosphate, glyceryl triacetate or diethyl phthalate or an auxiliary solvent such as ethyl acetate or cyclohexanone, formed into an emulsified dispersion by a mechanical means and then used. Further, the hydrazine derivative in the form of powder may be dispersed in water by a ball mill, a colloid mill or an ultrasonic wave according to a method known as a solid dispersion method and then used.

The nucleation accelerator for use in the present invention is a compound represented by formula (XII), (XIII), (XIV) or (XV):

(XII)

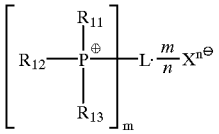

wherein $R_{11}$, $R_{12}$ and $R_{13}$ each represents an alkyl group, a cycloalkyl group, an aryl group, an alkenyl group, a cycloalkenyl group or a heterocyclic residue which may further have a substituent, m represents an integer of from 1 to 4, L represents an m-valent organic group connected to the P atom through the carbon atom, n represents an integer of from 1 to 3 and X represents an n-valent anion provided that X may be linked with L;

(XIII)

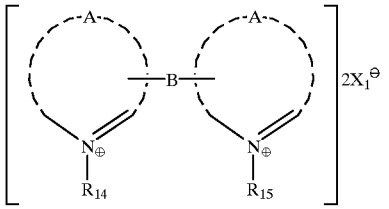

(XIV)

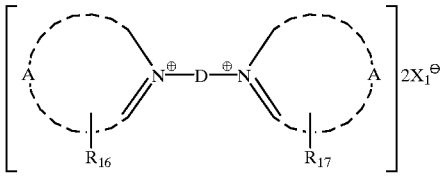

(XV)

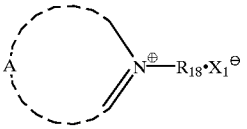

wherein A represents an organic group necessary for completing the hetero ring, B and D each represents a divalent group, $R_{14}$ and $R_{15}$ each represents an alkyl group or an aryl group, $R_{16}$ and $R_{17}$ each represents a hydrogen atom or a substituent, $R_{18}$ represents an alkyl group and $X_1$ represents an anion group provided that when an inner salt is formed, $X_1$ is not required.

Formula (XII) will be described in detail.

(XII)

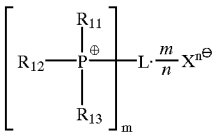

wherein $R_{11}$, $R_{12}$ and $R_{13}$ each represents an alkyl group, a cycloalkyl group, an aryl group, an alkenyl group, a cycloalkenyl group or a heterocyclic residue which may further have a substituent, m represents an integer of from 1 to 4, L represents an m-valent organic group connected to the P atom through the carbon atom, n represents an integer of from 1 to 3 and X represents an n-valent anion provided that X may be linked with L.

Examples of the group represented by $R_{11}$, $R_{12}$ or $R_{13}$ include a linear or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; an aralkyl group such as a substituted or unsubstituted benzyl group; a cycloalkyl group such as a cyclopropyl group, a cyclopentyl group and a cyclohexyl group; an aryl group such as a phenyl group, a naphthyl group and phenanthryl group; an alkenyl group such as an allyl group, a vinyl group and a 5-hexenyl group; a cycloalkenyl group such as a cyclopentenyl group or a cyclohexenyl group; and a heterocyclic residue such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group and a pyrrolidyl group. Examples of the substituent substituted on the above-described group include, in addition to the groups represented by $R_{11}$, $R_{12}$ or $R_{13}$, a halogen atom such as a fluorine atom, a chlorine atom, a bromine atom and an iodine atom, a nitro group, a primary, secondary or tertiary amino group, an alkyl- or arylether group, an alkyl- or arylthioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group and a carbonyl group. Examples of the group represented by L include the same as those described for $R_{11}$, $R_{12}$ or $R_{13}$ and additionally, a polymethylene group such as a trimethylene group, a tetramethylene group, a hexamethylene group, a pentamethylene group, an octamethylene group and a dodecamethylene group, a divalent aromatic group such as a phenylene group, a biphenylene group and a naphthylene group, a polyvalent aliphatic group such as a trimethylenemethyl group and a tetramethylenemethyl group and a polyvalent aromatic group such as a phenylene-1,3,5-toluyl group and a phenylene-1,2,4,5-tetrayl group.

Examples of the anion represented by X include a halogen ion such as c chlorine ion, a bromine ion and an iodine ion, a carboxylate ion such as acetate ion, an oxalate ion, a fumarate ion and a benzoate ion, a sulfonate ion such as p-toluene sulfonate, a methane sulfonate, a butane sulfonate and a benzene sulfonate, a sulfuric acid ion, a perchloric acid ion, a carbonic acid ion and a nitric acid ion.

In formula (XII), $R_{11}$, $R_{12}$ and $R_{13}$ each is preferably a group having 20 or less carbon atoms, more preferably an aryl group having 15 or less carbon atoms. m is preferably 1 or 2 and when m is 1, L is preferably a group having 20 or less carbon atoms, more preferably an alkyl or aryl group having a total carbon number of 15 or less. When m is 2, the divalent organic group represented by L is preferably an alkylene group, an arylene group, a divalent group resulting from bonding of these group or a divalent group formed by bonding to these groups a —CO— group, an —O— group, an —$NR_{19}$ group (wherein $N_{19}$ represents a hydrogen atom or the same groups as described for $R_{11}$, $R_{12}$ or $R_{13}$, provided that when a plurality of $R_{19}$ groups is present, the $R_{19}$ groups may be the same or different, or may be combined with each other), an —S— group, an —SO— group or an —$SO_2$— group. When m is 2, L is more preferably a divalent group having a total carbon number of 20 or less connected to the P atom through the carbon atom. When m represents an integer of 2 or greater, $R_{11}$, $R_{12}$ and $R_{13}$ each may be present in plurality in the molecule and the $R_{11}$, $R_{12}$ or $R_{13}$ groups in plurality may be the same or different.

n is preferably 1 or 2 and m is preferably 1 or 2. X may be combined with $R_{11}$, $R_{12}$, $R_{13}$ or L to form an inner salt.

In order to effect addition to a specific layer of a silver halide photographic material, $R_{11}$, $R_{12}$ or $R_{13}$ preferably has a ballast group for reducing the diffusibility or an adsorption accelerator to silver halide as a part of the substituent. The ballast group is preferably a group having a total carbon number of 15 or more for use in a silver halide photographic coupler. The adsorption accelerator to silver halide is preferably a thioamide compound (e.g., thiourethane, thioureido, thioamide), a mercapto compound (e.g., a heterocyclic mercapto such as 5-mercaptotetrazole, 3-mercapto-1,2,4-triazole, 2-mercapto-1,3,4-thiadiazole and 2-mercapto-1,3,4-oxadiazole, an alkylmercapto, an arylmercapto) or a 5- or 6-membered nitrogen-containing heterocyclic ring capable of forming an imino silver (e.g., benzotriazole).

Many compounds represented by formula (XII) of the present invention are known and commercially available as a reagent. The general synthetic method thereof include a method where a phosphinic acid is reacted with an alkylating agent such as an alkyl halide or a sulfonate and a method where a counter anion of a phosphonium salt is exchanged by a usual method.

Specific examples of the compound represented by formula (XII) are set forth below, but the present invention is by no means limited to these compounds.

A-101

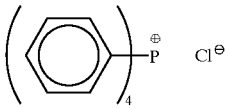

A-102

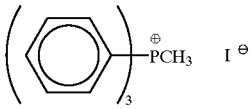

A-103

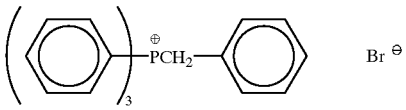

A-104

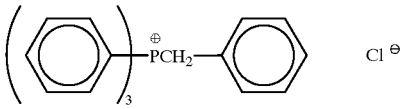

A-105

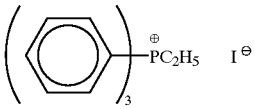

A-106

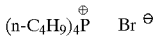

A-107

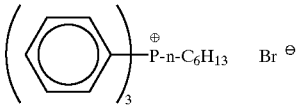

A-108

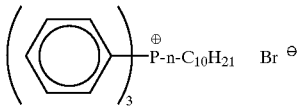

A-109

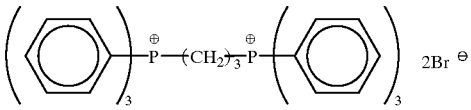

A-110

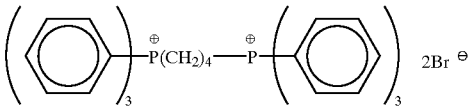

A-111

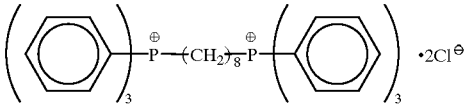

-continued
A-112
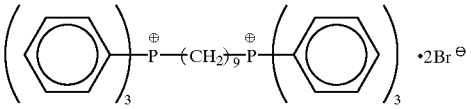
A-113
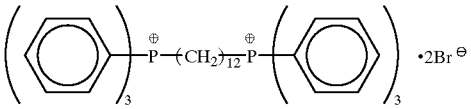
A-114
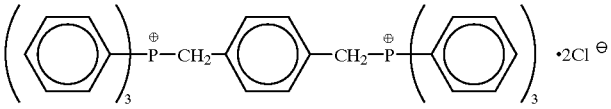
A-115
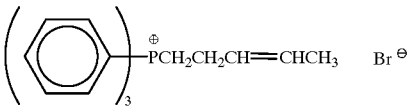
A-116
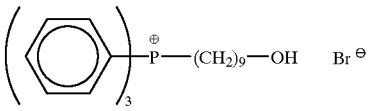
A-117
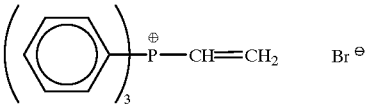
A-118
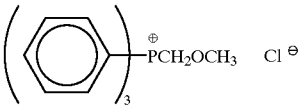
A-119
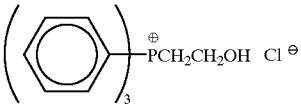
A-120
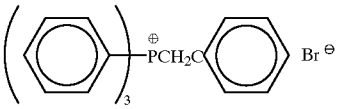
A-121
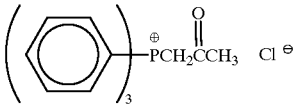
A-122
$(n\text{-}C_4H_9)_3\overset{\oplus}{P}CH_2CH_2OH \quad Br^{\ominus}$
A-123
$(n\text{-}C_4H_9)_3\overset{\oplus}{P}C_2H_5{}^{1}\!/_{2}SO_4{}^{2\ominus}$ -continued
A-124
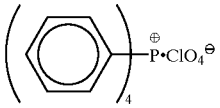
A-125
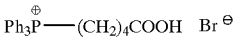
A-126
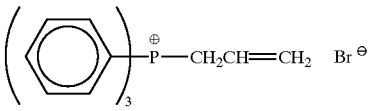
A-127
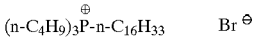
A-128
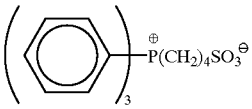
A-129
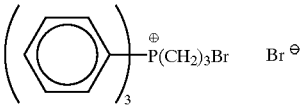
A-130
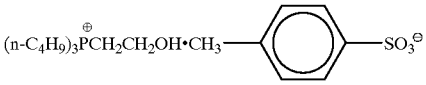
A-131
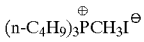
A-132
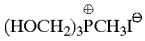
A-133
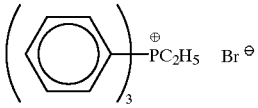
A-134
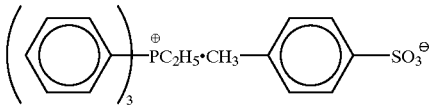
A-135
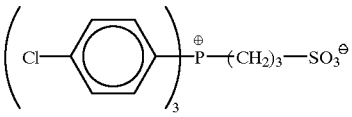
A-136
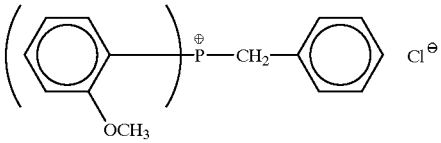

-continued
A-137
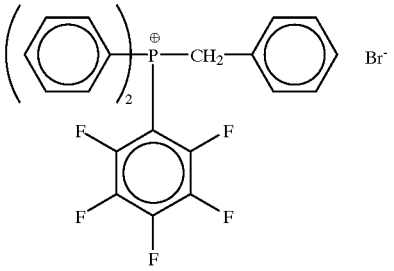
A-138
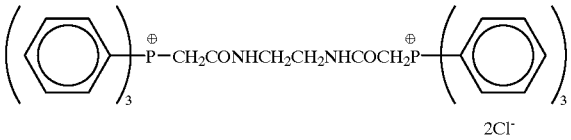
A-139
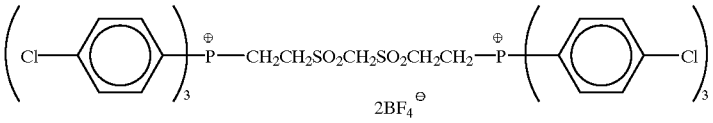
A-140
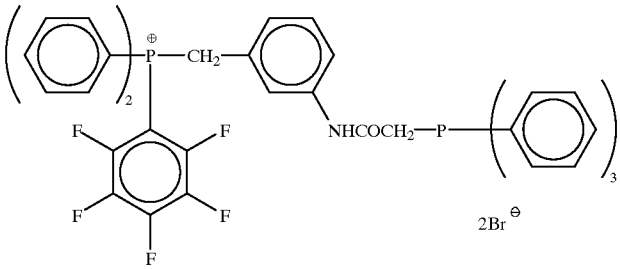
A-141
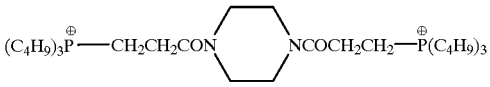
A-142
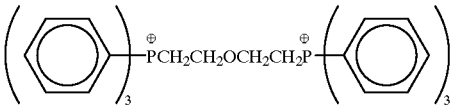
A-143
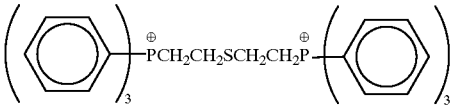
A-144
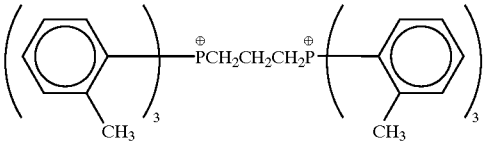

-continued

A-145

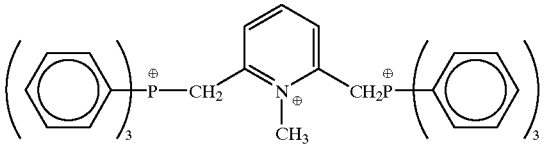

$3CF_3SO_3^{\ominus}$

A-146

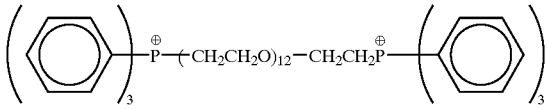

$2Br^{\ominus}$

A-147

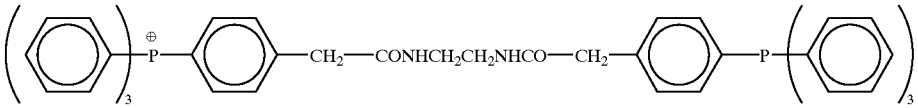

Formulae (XIII), (XIV) and (XV) will be described below in detail.

(XIII)

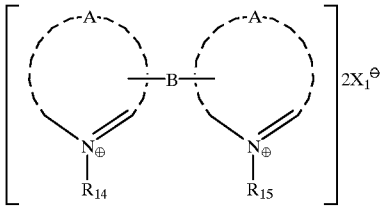

(XIV)

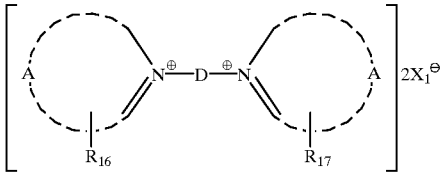

(XV)

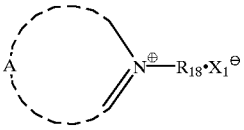

wherein A represents an organic group necessary for completing the hetero ring, which may contain a carbon atom, a hydrogen atom, an oxygen atom, a nitrogen atom or a sulfur atom and also may be condensed to a benzene ring. Preferred examples of A include 5- and 6-membered rings and more preferred examples thereof include a pyridine ring, a quinoline ring and an isoquinoline ring. Also, A may be substituted and preferred examples of the substituent include a halogen atom (e.g., chlorine atom, bromine atom), a substituted or unsubstituted alkyl group (e.g., methyl, hydroxyethyl), a substituted or unsubstituted aralkyl group (e.g., benzyl, p-methoxyphenetyl), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxy group, a hydroxy group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group and an arylthio group. Particularly preferred examples of the substituent include an aryl group, a sulfo group, a carboxyl group and a hydroxy group.

The divalent group represented by B or D is preferably constituted by alkylene, arylene, alkenylene, —$SO_2$—, —SO—, —O—, —S— or —$N(R_{20})$— (wherein $R_{20}$ represents an alkyl group, an aryl group or a hydrogen atom) solely or in combination. The divalent group represented by B or D is more preferably constituted by alkylene, arylene, —O— or —S— solely or in combination.

$R_{14}$ and $R_{15}$, which may be the same or different, each is preferably an alkyl group having from 1 to 20 carbon atoms. The alkyl group may be substituted by a substituent and examples of the substituent include a halogen atom (e.g., chlorine atom, bromine atom), a substituted or unsubstituted aryl group (e.g., phenyl, tolyl, p-chlorophenyl, furyl, thienyl, naphthyl), a substituted or unsubstituted acyl group (e.g., benzoyl, p-bromobenzoyl, acetyl), a sulfo group, a carboxyl group, a hydroxy group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group and an arylthio group. $R_{14}$ and $R_{15}$ each is more preferably an alkyl group having from 1 to 10 carbon atom. Preferred examples of the substituent include an aryl group, a sulfo group, a carboxyl group and a hydroxy group.

$R_{16}$ and $R_{17}$ each represents a hydrogen atom or a substituent and examples of the substituent include those described as the substituent of the alkyl group for $R_{14}$ or $R_{15}$. $R_{16}$ and $R_{17}$ each preferably has from 0 to 10 carbon atoms and specific examples thereof include an aryl-substituted alkyl group or a substituted or unsubstituted aryl group.

$R_{18}$ is preferably a linear, branched or cyclic alkyl group having from 1 to 20. The alkyl group may be substituted by a substituent and examples of the substituent include those described as the substituent of the alkyl group for $R_{14}$ or $R_{15}$.

$X_1$ represents an anion group provided that when an inner salt is formed, $X_1$ is not required. More specifically, $X_1$ represents a chlorine ion, a bromine ion, an iodine ion, a nitric acid ion, a sulfuric acid ion, a p-toluenesulfonic acid ion or an oxalato.

In order to effect addition to a specific layer of a silver halide photographic material, $R_{16}$, $R_{17}$ or $R_{18}$ preferably has a ballast group for reducing the diffusibility or an adsorption accelerator to silver halide as a part of the substituent. The ballast group is preferably a group having a total carbon number of 15 or more for use in a silver halide photographic coupler. The adsorption accelerator to silver halide is preferably a thioamide (e.g., thiourethane, thioureido, thioamide), a mercapto (e.g., a heterocyclic mercapto such as 5-mercaptotetrazole, 3-mercapto-1,2,4-triazole, 2-mercapto-1,3,4-thiadiazole and 2-mercapto-1,3,4-oxadiazole, an alkylmercapto, an arylmercapto) or a 5- or 6-membered nitrogen-containing heterocyclic ring capable of forming an imino silver (e.g., benzotriazole).

The compounds represented by formulae (XIII), (XIV) and (XV) of the present invention can be easily synthesized by a generally well-known method (e.g., described in *Quart. Rev.,* 16, 163 (1962)).

Specific examples of the compound represented by formulae (XIII), (XIV) and (XV) are set forth below, but the present invention is by no means limited to these compounds.

A-201

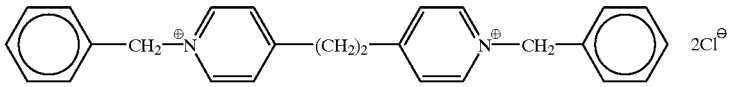

A-202

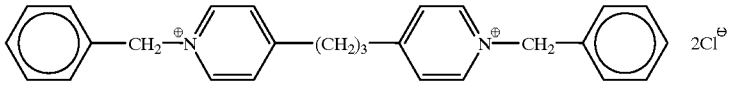

A-203

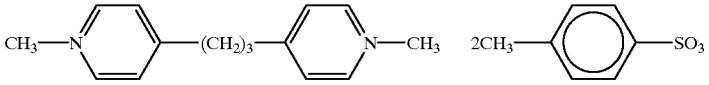

A-204

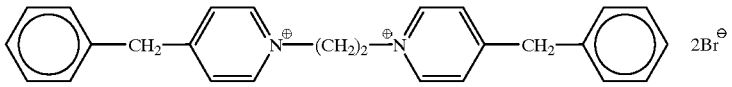

A-205

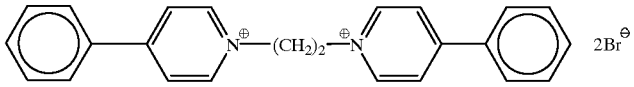

A-206

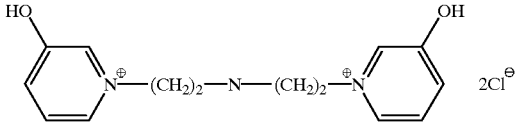

A-207

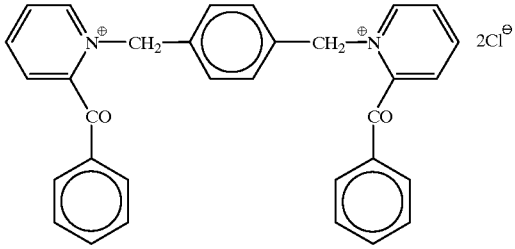

A-208

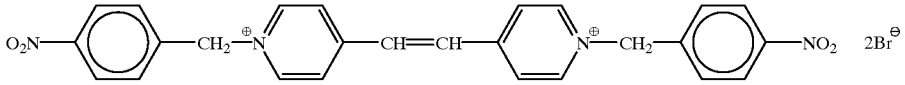

A-209

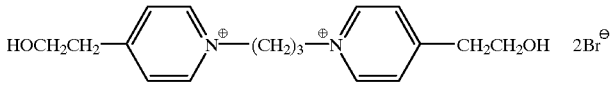

-continued
A-210
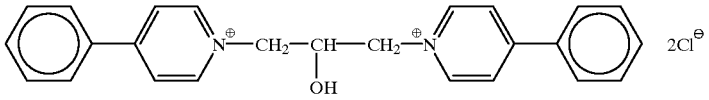
A-211
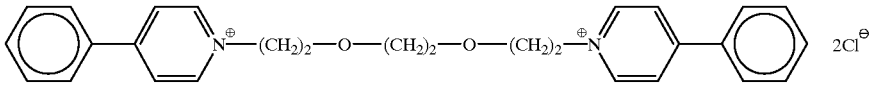
A-212
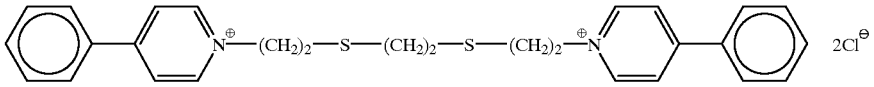
A-213
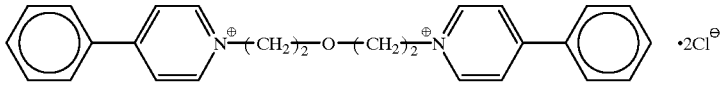
A-214
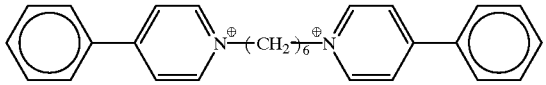
A-215
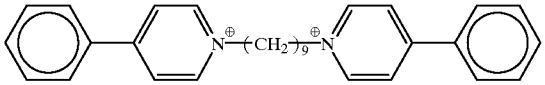
A-216
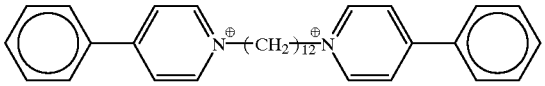
A-217
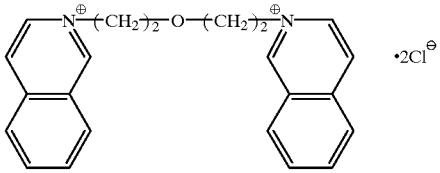
A-218
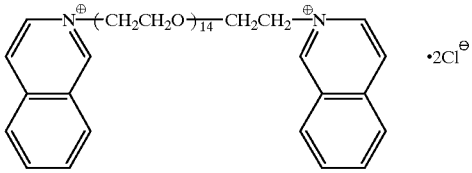
A-219
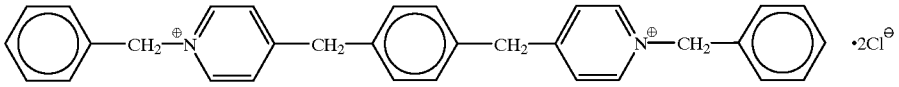
A-220
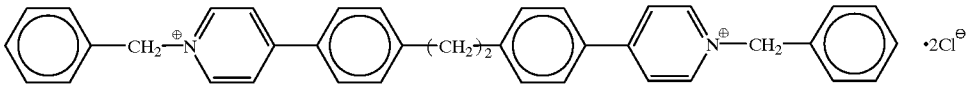
A-221
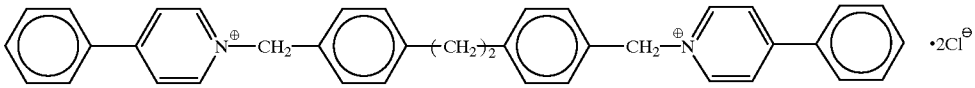
A-222
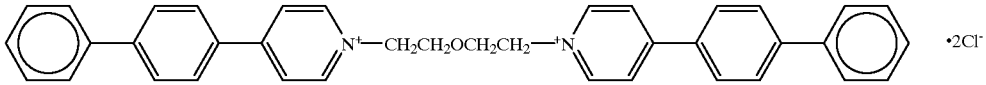

-continued
A-223
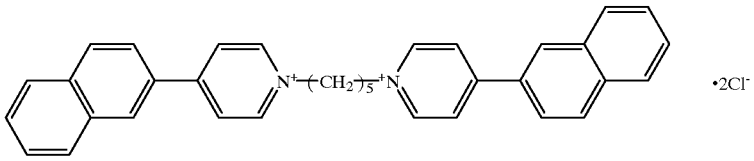
A-224
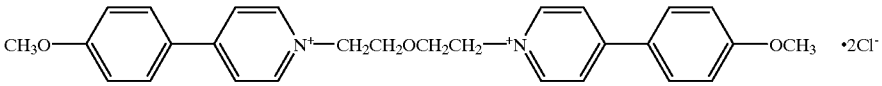
A-225
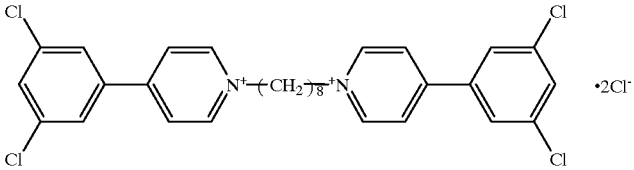
A-226
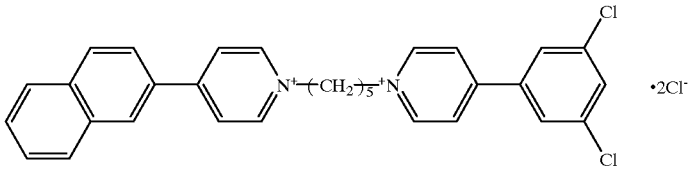
A-227
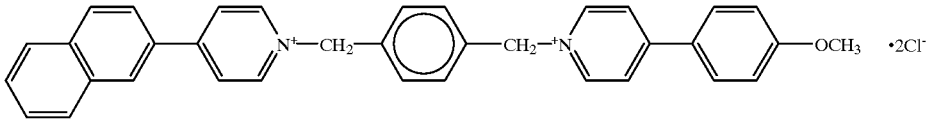
A-228
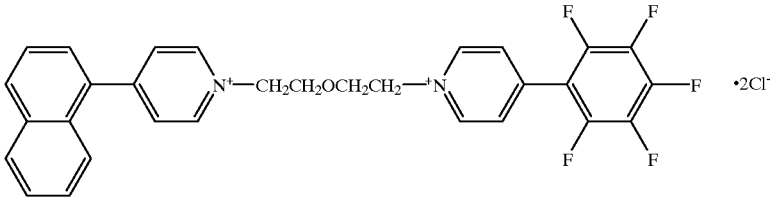
A-229
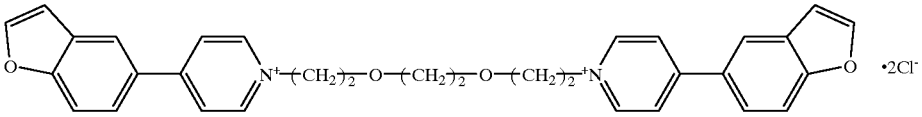
A-230
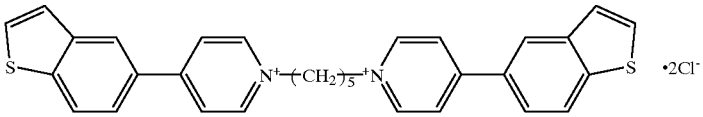
A-231
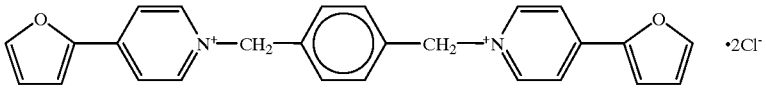
A-232
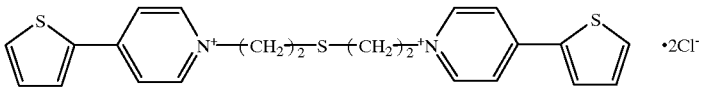

-continued
A-233
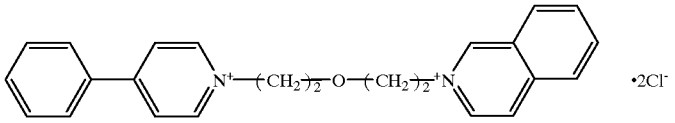
A-234
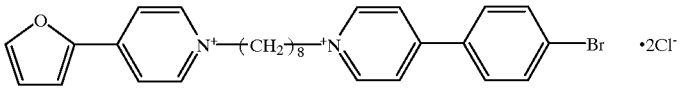
A-235
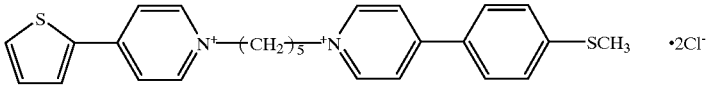
A-236
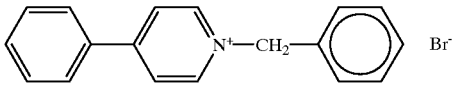
A-237
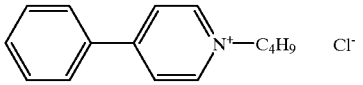
A-238
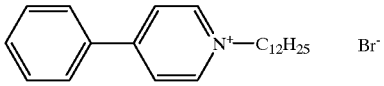
A-239
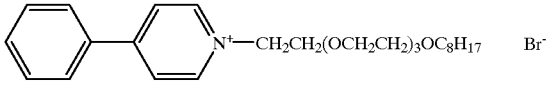
A-240
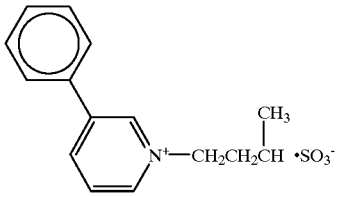
A-241
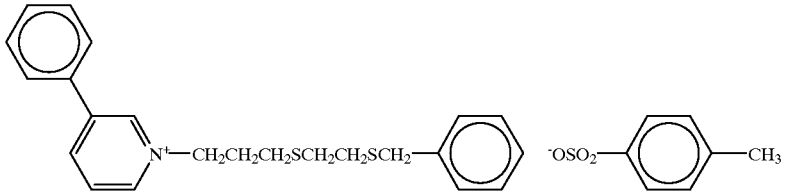
A-242
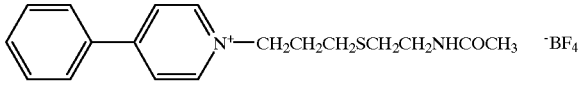
A-243
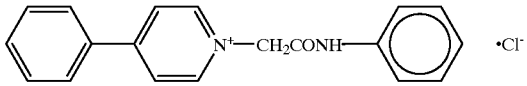
A-244
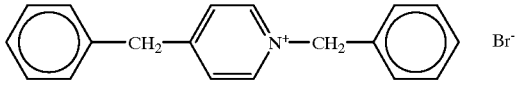

-continued
A-245
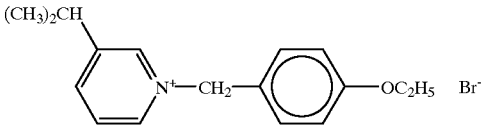
A-246
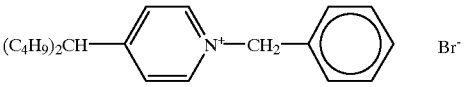
A-247
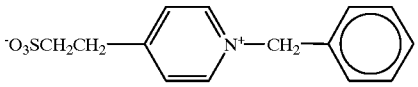
A-248
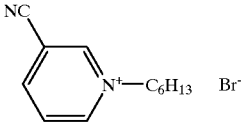
A-249
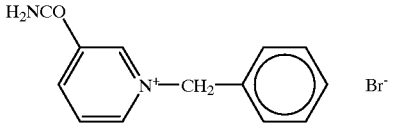
A-250
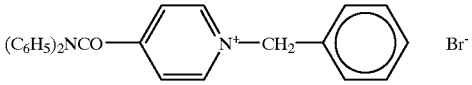
A-251
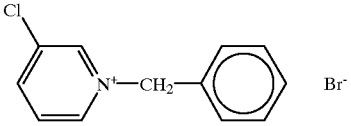
A-252
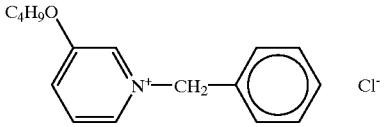
A-253
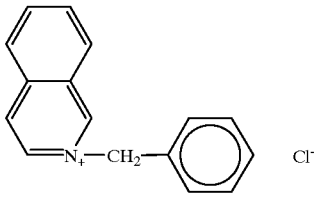
A-254
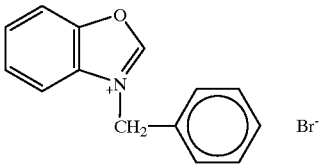
A-255
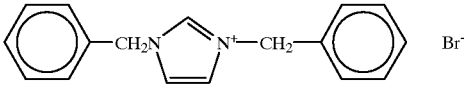

-continued

A-256

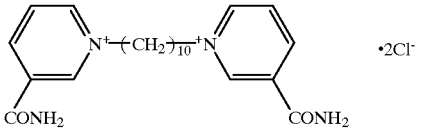

A-257

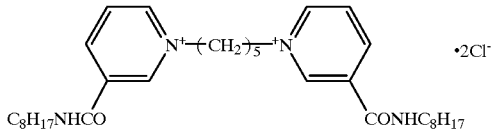

A-258

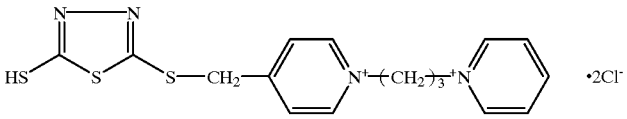

A-259

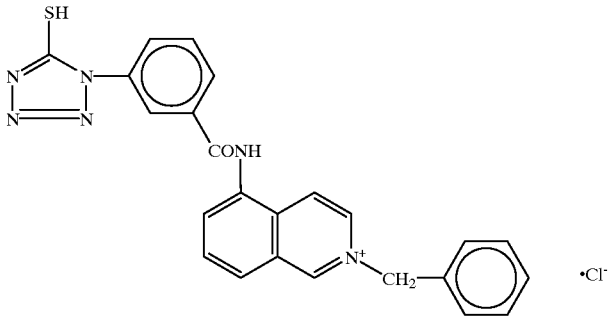

A-260

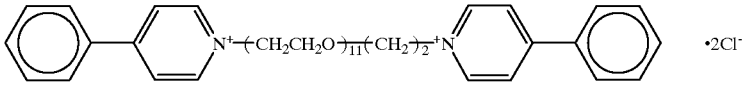

A-261

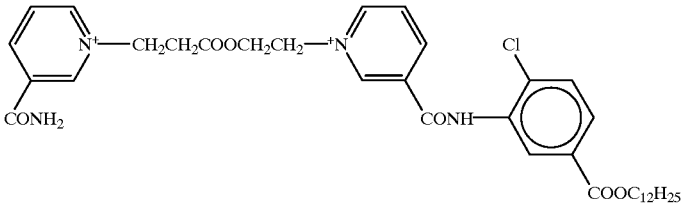

A-262

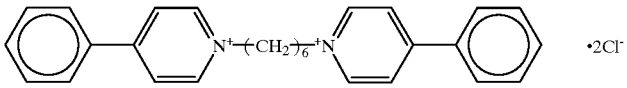

The addition amount of the compound represented by formula (XII), (XIII), (XIV) or (XV) of the present invention is not particularly limited, however, it is preferably from $1\times10^{-5}$ to $2\times10^{-2}$ mol, more preferably from $2\times10^{-5}$ to $1\times10^{-2}$ mol, per mol of silver halide.

The nucleation accelerator which is particularly preferably used in the present invention is a compound represented by formula (XIV).

The compound of formula (XII), (XIII), (XIV) or (XV) of the present invention may be incorporated into a photographic material in such a manner that, in case of a water-soluble compound, an aqueous solution thereof or, in case of a water-insoluble compound, a solution thereof in a water-miscible organic solvent such as alcohols (e.g., methanol, ethanol), esters (e.g., ethyl acetate) or ketones (e.g., acetone) is added to a silver halide emulsion solution or a hydrophilic colloid solution.

Also, the compound may be dissolved by a well-known emulsion-dispersion method using an oil such as dibutyl phthalate, tricresyl phosphate, glyceryl triacetate or diethyl phthalate or an auxiliary solvent such as ethyl acetate or cyclohexanone, formed into an emulsificated dispersion by a mechanical means and then used. Or, the compound can also be used as a fine dispersion in accordance with a method known as a solid dispersion method.

In embodiment (a) of the present invention, when the above-described hydrazine derivative and nucleation accelerator are added, fogging of a silver halide emulsion must be suppressed as much as possible because the fog is further increased due to the hydrazine derivative and the nucleation accelerator.

Accordingly, in the emulsion (a) of the present invention, a thiosulfonic acid compound represented by formula (XVI), (XVII) or (XVIII) is preferably added to the silver halide grain during the grain formation and/or the gold-sulfur sensitization step. By doing so, an emulsion low in fogging can be obtained.

$$R—SO_2S—M \quad (XVI)$$

$$R—SO_2S—R^1 \quad (XVII)$$

$$R—SO_2S—L_1m_1—SSO_2—R^2 \quad (XVIII)$$

wherein R, $R^1$ and $R^2$, which may be the same or different, each represents an aliphatic group, an aromatic group or a heterocyclic group, M represents a cation, $L_1$ represents a divalent linking group and $m_1$ is 0 or 1.

The compound represented by formula (XVI), (XVII) or (XVIII) may be a polymer containing a divalent group derived from the structure represented by formula (XVI), (XVII) or (XVIII) as a repeating unit.

Specific examples of formulae (XVI) to (XVIII) are set forth below, but the present invention is not limited thereto.

(1-1)

$CH_3SO_2SNa$ (1-2)

$C_2H_5SO_2SNa$ (1-3)

$C_3H_7SO_2SK$ (1-4)

$C_4H_9SO_2SLi$ (1-5)

$C_6H_{13}SO_2SNa$ (1-6)

$C_8H_{17}SO_2SNa$ (1-7)

$CH_3(CH_2)_3CH(C_2H_5)CH_2SO_2S \cdot NH_4$ (1-8)

$C_{10}H_{21}SO_2SNa$ (1-9)

$C_{12}H_{25}SO_2SNa$ (1-10)

$C_{16}H_{33}SO_2SNa$ (1-11)

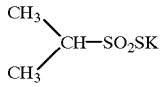

(1-12)

$t\text{-}C_4H_9SO_2SNa$ (1-13)

$CH_3OCH_2CH_2SO_2S \cdot Na$ (1-14)

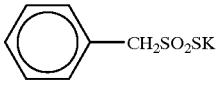

(1-15)

$CH_2{=}CHCH_2SO_2SNa$

-continued (1-16)

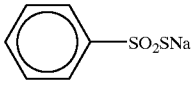

(1-17)

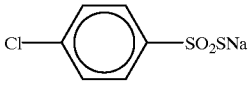

(1-18)

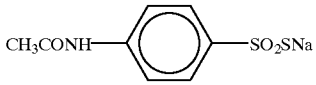

(1-19)

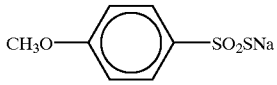

(1-20)

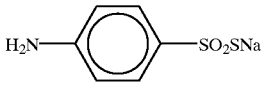

(1-21)

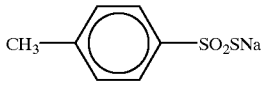

(1-22)

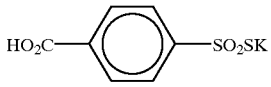

(1-23)

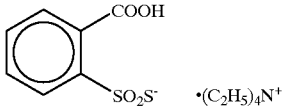

(1-24)

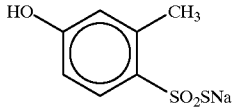

(1-25)

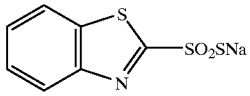

(1-26)

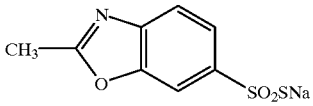

(1-27)

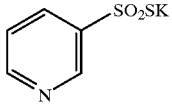

(1-28)

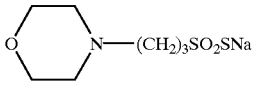

(2-1)

$C_2H_5SO_2S—CH_3$

-continued
(2-2)
$C_8H_{17}SO_2SCH_2CH_3$
(2-3)
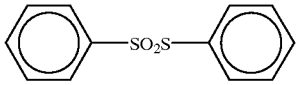
(2-4)
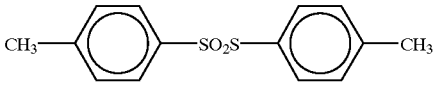
(2-5)
$C_2H_5SO_2SCH_2CH_2CN$
(2-6)
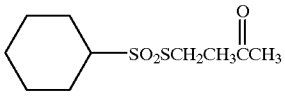
(2-7)
$C_4H_9SO_2SCH(CH_3)CH_2CN$
(2-8)
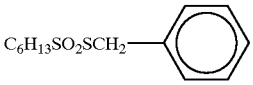
(2-9)
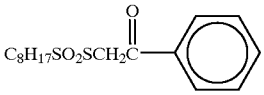
(2-10)
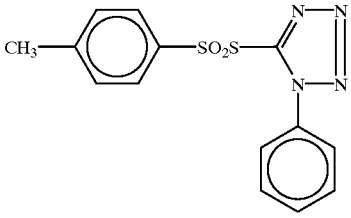
(2-11)
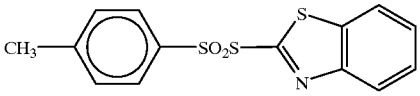
(2-12)
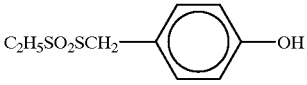
(2-13)
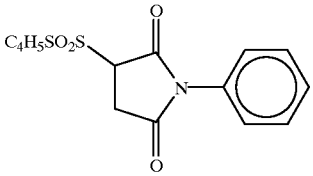
(2-14)
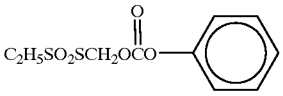
-continued
(2-15)
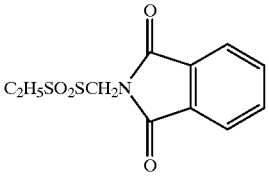
(2-16)
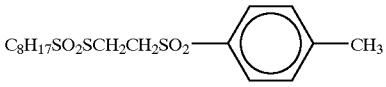
(2-17)
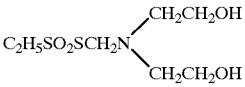
(2-18)
$C_2H_5SO_2SCH_2CH_2CH_2CH_2OH$
(2-19)
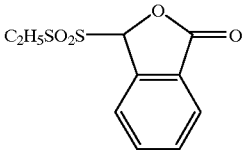
(2-20)
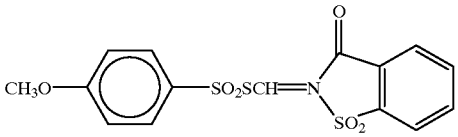
(3-1)
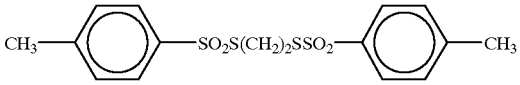
(3-2)
$C_2H_5SO_2SCH_2CH_2SO_2CH_2CH_2SSO_2C_2H_5$
(3-3)
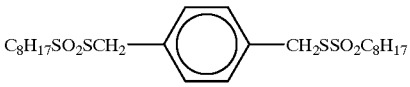
(3-4)
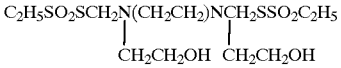
(3-5)
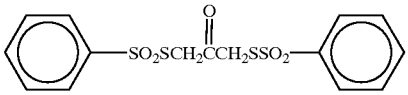
(3-6)
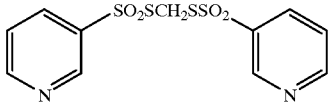
(3-7)
$C_2H_5SO_2SSSO_2C_2H_5$
(3-8)
$n\text{-}C_8H_{17}SO_2SSSO_2C_8H_{17}\text{-}n$ -continued (3-9)

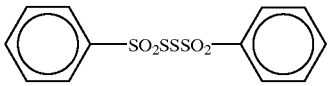

In order to obtain superhigh photographic properties having a safe-light safety capable of endure the use in a bright room using the silver halide photographic material of the present invention, a conventional infectious developer or a high alkali developer having a pH close to 13 described in U.S. Pat. No. 2,419,975 needs not be used and a stable developer can be used. More specifically, the silver halide photographic material of the present invention provides a sufficiently superhigh image with a developer containing a sulfite ion as a preservative in an amount of 0.15 mol/liter or more and having a pH of from 9.5 to 11.0.

The development and the fixing are not particularly limited in the present invention, however, the developer preferably uses a developing agent such as a dihydroxybenzene compound or a reductone.

The developer using a dihydroxybenzene-based developing agent preferably has the following composition.

The developer comprises:

(1) from 0.2 to 0.75 mol/liter of a dihydroxybenzene-based developing agent, (2) from 0.001 to 0.06 mol/liter of 1-phenyl-3-pyrazolidone-based or p-aminophenol-based auxiliary developing agent, (3) from 0.15 to 1.2 mol/liter of free sulfite ions, and (4) a compound represented by formula (XIX), with the concentration ratio of the compound represented by formula (XIX) to the dihydroxybenzene-based developing agent being from 0.03 to 0.12, and has a pH of from 9.0 to 11.0, preferably 9.5 to 10.7.

(XIX)

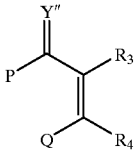

wherein $R_3$ and $R_4$ each represents a hydroxy group, an amino group, an acylamino group, an alkylsulfonylamino group, an arylsulfonylamino group, an alkoxycarbonylamino group, a mercapto group or an alkylthio group; P and Q each represents a hydroxy group, a carboxyl group, an alkoxy group, a hydroxyalkyl group, a carboxyalkyl group, a sulfo group, a sulfoalkyl group, an amino group, an aminoalkyl group, an alkyl group, an aryl group or an atomic group necessary for forming a 5-, 6-, 7- or 8-membered ring by combining P and Q with each other together with two vinyl carbon atoms to which $R_3$ and $R_4$ are substituted and the carbon atom to which Y" is substituted; and Y" represents =O or =N—$R_5$ (wherein $R_5$ represents a hydrogen atom, a hydroxyl group, an alkyl group, an acyl group, a hydroxyalkyl group, a sulfoalkyl group or a carboxyalkyl group).

Formula (XIX) and specific compounds thereof are described in detail in Japanese Patent Application No. 5-282101.

Among those, preferred are an ascorbic acid or an erysorbic acid (stereoisomer). The compound of formula (XIX) is added in such an amount to give a concentration ratio (a value obtained by dividing the concentration of the compound represented by formula (XIX) by the concentration of the dihydroxybenzene-based developing agent) of (compound represented by formula (XIX)/hydroquinone-based developing agent) of from 0.03 to 0.12, preferably from 0.03 to 0.10, more preferably from 0.05 to 0.09.

Preferred examples of the dihydroxybenzene-based developing agent for use in the present invention include hydroquinone, chlorohydroquinone, bromohydroquinone, isopropylhydroquinone, methylhydroquinone, 2,3-dibromohydroquinone and 2,5-dimethylhydroquinone. Particularly preferred is hydroquinone. The concentration of the hydroquinone derivative in the developer is from 0.2 to 0.75 mol/liter, preferably from 0.2 to 0.5 mol/liter, more preferably from 0.2 to 0.4 mol/liter.

Examples of the 1-phenyl-3-pyrazolidone derivative developing agent for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone, with 1-phenyl-3-pyrazolidone and 1-phenyl-4-methyl-4-hydroxymethyl-3-pyrazolidone being preferred.

Examples of the p-aminophenol-based developing agent include N-methyl-p-aminophenol, p-aminophenol, N-(β-hydroxyethyl)-p-aminophenol and N-(4-hydroxyphenyl) glycine, with N-methyl-p-aminophenol being preferred.

In the case when a dihydroxybenzene and a 1-phenyl-3-pyrazolidone or a p-aminophenol are combined, the former is preferably used in an amount of from 0.05 to 0.5 mol/liter and the latter is preferably used in an amount of 0.06 mol/liter or less.

When a reductone is used as a developing agent, the compound of formula (XIX) is preferably used as a reductone and an ascorbic acid or an erysorbic acid (stereoisomer) is more preferred. In this case, the auxiliary developing agent may be the same with that for the dihydroxybenzene-based developing agent and p-aminophenol-based and/or 1-phenyl-3-pyrazolidone-based auxiliary developing agents are preferred. When the compound of formula (XIX) is used as a developing agent, the use amount thereof is generally from $5\times10^{-3}$ to 1 mol, more preferably from $10^{-2}$ to 0.5 mol, per liter of the developer.

A preferred preservative for use in the developer of the present invention is a free sulfite ion and the free sulfite ion is added to the developer in the form of sodium sulfite, lithium sulfite, ammonium sulfite or sodium bisulfite. The concentration of the free sulfite ion is from 0.15 to 1.2 mol/liter, preferably from 0.3 to 1.0 mol/liter, more preferably from 0.3 to 0.8 mol/liter.

The developer for use in the development of the present invention has a pH of from 9.0 to 11.0, preferably from 9.5 to 10.7. The alkali agent used for setting the pH includes a pH adjusting agent such as sodium hydroxide, sodium carbonate, sodium tertiary phosphate, potassium hydroxide, potassium carbonate or boric acid.

In the developer used in the method of the present invention, a dialdehyde-based hardening agent or a bisulfite adduct thereof may be used. Specific examples thereof include glutaraldehyde, α-methylglutaraldehyde, β-methylglutaraldehyde, maleindialdehyde, succindialdehyde, methoxysuccindialdehyde, methylsuccindialdehyde, α-methoxy-,β-ethoxyglutaraldehyde, α,-n-butoxyglutaraldehyde, α,α-diethylsuccindialdehyde, butylmaleindialdehyde and a bisulfite adduct of these. Among these, glutaraldehyde and a bisulfite adduct thereof are most commonly used. The dialdehyde compound is used in such an amount that the sensitivity of photographic layers to be processed is not suppressed and the crying time is not so extremely prolonged. More specifically, the dialdehyde compound is used in an amount of from 1 to 50 g, preferably from 3 to 10 g, per liter of the developer.

In the developer for use in the method of the present invention, an antifoggant is used and the antifoggant includes an indazole-based antifoggant, a benzimidazole-based antifoggant and a benztriazole-based antifoggant. Examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenztriazole, sodium 4-[(2-mercapto-1,3,4-thiadiazole-2-yl)thio]butanesulfonate and 5-amino-1,3,4-thiadiazole-2-thiol. The antifoggant is used in an amount of generally from 0.01 to 10 mmol, preferably from 0.1 to 2 mmol, per liter of the developer. In addition to these organic antifoggants, for example, a halide such as potassium bromide and sodium bromide may be used.

In the developer for use in the present invention, various organic-inorganic chelating agents may be used in combination. As the inorganic chelating agent, sodium tetrapolyphosphate or sodium hexametaphosphate may be used.

As the organic chelating agent, an organic carboxylic acid, an aminopolycarboxylic acid, an organic phosphonic acid, an aminophosphonic acid or an organic phosphonocarboxylic acid may be mainly used.

Examples of the organic carboxylic acid include an acrylic acid, an oxalic acid, a malonic acid, a succinic acid, a glutaric acid, an adipic acid, a pimelic acid, a cork acid, an azelaic acid, a sebacic acid, a nonanedicarboxylic acid, a decanedicarboxylic acid, an undecanedicarboxylic acid, a maleic acid, an itaconic acid, a malic acid, a citric acid and a tartaric acid, but these are not limitative.

Examples of the aminopolycarboxylic acid include iminodiacetic acid, nitriloacetic acid, nitrilopropionate, ethylenediaminomonohydroxyethyltriacetic acid, ethylenediaminetetraacetic acid, a glycolethertetraacetic acid, 1,2-diaminopropanetetraacetic acid, diethylenetriaminepentaacetic acid, triethyleneteramine-hexaacetic acid, 1,3-diamino-2-propanoltetraacetic acid, glycoletherdiaminotetraacetic acid and the compounds described in JP-A-52-25632, JP-A-55-67747, JP-A-57-102624 and JP-B-53-40900.

Examples of the organic phosphonic acid include hydroxyalkylidene-diphosphonic acid described in U.S. Pat. Nos. 3,214,454 and 3,794,591 and West German Patent (OLS) No. 2,227,639 and the compounds described in *Research Disclosure*, Vol. 181, Item 18170 (May, 1979).

Examples of the aminophosphonic acid include aminotris (methylenephoshonic acid), ethylenediaminotetramethylenephosphonic acid, aminotrimethylenephosphonic acid and the compounds described in *Research Disclosure*, No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No. 18170.

These chelating agent may be used in the form of an alkali metal salt or an ammonium salt. The addition amount of the chelating agent is preferably from $1\times10^{-4}$ to $1\times10^{-1}$ mol, more preferably from $1\times10^{-3}$ to $1\times10^{-2}$ mol, per liter of the developer.

In addition to the above-described composition, the developer for use in the method of the present invention may contain, if desired, a buffering agent (e.g., carbonate, alkanolamine), an alkali agent (e.g., hydroxide, carbonate), a dissolution aid (e.g., polyethylene glycols and an ester thereof), a pH adjustor (e.g., organic acid such as acetic acid), a development accelerator (e.g., various pyridinium compounds and other cationic compounds described in U.S. Pat. No. 2,648,604, JP-B-44-9503 and U.S. Pat. No. 3,171,247, a cationic dye such as phenosafranine, a neutral salt such as thallium nitrate and potassium nitrate, polyethylene glycol and a derivative thereof described in JP-B-44-9304, U.S. Pat. Nos. 2,533,990, 2,531,832, 2,950,970 and 2,577,127, a nonionic compound such as polythioether, an organic solvent described in JP-B-44-9509 and Belgian Patent 682,862 and thioether-based compounds described in U.S. Pat. No. 3,201,242, with the thioether-based compounds being particularly preferred) or a surface active agent.

The development temperature and the development time are interrelated with each other and determined in view of the total processing time, however, in general, the processing temperature is from about 20 to about 50° C. and the processing time is from 10 seconds to 2 minutes.

In processing a silver halide black-and-white photographic material in a size of 1 $m^2$, the replenishing amount of the developer is 400 ml or less, preferably 200 ml or less.

The fixing solution used in the fixing step of the present invention is an aqueous solution containing sodium thiosulfate, ammonium thiosulfate, if desired, tartaric acid, citric acid, gluconic acid, boric acid, iminodiacetic acid, 5-sulfosalicylic acid, glucoheptanic acid, Tiron, ethylenediaminetetraacetic acid, diethylenetriaminepentaacetic acid, nitrilotriacetic acid and a salt of these. In view of the environmental conservation as a matter of concerns in recent years, it is preferred not to contain the boric acid.

The fixing agent of the fixing solution for use in the present invention includes sodium thiosulfate and ammonium thiosulfate and in view of the fixing rate, ammonium thiosulfate is preferred, however, in view of the environmental conservation as a matter of concerns in recent years, sodium thiosulfate may be used. The use amount of these known fixing agent may be appropriately varies and it is generally from about 0.1 to about 2 mol/liter, more preferably from 0.2 to 1.5 mol/liter.

The fixing solution may contain, if desired, a hardening agent (e.g., a water-soluble aluminum compound), a preservative (e.g., sulfite, bisulfite), a pH buffer (e.g., acetic acid), a pH adjustor (e.g., ammonia, sulfuric acid), a chelating agent, a surface active agent, a wetting agent or a fixing accelerator.

Examples of the surface active agent include an anionic surface active agent such as a sulfated product and a sulfonated product, a polyethylene-based surface active agent and an amphoteric surface active agent described in JP-A-57-6740. A known defoaming agent may also be added. Examples of the wetting agent include alkanolamine and alkylene glycol. Examples of the fixing accelerator include thiourea derivatives and alcohols having a triple bond in the molecule described in JP-B-45-35754, JP-B-58-122535 and JP-B-58-122536, thioether compounds described in U.S. Pat. No. 4,126,459 and meso-ionic compounds described in JP-A-4-229860, and the compounds described in JP-A-2-44355 may also be used.

The pH of the fixing solution is preferably from 4.0 to 6.5, more preferably from 4.5 to 6.0.

Also, as the dye elution accelerator, the compounds described in JP-A-64-4739 may be used.

The hardening agent for use in the fixing solution of the present invention includes a water-soluble aluminum salt and a chromium salt, with the water-soluble aluminum salt being preferred. Examples of the water-soluble aluminum salt include aluminum chloride, aluminum sulfate and potassium alum. The addition amount thereof is preferably from 0.01 to 0.2 mol/liter, more preferably from 0.03 to 0.08 mol/liter.

The fixing temperature is from about 20 to about 50° C., preferably from 25 to 45° C. and the fixing time is from 5 seconds to 1 minute, preferably from 7 to 50 seconds.

The replenishing amount of the fixing solution is 600 ml/m$^2$ or less, preferably 300 ml/m$^2$ or less, based on the processing amount of the photographic material.

After the development and the fixing, the photographic material is subjected to water washing or stabilization treatment. The water washing or the stabilization treatment may be carried out at a replenishing amount of 3 l or less per m$^2$ of the silver halide photographic material (including 0, namely standing water washing). In other words, not only a water-saving treatment can be carried out but also the piping for installing an automatic developer can be omitted. When the water washing is carried out using a small amount of water, a purifying tank with a squeeze roller described in JP-A-63-18350 and JP-A-62-287252 is preferably provided. Also, in order to reduce the pollution load causing a problem in the case of water washing with a small amount of water, various oxidizing agents may be added or filtering with a filter may be effected in combination. Further, the overflow from a water washing or stabilization bath, which is generated in replenishing water having an antimold means to the water washing or stabilization bath according to the processing in the method of the present invention, may be partially or wholly used in the processing solution having a fixing ability as the previous processing step thereof as described in JP-A-60-235133. Furthermore, in order to prevent unevenness due to water bubbles prone to be generated at the water washing with a small amount of water and/or to prevent the transfer of a processing agent component attached to a squeeze roller to the processed film, a water-soluble surface active agent or a defoaming agent may also be added. Still further, a dye adsorbent described in JP-A-63-163456 may be provided in the water washing tank so as to prevent stains due to the dye eluted from the photographic material.

The above-described water washing treatment may be followed by stabilization treatment and, for example, a bath containing the compounds described in JP-A-2-201357, JP-A-2-132435, JP-A-1-102553 and JP-A-46-44446 may be used as a final bath for the photographic material. This stabilization bath may also contain, if desired, an ammonium compound, a metal compound such as Bi and Al, a fluorescent brightening agent, various chelating agent, a layer pH buffering agent, a hardening agent, a sterilizer, an antimold, an alkanolamine or a surface active agent and the water used is preferably, in addition to tap water, a deionized water or water sterilized by a halogen, an ultraviolet bactericidal lamp or various oxidizing agents (e.g., ozone, hydrogen peroxide, chlorate).

The processing solution which is preferably used in the present invention is preferably stored in a packaging material having a low oxygen permeability described in JP-A-61-73147.

On the other hand, in the case where the replenishing amount is reduced, the contact area of the processing tank with air is preferably reduced to prevent evaporation or air oxidation of the solution. With respect to a roller transportation-type automatic developing machine, U.S. Pat. Nos. 3,025,779 and 3,545,971 describe thereon and a roller transportation-type developing machine consisting of four steps of development, fixing, water washing and drying can be preferably used.

The above-described processing solution may be used as a solid processing agent.

The solid processing agent which is preferably used in the present invention is in a powder, tablet, granular, massive or paste form, preferably in the form as described in JP-A-61-259921 or a tablet. The tablet can be produced by a common method described, for example, in JP-A-51-61837, JP-A-54-155038, JP-A-52-88025 and British Patent 1,213,808, and the granular processing agent can be produced by a common method described, for example, in JP-A-2-109042, JP-A-2-109043, JP-A-3-39735 and JP-A-3-39739. Further, the powder processing agent can be produced by a common method described, for example, in JP-A-54-133332, British Patents 725,892 and 729,862 and German Patent No. 3,733,861.

The bulk density of the solid processing agent which is preferably used in the present invention is, in view of the solubility and the effect on the object of the present invention, preferably from 0.5 to 6.0 g/m$^3$, more preferably from 1.0 to 5.0 g/cm$^3$.

Various additives for use in the photographic material of the present are not particularly limited and those described, for example, in the following publications at the portion described below can be preferably used.

| Item | Pertinent Portion |
|---|---|
| 1) Spectral Sensitizing Dye | JP-A-2-12236, p. 8, from left lower col., line 13 to right lower col., line 4; JP-A-2-103536, from p. 16, right lower col., line 3 to p. 17, left lower col., line 20; and spectral sensitizing dyes described in JP-A-1-112235, JP-A-2-124560, JP-A-3-7928, JP-A-5-11389 and Japanese Patent Application No. 3-411064 |
| 2) Surface active agent, antistatic agent | JP-A-2-12236, p. 9, from right upper col., line 7 to right lower col., line 7; JP-A-2-18542, from p. 2, left lower col., line 13 to p. 4, right lower col., line 18 |
| 3) Antifoggant, stabilizer | JP-A-2-103536, from p. 17, right lower col., line 19 to p. 18, right upper col., line 4, and right lower col., lines 1 to 5; and thiosulfinic acid compounds described in JP-A-1-237538 |
| 4) Compounds having an acid group | JP-A-2-103536, from p. 8, right lower col., line 5 to p. 19, left upper col., line 1; and JP-A-2-55349, from p. 8, right lower col., line 13 to p. 11, left upper col., line 8 |
| 5) Matting agent, slipping agent | JP-A-2-103536, p. 19, from left upper col., line 15 to right upper col., line 15 |
| 6) Hardening agent | JP-A-2-103536, p. 18, right upper col., lines 5 to 17 |
| 7) Dye | JP-A-2-103536, p. 17, right lower col., lines 1 to 18; JP-A-2-39042, from p. 4, right upper col., line 1 to p. 6, right upper col., line 5; dyes |

-continued

| Item | Pertinent Portion |
|---|---|
| | described in JP-A-2-294638 and JP-A-63-296039; and solid disperse dyes described in WO88/04794, European Patent 456,148 and JP-A-5-11382 |
| 8) Binder | JP-A-2-18542, p. 3, right lower col., lines 1–20 |
| 9) Black spot inhibitor | compounds described in U.S. patent 4,956,257 and JP-A-1-118832 |
| 10) Redox compound | JP-A-2-301743, compounds represented by formula (I) (in particular, compounds 1 to 50); JP-A-3-174143, pp. 3–20, compounds represented by formula (R-1), (R-2) and (R-3) (compounds 1 to 75); and compounds described in JP-A-5-257239 and JP-A-4-278939 |
| 11) Monomethine compound | JP-A-2-287532, compounds represented by formula (II) (in particular, compounds II-1 to II-26) |
| 12) Dihydroxybenzenes | compounds described in JP-A-3-39948, from p. 11, left upper col., to p. 12, left lower col. and European Patent 452,772A |
| 13) Polymer latex | JP-A-2-103536, p. 18, left lower col., lines 12 to 20; and polymer latexes having an active methylene group described in JP-B-46-22507, JP-A-50-73625, U.S. patents 3,488,708, 3,939,130 and 3,929,482 |
| 14) Organic desensitizer | compounds described in JP-B-3-76450 and JP-A-63-64039 |
| 15) Compounds having an amino group, an ammonium group or a nitrogen-containing heterocyclic ring | JP-A-63-133145, from p. 8, line 5 to p. 40, line 5 |

The present invention will be described below in greater detail with reference to the examples, however, the present invention should not be construed as being limited thereto.

EXAMPLE 1

Preparation of Emulsion

Emulsion 1A

To a 1.5% aqueous gelatin solution containing sodium chloride and $3\times10^{-5}$ mol/mol-Ag of Compound (1–16) of the present invention kept at 40° C. and having a pH of 2.0, an aqueous silver nitrate solution and an aqueous sodium chloride solution containing $3.5\times10^{-5}$ mol/mol-Ag of $(NH_4)_2Rh(H_2O)Cl_5$ were simultaneously added by a double jet method at an electric potential of 95 mV over 3 minutes and 30 seconds to give a half of silver amount in the final grain and thereby a core grain having a size of 0.12 μm was prepared. Thereafter, an aqueous silver nitrate solution and an aqueous sodium chloride solution containing $10.5\times10^{-5}$ mol/mol-Ag of $(NH_4)_2Rh(H_2O)Cl_5$ were added in the same manner as above over 7 minutes to provide a silver chloride cubic grain having an average grain size of 0.15 μm (coefficient of variation: 12%).

Then, 4-hydroxy.-6-methyl-1,3,3a,7-tetrazaindene was added thereto in an amount of $1.5\times10^{-3}$ mol/mol-Ag.

Thereafter, the resulting emulsion was washed with water by a flocculation method well known in the art to remove a soluble salt, gelatin was added thereto and, without carrying out chemical ripening, 50 mg/mol-Ag of Compound-A and 50 mg/mol-Ag of p-henoxyethanol as antiseptics and $3\times10^{-3}$ mol/mol-Ag of 4-hydroxy-6-methyl-1,3,3a,7-tetrazaindene as a stabilizer were added (the final grain having a pH of 5.7, a pAg of 7.5 and an Rh content of $7\times10^{-5}$ mol/mol-Ag).

Emulsion 1B

The grain formation, the water washing and the addition of gelatin were carried out in the same manner as in Emulsion 1A and then, the pH and the pAg were adjusted to 5.7 and 7.5, respectively. Further, $2\times10^{-5}$ mol/mol-Ag of sodium thiosulfate and $4\times10^{-5}$ mol/mol-Ag of chloroauric acid were added thereto, the emulsion was heated at 60° C. for 60 minutes and subjected to chemical sensitization, and then, a stabilizer and antiseptics were added as in Emulsion 1A.

Emulsion 1C

Emulsion 1C was prepared thoroughly in the same manner as Emulsion 1B except for changing the amount of $(NH_4)_2Rh(H_2O)Cl_5$ doped at the grain formation to $1\times10^{-6}$ mol/mol-Ag.

Emulsion 1D

Emulsion 1D was prepared thoroughly in the same manner as Emulsion 1B except for changing the amount of $(NH_4)_2Rh(H_2O)Cl_5$ doped at the grain formation to $5\times10^{-6}$ mol/mol-Ag.

Emulsion 1E

Emulsion 1E was prepared thoroughly in the same manner as Emulsion 1B except for changing the amount of $(NH_4)_2Rh(H_2O)Cl_5$ doped at the grain formation to $6\times10^{-5}$ mol/mol-Ag.

Emulsion 1F

The grain formation, the water washing and the addition of gelatin were carried out in the same manner as in Emulsion 1A and then, the pH and the pAg were adjusted to 5.7 and 7.5, respectively. Further, $2\times10^{-5}$ mol/mol-Ag of Sulfur Compound S and $4\times10^{-5}$ mol/mol-Ag of chloroauric acid were added thereto, the emulsion was heated at 60° C. for 60 minutes and subjected to chemical sensitization, and then, a stabilizer and antiseptics were added as in Emulsion 1A.

Emulsion 1G

Emulsion 1G was prepared thoroughly in the same manner as Emulsion 1A except that the kind of a metal doped at the grain formation was $K_2Ru(NO)Cl_5$ and the doped amount was $6\times10^{-5}$ mol/mol-Ag.

Emulsion 1H

Emulsion 1H was prepared thoroughly in the same manner as Emulsion 1B except that the kind of a metal doped at the grain formation was $K_2Ru(NO)Cl_5$, the doped amount was $6\times10^{-5}$ mol/mol-Ag and the amount of sodium thiosulfate was $6\times10^{-5}$ mol.

Emulsion 1I

Emulsion 1I was prepared thoroughly in the same manner as Emulsion 1H except that the amount of $K_2Ru(NO)Cl_5$ doped at the grain formation was $5\times10^{-6}$ mol/mol-Ag.

Emulsion 1J

Emulsion 1J was prepared thoroughly in the same manner as Emulsion 1H except for excluding the chloroauric acid from Emulsion 1H.

Preparation of Coating Solution for Emulsion Layer and Coating Thereof

The following compounds were added to each of emulsions shown in Table 1 and a silver halide emulsion layer was coated on a support described below having an undercoat layer to give a gelatin coated amount of 1.1 g/m$^2$ and a silver coated amount of 2.5 g/m$^2$.

| | |
|---|---|
| 4-Hydroxy-6-methyl-1,3,3a,7-tetrazaindene | 10 mg/m$^2$ |
| N-Oleyl-N-methyltaurine sodium salt | 35 mg/m$^2$ |
| Compound-B | 10 mg/m$^2$ |
| Compound-C | 20 mg/m$^2$ |
| n-Butylacrylate/2-acetoacetoxyethyl methacrylate/acrylic acid copolymer (89/8/3) | 900 mg/m$^2$ |
| compound-D (hardening agent) | 150 mg/m$^2$ |

Further, the nucleation accelerator and the hydrazine derivative of the present invention were added each in an amount as shown in Table 1.

On the upper layer of the above-described emulsion layer, emulsion protective lower and upper layers were coated.

Preparation of Coating Solution for Emulsion Protective Lower Layer and Coating Thereof The following compounds were added to an aqueous gelatin solution and coated to give a gelatin coated amount of 0.7 g/m$^2$.

| | |
|---|---|
| Gelatin ($Ca^{++}$ content: 2,700 ppm) | 0.7 g/m$^2$ |
| Sodium p-dodecylbenzenesulfonate | 15 mg/m$^2$ |
| Compound-A | 5 mg/m$^2$ |
| Compound-E | 10 mg/m$^2$ |
| Compound-F | 20 mg/m$^2$ |

Preparation of Emulsion Protective Upper Layer and Coating Thereof

The following compounds were added to an aqueous gelatin solution and coated to give a gelatin coated amount of 0.8 g/m$^2$.

| | |
|---|---|
| Gelatin ($Ca^{++}$ content: 2,700 ppm) | 0.8 g/m$^2$ |
| Amorphous silica matting agent (average particle size: 3.5 μm, pore diameter: 25 Å, surface area: 700 m$^2$/g) | 40 mg/m$^2$ |
| Amorphous silica matting agent (average particle size: 2.5 μm, pore diameter: 170 Å, surface area: 300 m$^2$/g) | 10 mg/m$^2$ |
| N-Perfluorooctanesulfonyl-N-propylglycine potassium | 5 mg/m$^2$ |
| Sodium dodecylbenzenesulfonate | 30 mg/m$^2$ |
| Compound-A | 5 mg/m$^2$ |
| Solid Disperse Dye-$G_1$ | 100 mg/m$^2$ |
| Solid Disperse Dye-$G_2$ | 50 mg/m$^2$ |

Then, on the opposite side of the support, the following electroconductive layer and backing layer were simultaneously coated.

Preparation of Coating Solution for Electroconductive Layer and Coating Thereof

The following compounds were added to an aqueous gelatin solution and coated to give a gelatin coated amount of 77 mg/m$^2$.

| | |
|---|---|
| $SnO_2$/Sb (9/1 by weight, average particle size: 0.25 μm) | 200 mg/m$^2$ |
| Gelatin ($Ca^{++}$ content: 3,000 ppm) | 77 mg/m$^2$ |
| Sodium dodecylbenzenesulfonate | 10 mg/mg$^2$ |
| Sodium dihexyl-α-sulfosuccinate | 40 mg/m$^2$ |
| Sodium polystyrenesulfonate | 9 mg/m$^2$ |
| Compound-A | 7 mg/m$^2$ |

Preparation of Coating Solution for Backing Layer and Coating Thereof

The following compounds were added to an aqueous gelatin solution and coated to give a gelatin coated amount of 2.92 g/m$^2$.

| | |
|---|---|
| Gelatin ($Ca^{++}$ content: 30 ppm) | 2.92 g/m$^2$ |
| Polymethyl methacrylate fine particle (average particle size: 3.4 μm) | 54 mg/m$^2$ |
| Compound-H | 140 mg/m$^2$ |
| Compound-I | 140 mg/m$^2$ |
| Compound-J | 40 mg/m$^2$ |
| Sodium dodecylbenzenesulfonate | 75 mg/m$^2$ |
| Sodium dihexyl-α-sulfosuccinate | 20 mg/m$^2$ |
| Compound-K | 5 mg/m$^2$ |
| N-Perfluorooctanesulfonyl-N-propylglycine potassium | 5 mg/m$^2$ |
| Sodium sulfate | 50 mg/m$^2$ |
| Sodium acetate | 85 mg/m$^2$ |

Support and Undercoat Layer

A first undercoat layer and a second undercoat layer each having the following composition were coated on both surfaces of a biaxially stretched polyethylene terephthalate support (thickness: 100 μm).

Undercoat First Layer

| | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound-L | 0.20 g |
| Colloidal silica (Snowtex ZL, produced by Nissan Kagaku KK, particle size: 70-100 μm) | 0.12 g |
| Water to make | 100 g |

Further, 10 wt % of KOH was added thereto and the resulting coating solution adjusted to have a pH of 6 was coated at a drying temperature of 180° C. for 2 minutes to give a dry thickness of 0.9 μm.

Undercoat Second Layer

| | |
|---|---|
| Gelatin | 1 g |
| Methyl cellulose | 0.05 g |
| Compound-M | 0.02 g |
| $C_{12}H_{25}O(CH_2CH_2O)_{10}H$ | 0.03 g |
| Compound-A | $3.5 \times 10^{-3}$ g |
| Acetic acid | 0.2 g |
| Water to make | 100 g |

The resulting coating solution was coated at a drying temperature of 170° C. for 2 minutes to give a dry thickness of 0.1 μm. Samples 1 to 19 were thus prepared.

Compound-A

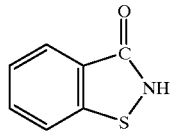

Sulfur Compound S

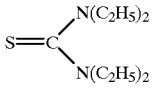

Compound-B

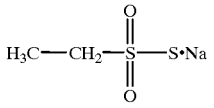

-continued

Compound-C

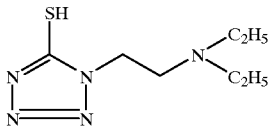

Compound-D

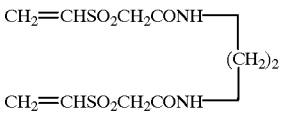

Compound-E

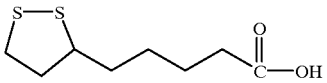

Compound-F

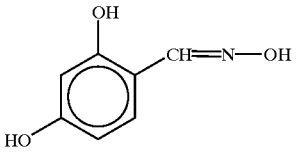

Solid Disperse Dye-$G_1$

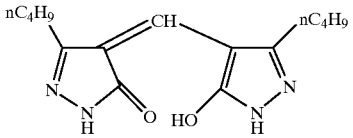

Solid Disperse Dye-$G_2$

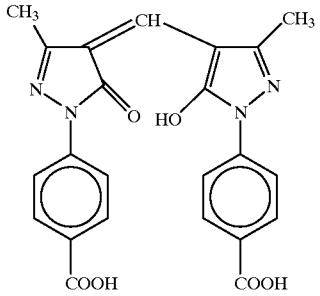

Compound-H

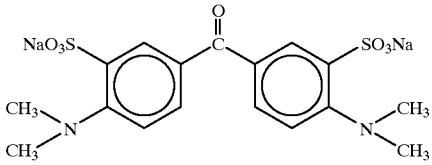

Compound-I

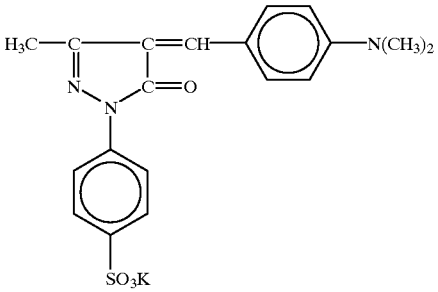

-continued

Compound-J

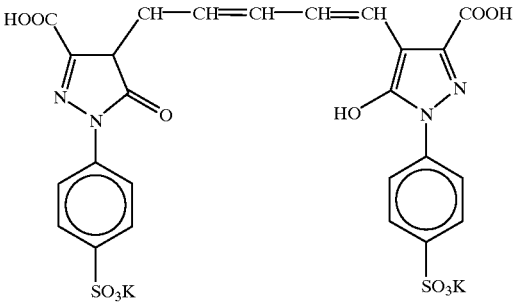

Compound-K $C_8F_{17}SO_3Li$

Core-shell Type Vinylidene Chloride Copolymer (1)

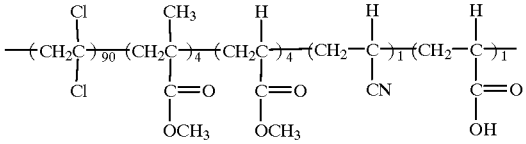

VDC MMA MA AN AA

Core: VDC/MMA/MA (80 wt. %)
Shell: VDC/AN/AA (20 wt. %)
Average particle size: 70 nm Compound-L

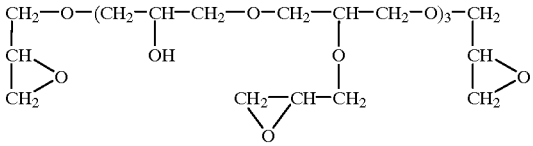

Compound-M

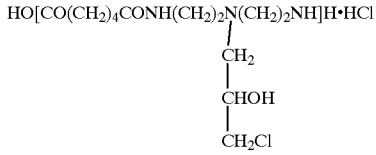

Evaluation Method

Photographic Properties

Each of the thus-obtained samples was exposed through an optical wedge in a printer, P-627FM, manufactured by nippon & Screen Mfg., Co., Ltd., processed with Developer 1 at 38° C. for 20 seconds in an automatic developing machine, FG-680AG, manufactured by Fuji Photo Film Co., Ltd., and then fixed, water washed and dried. The fixing solution used was Fixing Solution 1. The resulting samples were evaluated on the following items:

1) Sensitivity ($S_{1.5}$): A logarithmic value of the exposure amount giving density of 1.5 (the smaller the value, the higher the sensitivity)

2) $\gamma$:(1.5−0.1)/{log(exposure amount giving density of 1.5)−log(exposure amount giving density of 0.1)}

Quality of Superimposed Letter Image

For the evaluation on the quality of superimposed letter image, an original shown in FIG. 1 of JP-B-2-28856 comprising "transparent paste-in base/film having formed thereon a line work positive image (line original)/transparent- paste-in base/film having formed thereon a halftone image (halftone original)" superposed in this order, was prepared and this original was put into close contact with the emulsion surface of each sample. The laminate was imagewise exposed in a printer, P-627FM and developed (in the same manner as described above).

The exposure time for each sample was determined so that a halftone image at a dot percent of 50% could be formed on each sample from the halftone original having a dot percent of 50%.

In the evaluation, the superimposed letter image quality of 5 means a very good superimposed letter image quality where when an optimum exposure is effected using an original shown in FIG. 1 of JP-B-2-28856 so that the 50% dot area could be reflected by 50% dot area on the photographic material for dot-to-dot working, a letter in a width of 30 $\mu$m is reproduced. On the other hand, the superimposed letter image quality of 1 means a poor image quality where on an optimum exposure as described above, a letter in a width of 150 $\mu$m or more only can be reproduced. Between rank 1 and rank 5, ranks 2 to 4 were provided according to sensory evaluation. Samples in rank 3 or higher lie on a level capable of practical use.

Dmax in Practical Use

This is the maximum blacking density obtained when an exposure was given so that 50% of a halftone original as described in the evaluation on the superimposed letter image quality could be reflected on the film sample by 50% of a dot area.

Storage Stability $\Delta S_{1.5}$

After leaving under the conditions of 50° C. and 70% RH for three days, each sample was processed in the same manner as described in the evaluation on the photographic properties and the change in sensitivity from that immediately after coating was determined (S1.5 immediately after coating—$S_{1.5}$ after leaving at 50°C. and 70% RH for three days; the larger the value, the greater the increase in sensitivity).

Developer 1

| | |
|---|---|
| Sodium hydroxide | 35.0 g |
| Diethylenetriaminepentaacetic acid | 2.0 g |
| Potassium carbonate | 12.0 g |
| Sodium metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-pheny1-3-pyrazolidone | 0.45 g |
| 2,3,5,6,7,8-Hexahydro-2-thioxo-4-(1H)-quinazoline | 0.04 g |
| Sodium 2-mercaptobenzimidazole-5-sulfonate | 0.15 g |
| Sodium erysorbate | 3.0 g |
| Potassium hydroxide and water were added to make 1 l and the pH was adjusted to 10.5. | |

Fixing Solution

| | |
|---|---|
| Ammonium thiosulfate | 359.1 g |
| Disodium ethyleneaminetetraacetate dihydrate | 2.26 g |
| Sodium thiosulfate pentahydrate | 32.8 g |
| Sodium sulfite | 64.0 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted by sulfuric acid or sodium hydroxide) | 4.85 |
| Water to make | 1 l |

TABLE 1

| Sample | Emulsion | | | Hydrazine Derivative | | Nucleation Accelerator | | Photographic Properties | | Superimposed Letter Image | Dmax in Practical | Storage Stability |
|---|---|---|---|---|---|---|---|---|---|---|---|---|
| No. | No. | Heavy Metal* (Addition Amount) | Chemical Sensitization | Kind | Addition Amount (mol/mol-Ag) | Kind | Addition Amount (mol/mol-Ag) | Sensitivity | γ | Quality | Use | $\Delta S_{1.5}$ |
| 1 | 1A | Rh ($7 \times 10^{-5}$) | none | I-11 | $1.9 \times 10^{-3}$ | A-214 | $1.7 \times 10^{-3}$ | 3.50 | 8 | 2 | 2.5 | 0.02 |
| 2 | 1C | Rh ($1 \times 10^{-6}$) | Au/S | " | " | " | " | 1.10 | 24 | 5 | 5.2 | 0.39 |
| 3 | 1D | Rh ($5 \times 10^{-6}$) | Au/S | " | " | " | " | 1.80 | 21 | 5 | 5.2 | 0.31 |
| 4 | 1B | Rh ($7 \times 10^{-5}$) | Au/S | — | — | — | — | 3.65 | 3 | 2 | 2.4 | 0.02 |
| 5 | " | " | " | — | — | A-214 | $1.7 \times 10^{-3}$ | 3.64 | 3 | 2 | 2.4 | 0.02 |
| 6 | " | " | " | I-11 | $1.9 \times 10^{-3}$ | — | — | 3.61 | 5 | 2 | 2.6 | 0.02 |
| 7 | " | " | " | " | " | A-214 | $1.7 \times 10^{-3}$ | 3.20 | 15 | 4 | 5.1 | 0.02 |
| 8 | " | " | " | I-16 | $2.0 \times 10^{-3}$ | " | " | 3.30 | 11 | 3 | 5.0 | 0.03 |
| 9 | " | " | " | I-11 | $1.9 \times 10^{-3}$ | A-112 | $2.0 \times 10^{-3}$ | 3.31 | 10 | 3 | 5.0 | 0.03 |
| 10 | " | " | " | " | " | A-213 | $1.7 \times 10^{-3}$ | 3.22 | 13 | 4 | 5.1 | 0.02 |
| 11 | " | " | " | I-32 | " | A-214 | " | 3.19 | 14 | 4 | 5.1 | 0.02 |
| 12 | 1E | Rh ($6 \times 10^{-5}$) | Au/S | I-11 | " | " | " | 3.11 | 16 | 4 | 5.1 | 0.03 |
| 13 | 1F | Rh ($7 \times 10^{-5}$) | Au/S | " | " | " | " | 3.21 | 15 | 4 | 5.0 | 0.02 |
| 14 | 1G | Ru ($6 \times 10^{-5}$) | none | " | " | " | " | 3.50 | 9 | 2 | 2.2 | 0.02 |
| 15 | 1H | Ru ($6 \times 10^{-5}$) | Au/S | " | " | — | — | 3.52 | 7 | 2 | 2.3 | 0.02 |
| 16 | " | " | " | — | — | A-214 | $1.7 \times 10^{-3}$ | 3.54 | 6 | 2 | 2.2 | 0.02 |
| 17 | " | " | " | I-11 | $1.9 \times 10^{-3}$ | " | " | 3.08 | 18 | 4 | 5.1 | 0.03 |
| 18 | 1I | Ru ($5 \times 10^{-6}$) | Au/S | " | " | " | " | 1.72 | 22 | 5 | 5.1 | 0.36 |
| 19 | 1J | Ru ($6 \times 10^{-5}$) | S | " | " | " | " | 3.45 | 10 | 2 | 2.5 | 0.02 |

*Unit: mol/mol-Ag, Au: gold sensitization, S: sulfur sensitization
Sample Nos. 7 to 13 and 17 are according to the present invention.

As is clearly seen from Table 1, Sample Nos. 7 to 13 and 17 of the present invention exhibited high contrast photographic properties having a γ value of 10 or more, excellent superimposed letter image quality and high Dmax in practical use of 5.0 or more. Further, the storage stability was also good and therefore, the above-described superior quality can be maintained for a long period of time.

Three kinds of emulsions were prepared by changing the heavy metal of Emulsion 1B to $K_3CrCN_6$, $K_3ReCl_6$ or $K_2Ir(NO)Cl_5$ and evaluated in the same manner as Emulsion 1B in Table 1 and as a result, it was confirmed that high contrast, high Dmax, high image quality and good storage stability were provided.

EXAMPLE 2

Sample Nos. 1 and 4 to 8 in Example 1 each was evaluated in the same manner as in Example 1 except for the processing (in FG-680AG) was carried out using Developer 2 at 38° C. for 20 seconds.

Developer 2

| | |
|---|---|
| Metol | 7.5 g |
| Sodium ascorbate | 30.0 g |
| Sodium metaborate | 70.0 g |
| Potassium bromide | 1.0 g |
| 5-Methylbenzotriazole | 10.0 mg |
| Sodium hydrogensulfite | 22.0 g |
| Water to make | 1 l |
| pH | 9.8 |

The results of evaluation were such that the contrast was higher than that in Example 1 and Sample Nos. 7 and 8 according to the present invention exhibited excellent quality of a superimposed letter image even at a pH of 9.8 and high Dmax in practical use of 5.0 or more.

EXAMPLE 3

Emulsions K to O were prepared by changing the pH and the amount of Compound (1–16) at the grain formation of Emulsion 1B in Example 1 as shown in Table 2 and Samples 20 to 24 were prepared using Emulsions K to O thoroughly in the same manner as Sample 7 in Example 1.

The thus-obtained samples each was processed in the same manner as in the examination of photographic properties in Example 1 and evaluated from the value obtained by subtracting the base density from the density (fog value) on the unexposed area.

Also, after leaving each sample under the conditions of 60° C. and 30% RH for three days, evaluation on the fog value was carried out in the same manner. Samples 1 and 7 of Example 1 were also subjected to the same evaluation.

The results obtained are shown in Table 2.

TABLE 2

| Sample No. | Emulsion | pH at Grain Formation | Amount of Compound (1-16) (mol/mol-Ag) | Fog Value | Fog Value after Leaving at 60° C. and 30% for Three Days |
|---|---|---|---|---|---|
| 1 | A | 2.0 | $3 \times 10^{-5}$ | 0.002 | 0.002 |
| 7 | B | " | " | 0.002 | 0.003 |
| 20 | K | " | 0 | 0.004 | 0.007 |
| 21 | L | 3.5 | 0 | 0.006 | 0.009 |
| 22 | M | 4.5 | 0 | 0.021 | 0.037 |
| 23 | N | 6.0 | 0 | 3.02 | 4.05 |
| 24 | O | " | $3 \times 10^{-5}$ | 0.089 | 0.102 |

Sample Nos. 7 and 20 to 21 are according to the present invention.

As is clearly seen from Table 2, Sample Nos. 7, 20 and 21 of the present invention exhibited excellent results with respect to the fog value. In other words, it is seen that the grain formation under an acidic condition (at a pH of 4 or less) and/or a thiosulfonic acid compound are needed.

Similarly, it is seen that the same results could be obtained even when Compound (1–16) was replaced by Compound (1–2) or when Compound (1–16) was added not at the grain formation but at the gold-sulfur sensitization.

EXAMPLE 4

Sample Nos. 1 and 4 to 8 of Example 1 was evaluated in the same manner as in Example 1 except for carrying out the processing (in FG-680AG) using Developer 3 which was stored in the following state as a solid processing agent so as to further improve the stability during storage of the developer, at 38° C. for 20 seconds.

Developer 3

The liquid components used and the composition of Developer 3 are shown in Table 3.

This developer as a solid processing agent was produced by laminating the components of the developer each as a solid and packaging the laminate in a bag made of an aluminum foil coated on a plastic substance. The order of the laminated layers was such that, from the upper side,

| | |
|---|---|
| First Layer | hydroquinone |
| Second Layer | other components |
| Third Layer | sodium bisulfite |
| Fourth layer | potassium carbonate |
| Fifth Layer | potassium hydroxide pellets |

The bag was evacuated by a common method and sealed while laying the system in a vacuum state.

TABLE 3

| Developer Component | Developer Composition (g) |
|---|---|
| Sodium hydroxide | 35 |
| Diethylenetriaminepentaacetic acid | 2.0 |
| Potassium carbonate | 100 |
| Potassium bromide | 3 |
| 5-Methylbenzotriazole | 0.08 |
| Sodium 2-mercaptobenzimidazole-5-sulfonate | 0.15 |
| 2,3,5,6,7,8-Hexahydro-2-thioxo-4-(1H)-quinazoline | 0.03 |
| Sodium metabisulfite | 54 |
| 4-Hydroxymethyl-4-methyl-1-phenyl-3-pyrazolidone | 0.45 |

TABLE 3-continued

| Developer Component | Developer Composition (g) |
|---|---|
| Hydroquinone | 30.0 |
| Sodium erysorbate | 3.0 |
| Water to make | 1 l |
| pH adjusted to | 10.5 |

The results obtained were thoroughly the same as those in Example 1 and revealed that the present invention is effective.

EXAMPLE 5

Preparation of Emulsion

Emulsion 5A

To a 1.5% aqueous gelatin solution containing sodium chloride and $3\times10^{-5}$ mol/mol-Ag of sodium benzenethiosulfonate kept at 40° C. and having a pH of 2.0, an aqueous silver nitrate solution and an aqueous sodium chloride solution containing $3.5\times10^{-5}$ mol/mol-Ag of $(NH_4)_2Rh(H_2O)Cl_5$ were simultaneously added by a double jet method at an electric potential of 95 mV over 3 minutes and 30 seconds to give a half of silver amount in the final grain and thereby a core grain having a size of 0.12 μm was prepared. Thereafter, an aqueous silver nitrate solution and an aqueous sodium chloride solution containing $10.5\times10^{-5}$ mol/mol-Ag of $(NH_4)_2Rh(H_2O)Cl_5$ were added in the same manner as above over 7 minutes to provide a silver chloride cubic grain having an average grain size of 0.15 ;μm (coefficient of variation: 12%).

Thereafter, the resulting emulsion was washed with water by a flocculation method well known in the art to remove a soluble salt, gelatin was added thereto and, without carrying out chemical ripening, 50 mg/mol-Ag of Compound-A and 50 mg/mol-Ag of phenoxyethanol as antiseptics and $1\times10^{-3}$ mol/mol-Ag of 4-hydroxy-6-methyl-1,3,3a,7-tetrazaindene as a stabilizer were added (the final grain having a pH of 5.7, a pAg of 7.5 and an Rh content of $7\times10^{-5}$ mol/mol-Ag).

Emulsion 5B

The grain formation, the water washing and the addition of gelatin were carried out in the same manner as in Emulsion 5A and then, the pH and the pAg were adjusted to 5.7 and 7.5, respectively. Further, $1.6\times10^{-5}$ mol/mol-Ag of sodium thiosulfate, $0.4\times10^{-5}$ mol/mol-Ag of Selenium Sensitizer (II-41) of the present invention and $4\times10^{-5}$ mol/mol-Ag of chloroauric acid were added thereto, the emulsion was heated at 60° C. for 60 minutes and subjected to chemical sensitization, and then, a stabilizer and antiseptics were added as in Emulsion 5A.

Emulsion 5C

Emulsion 5C was prepared thoroughly in the same manner as Emulsion 5B except for changing the amount of $(NH_4)_2Rh(H_2O)Cl_5$ doped at the grain formation to $1\times10^{-6}$ mol/mol-Ag.

Emulsion 5D

Emulsion 5D was prepared thoroughly in the same manner as Emulsion 5B except for changing the amount of $(NH_4)_2Rh(H_2O)Cl_5$ doped at the grain formation to $5\times10^{-6}$ mol/mol-Ag.

Emulsion 5E

Emulsion 5E was prepared thoroughly in the same manner as Emulsion 5B except for changing the amount of $(NH_4)_2Rh(H_2O)Cl_5$ doped at the grain formation to $6\times10^{-5}$ mol/mol-Ag.

Emulsion 5F

The grain formation, the water washing and the addition of gelatin were carried out in the same manner as in Emulsion 5A and then, the pH and the pAg were adjusted to 5.7 and 7.5, respectively. Further, $2\times10^{-5}$ mol/mol-Ag of Tellurium Sensitizer (V-70) of the present invention and $4\times10^{-5}$ mol/mol-Ag of chloroauric acid were added thereto, the emulsion was heated at 60° C. for 60 minutes and subjected to chemical sensitization, and then, a stabilizer and antiseptics were added as in Emulsion 5A.

Emulsion 5G

Emulsion 5G was prepared thoroughly in the same manner as Emulsion 5A except that the kind of a metal doped at the grain formation was $K_2Ru(NO)Cl_5$ and the doped amount was $6\times10^{-5}$ mol/mol-Ag.

Emulsion 5H

Emulsion 5H was prepared thoroughly in the same manner as Emulsion 5B except that the kind of a metal doped at the grain formation was $K_2Ru(NO)Cl_5$ and the doped amount was $6\times10^{-5}$ mol/mol-Ag.

Emulsion 5I

Emulsion 5I was prepared thoroughly in the same manner as Emulsion 5H except that the amount of $K_2Ru(NO)Cl_5$ doped at the grain formation was $5\times10^{-6}$ mol/mol-Ag.

Preparation of Coating Solution for Emulsion Layer and Coating Thereof

The following compounds were added to each of emulsions shown in Table 4 and one or two silver halide emulsion layer was coated on a support described below having an undercoat layer to give a gelatin coated amount of 1.1 g/m$^2$ and a silver coated amount of 2.5 g/m$^2$ (the coated amount of each compound is the total coated amount of the emulsion layers).

| | |
|---|---|
| 4-Hydroxy-6-methyl-1,3,3a,7-tetrazaindene | 10 mg/m$^2$ |
| N-Oleyl-N-methyltaurine sodium salt | 35 mg/m$^2$ |
| Compound-B | 10 mg/m$^2$ |
| Compound-C | 20 mg/m$^2$ |
| n-Butylacrylate/2-acetoacetoxyethyl methacrylate/acrylic acid copolymer (89/8/3) | 900 mg/m$^2$ |
| Compound-D (hardening agent) | 150 mg/m$^2$ |

Further, the nucleation accelerator and the hydrazine derivative of the present invention were added each in an amount as shown in Table 4.

On the upper layer of the above-described emulsion layer, emulsion protective lower and upper layers were coated.

Preparation of Coating Solution for Emulsion Protective Lower Layer and Coating Thereof The following compounds were added to an aqueous gelatin solution and coated to give a gelatin coated amount of 0.7 g/m$^2$.

| | |
|---|---|
| Gelatin ($Ca^{++}$ content: 2,700 ppm) | 0.7 g/m$^2$ |
| Sodium p-dodecylbenzenesulfonate | 15 mg/m$^2$ |
| Compound-A | 5 mg/m$^2$ |
| Compound-E | 10 mg/m$^2$ |
| Compound-F | 20 mg/m$^2$ |

Preparation of Emulsion Protective Upper Layer and Coating Thereof

The following compounds were added to an aqueous gelatin solution and coated to give a gelatin coated amount of 0.8 g/m$^2$.

| | |
|---|---|
| Gelatin ($Ca^{++}$ content: 2,700 ppm) | 0.8 g/m$^2$ |
| Amorphous silica matting agent (average particle size: 3.5 μm, pore diameter: 25 Å, surface area: 700 m$^2$/g) | 40 mg/m$^2$ |
| Amorphous silica matting agent (average particle size: 2.5 μm, pore diameter: 170 Å, surface area: 300 m$^2$/g) | 10 mg/m$^2$ |
| N-Perfluorooctanesulfonyl-N-propylglycine potassium | 5 mg/m$^2$ |
| Sodium dodecylbenzenesulfonate | 30 mg/m$^2$ |
| Compound-A | 5 mg/m2 |
| Solid Disperse Dye-$G_1$ | 100 mg/m$^2$ |
| Solid Disperse Dye-$G_2$ | 50 mg/m$^2$ |

Then, on the opposite side of the support, the following electroconductive layer and backing layer were simultaneously coated.

Preparation of Coating Solution for Electroconductive Layer and Coating Thereof

The following compounds were added to an aqueous gelatin solution and coated to give a gelatin coated amount of 77 mg/m$^2$.

| | |
|---|---|
| $SnO_2$/Sb (9/1 by weight, average particle size: 0.25 μm) | 200 mg/m$^2$ |
| Gelatin ($Ca^{++}$ content: 3,000 ppm) | 77 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |
| Compound-A | 7 mg/m$^2$ |

Preparation of Coating Solution for Backing Layer and Coating Thereof

The following compounds were added to an aqueous gelatin solution and coated to give a gelatin coated amount of 2.92 g/m$^2$.

| | |
|---|---|
| Gelatin ($Ca^{++}$ content: 30 ppm) | 2.92 g/m$^2$ |
| Polymethyl methacrylate fine particle (average particle size: 3.4 μm) | 54 mg/m$^2$ |
| Compound-H | 140 mg/m$^2$ |
| Compound-I | 140 mg/m$^2$ |
| Compound-J | 40 mg/m$^2$ |
| Sodium dodecylbenzenesulfonate | 75 mg/m$^2$ |
| Sodium dihexyl-α-sulfosuccinate | 20 mg/m$^2$ |
| Compound-K | 5 mg/m$^2$ |
| N-Perfluorooctanesulfonyl-N-propylglycine potassium | 5 mg/m$^2$ |
| Sodium sulfate | 50 mg/m$^2$ |
| Sodium acetate | 85 mg/m$^2$ |

Support and Undercoat Layer

A first undercoat layer and a second undercoat layer each having the following composition were coated on both surfaces of a biaxially stretched polyethylene terephthalate support (thickness: 1.00 μm).

Undercoat First Layer

| | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound-L | 0.20 g |
| Colloidal silica (Snowtex ZL, produced by Nissan Kagaku KK, particle size: 70–100 μm) | 0.12 g |
| Water to make | 100 g |

Further, 10 wt % of KOH was added thereto and the resulting coating solution adjusted to have a pH of 6 was coated at a drying temperature of 180° C. for 2 minutes to give a dry thickness of 0.9 μm.

Undercoat Second Layer

| | |
|---|---|
| Gelatin | 1 g |
| Methyl cellulose | 0.05 g |
| Compound-M | 0.02 g |
| $C_{12}H_{25}O(CH_2CH_2O)_{10}H$ | 0.03 g |
| Compound-A | 3.5 × $10^{-3}$ g |
| Acetic acid | 0.2 g |
| Water to make | 100 g |

The resulting coating solution was coated at a drying temperature of 170° C. for 2 minutes to give a dry thickness of 0.1 μm.

Compound-A

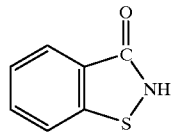

Compound-B

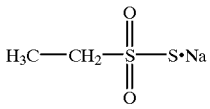

Compound-C

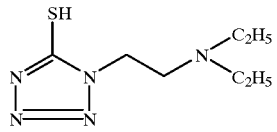

Compound-D

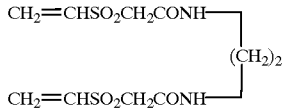

Compound-E

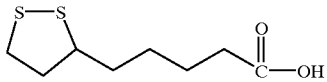

Compound-F

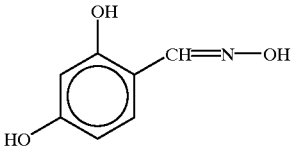

Solid Disperse Dye-$G_1$

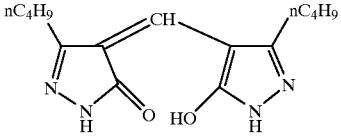

-continued

Solid Disperse Dye-$G_2$

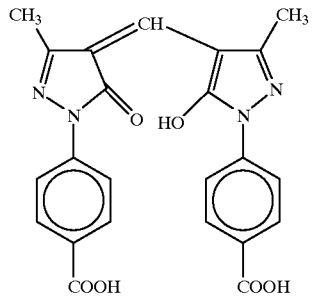

Compound-H

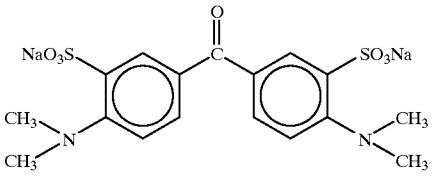

Compound-I

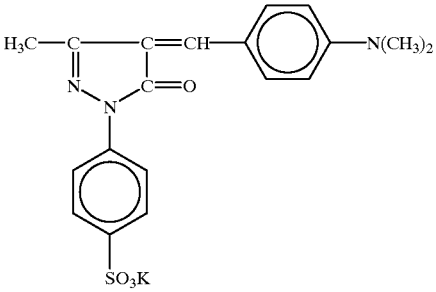

Compound-J

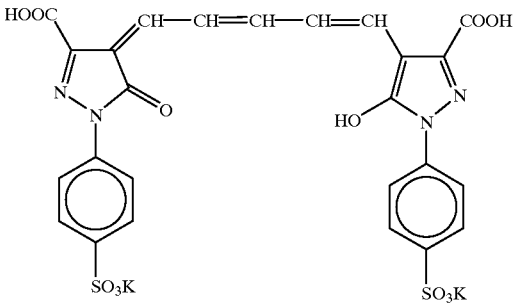

-continued

Compound-K $C_8F_{17}SO_3Li$

Core-shell Type Vinylidene Chloride Copolymer (1)

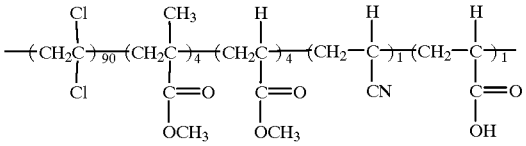

VDC MMA MA AN AA

Core: VDC/MMA/MA (80 wt. %)
Shell: VDC/AN/AA (20 wt. %)
Average particle size: 70 nm Compound-L

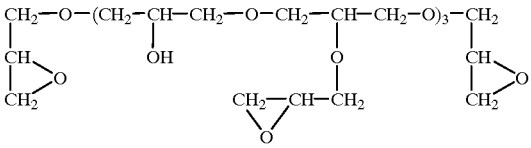

Compound-M

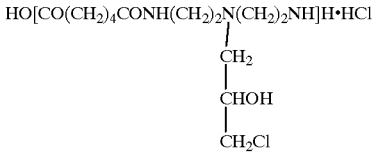

Each of the thus-obtained samples was exposed through an optical wedge in a printer, P-627FM, manufactured by Dainippon & Screen Mfg., Co., Ltd., processed with Developer 1 of Example 1 at 38° C. for 20 seconds in an automatic developing machine, FG-680AG, manufactured by Fuji Photo Film Co., Ltd., and then fixed, water washed and dried. The fixing solution used was Fixing Solution 1 of Example 1. These samples were evaluated on the sensitivity, the γ, the superimposed letter image quality, the Dmax in practical use and the storage stability $\Delta S_{1.5}$ in the same manner as in Example 1 and the results obtained are shown in Table 4.

TABLE 4

| Sample | | Emulsion Layer | Silver Amount | Hydrazine Derivative | | Nucleation Accelerator | | Photographic Properties | | Superimposed Letter Image | Dmax in Practical | Storage Stability |
|---|---|---|---|---|---|---|---|---|---|---|---|---|
| | | | | | Addition Amount | | Addition Amount | | | | | |
| No. | Emulsion | Structure | ($g/m^2$) | Kind | (mol/mol-Ag) | Kind | (mol/mol-Ag) | Sensitivity | γ | Quality | Use | $\Delta S_{1.5}$ |
| 501 | 5A | single layer | 2.5 | I-11 | $1.9 \times 10^{-3}$ | A-214 | $1.7 \times 10^{-3}$ | 3.50 | 8 | 2 | 2.5 | 0.02 |
| 502 | 5C | single layer | " | " | " | " | " | 1.00 | 25 | 5 | 5.3 | 0.41 |
| 503 | 5D | single layer | " | " | " | " | " | 1.70 | 21 | 5 | 5.3 | 0.32 |

TABLE 4-continued

| Sample No. | Emulsion | Emulsion Layer Structure | Silver Amount ($g/m^2$) | Hydrazine Derivative Kind | Hydrazine Derivative Addition Amount (mol/mol-Ag) | Nucleation Accelerator Kind | Nucleation Accelerator Addition Amount (mol/mol-Ag) | Photographic Properties Sensitivity | Photographic Properties γ | Superimposed Letter Image Quality | Dmax in Practical Use | Storage Stability $\Delta S_{1.5}$ |
|---|---|---|---|---|---|---|---|---|---|---|---|---|
| 504 | 5B | single layer | " | — | — | — | — | 3.55 | 4 | 2 | 2.4 | 0.02 |
| 505 | " | single layer | " | — | — | A-214 | $1.7 \times 10^{-3}$ | 3.55 | 4 | 2 | 2.4 | 0.02 |
| 506 | " | single layer | " | I-11 | $1.9 \times 10^{-3}$ | — | — | 3.50 | 6 | 2 | 2.6 | 0.02 |
| 507 | " | single layer | " | " | " | A-214 | $1.7 \times 10^{-3}$ | 3.10 | 16 | 4 | 5.1 | 0.02 |
| 508 | " | single layer | " | I-16 | $2.0 \times 10^{-3}$ | " | " | 3.21 | 11 | 3 | 5.0 | 0.03 |
| 509 | " | single layer | " | I-11 | $1.9 \times 10^{-3}$ | A-112 | $2.0 \times 10^{-3}$ | 3.20 | 11 | 3 | 5.0 | 0.03 |
| 510 | 5E | single layer | " | " | " | A-214 | $1.7 \times 10^{-3}$ | 3.00 | 17 | 4 | 5.1 | 0.03 |
| 511 | 5B/5E | super-posed layers | 1.2/1.3 | " | " | " | " | 3.02 | 19 | 5 | 5.2 | 0.02 |
| 512 | 5F | single layer | 2.5 | " | " | " | " | 3.10 | 15 | 4 | 5.1 | 0.02 |
| 513 | 5F/5E | super-posed layers | 1.2/1.3 | " | " | " | " | 3.02 | 18 | 5 | 5.2 | 0.02 |
| 514 | 5G | single layer | 2.5 | " | " | " | " | 3.50 | 9 | 2 | 2.0 | 0.02 |
| 515 | 5I | single layer | " | " | " | " | " | 1.78 | 22 | 5 | 5.1 | 0.35 |
| 516 | 5H | single layer | " | " | " | — | — | 3.54 | 7 | 2 | 2.2 | 0.02 |
| 517 | " | " layer | " | — | — | A-214 | $1.7 \times 10^{-3}$ | 3.55 | 5 | 2 | 2.2 | 0.02 |
| 518 | " | single layer | " | I-11 | $1.9 \times 10^{-3}$ | " | " | 3.10 | 17 | 4 | 5.1 | 0.02 |

Sample Nos. 507 to 513 and 518 are according to the present invention

As is clearly seen from Table 4, Sample Nos. 507 to 513 and 518 of the present invention exhibited high contrast photographic properties having a γ value of 10 or more, excellent superimposed letter image quality and high Dmax in practical use of 5.0 or more. Further, the storage stability was also good and thereofre, the above-described superior quality can be maintained for a long period of time.

Three kinds of emulsions were prepared by changing the heavy metal of Emulsion 5B to $K_3CrCN_6$, $K_3ReCl_6$ or $K_2Ir(NO)Cl_5$ and evaluated in the same manner as Emulsion 5B in Table 4 and as a result, it was confirmed that high contrast, high Dmax, high image quality and good storage stability were provided.

EXAMPLE 6

Sample Nos. 501 and 504 to 508 in Example 5 each was evaluated in the same manner as in Example 5 except for the processing (in FG-680AG) was carried out using Developer 2 of Example 2 at 38° C. for 20 seconds.

The evaluation results were such that the contrast was higher than that in Example 5 and Sample Nos. 507 and 508 of the present invention exhibited excellent superimposed letter image quality and high Dmax in practical use of 5.0 or more.

EXAMPLE 7

Preparation of Emulsion

Emulsion 7A

To a 1.5% aqueous gelatin solution containing sodium chloride and $3\times10^{-5}$ mol/mol-Ag of sodium benzenethiosulfonate kept at 40° C. and having a pH of 2.0, an aqueous silver nitrate solution and an aqueous sodium chloride solution containing $3.5\times10^{-5}$ mol/mol-Ag of $(NH_4)_2Rh(H_2O)Cl_5$ were simultaneously added by a double jet method at an electric potential of 95 mV over 3 minutes and 30 seconds to give a half of silver amount in the final grain and thereby a core grain having a size of 0.12 μm was prepared. Thereafter, an aqueous silver nitrate solution and an aqueous sodium chloride solution containing $10.5\times10^{-5}$ mol/mol-Ag of $(NH_4)_2Rh(H_2O)Cl_5$ were added in the same manner as above over 7 minutes to provide a Silver chloride cubic grain having an average grain size of 0.15 μm (coefficient of variation 12%).

Thereafter, the resulting emulsion was washed with water by a flocculation method well known in the art to remove a soluble salt, gelatin was added thereto and, without carrying out chemical ripening, 50 mg/mol-Ag of Compound-A and 50 mg/mol-Ag of phenoxyethanol as antiseptics and $1\times10^{-3}$ mol/mol-Ag of 4-hydroxy-6-methyl-1,3,3a,7-tetrazaindene as a stabilizer were added as in Emulsion 7A (the final grain having a pH of 5.7, a pAg of 7.5 and an Rh content of $7\times10^{-5}$ mol/mol-Ag).

Emulsion 7B

The core grain (size: 0.12 μm) of Emulsion 7B was prepared in the same manner as in Emulsion 7A and then, an aqueous silver nitrate solution and an aqueous sodium chloride solution containing $14.0\times10^{-5}$ mol/mol-Ag of $(NH_4)_2Rh(H_2O)Cl_5$ were added by a double jet method at an electric potential of 95 mV over 3 minutes and 30 seconds to give ¼ silver amount of the final grain to thereby produce a grain in size of 0.14 μm. Further thereafter, an aqueous silver nitrate solution and an aqueous sodium chloride solution containing $4.0\times10^{-4}$ mol/mol-Ag of $K_4[Fe(CN)_6]$ and $7.0\times10^{-5}$ mol/mol-Ag of $(NH_4)_2Rh(H_2O)Cl_5$ were added in the same manner as above over 3 minutes and 30 seconds to give ¼ silver amount of the final grain to thereby produce a silver chloride cubic grain having an average grain size of 0.15 μm. Then, the resulting emulsion was washed with water, gelatin was added thereto and without carrying out chemical sensitization, antiseptics and a stabilizer were added (the final grain having a coefficient of variation of 12%, a pH of 5.7, a pAg of 7.5, an Rh content of $7.0\times10^{-5}$ mol/mol-Ag and an Fe content of $1.0\times10^{-4}$ mol/mol-Ag).

Emulsions 7C to 7I

Emulsions 7C to 7I were prepared in the same manner as Emulsion 7B except for changing the kind of a metal doped to the silver halide grain, the doped amount of the metal and the doped amount of $K_4[Fe(CN)_6]$ as shown in Table 5.

Preparation of Coating Solution for Emulsion Layer and Coating Thereof

The following compounds were added to each of emulsions shown in Table 5 and a silver halide emulsion layer was coated on a support described below having an undercoat layer to give a gelatin coated amount of 1.1 g/m² and a silver coated amount of 2.5 g/m².

| | |
|---|---|
| 4-Hydroxy-6-methyl-1,3,3a,7-tetrazaindene | 10 mg/m² |
| N-Oleyl-N-methyltaurine sodium salt | 35 mg/m² |
| Compound-B | 10 mg/m² |
| Compound-C | 20 mg/m² |
| n-Butylacrylate/2-acetoacetoxyethyl methacrylate/acrylic acid copolymer (89/8/3) | 900 mg/m² |
| Compound-D (hardening agent) | 150 mg/m² |

Further, the nucleation accelerator and the hydrazine derivative of the present invention were added each in an amount as shown in Table 5.

On the upper Layer of the above-described emulsion layer, emulsion protective lower and upper layers were coated.

Preparation of Coating Solution for Emulsion Protective Lower Layer and Coating Thereof The following compounds were added to an aqueous gelatin solution and coated to give a gelatin coated amount of 0.7 g/m².

| | |
|---|---|
| Gelatin ($Ca^{++}$ content: 2,700 ppm) | 0.7 g/m² |
| Sodium p-dodecylbenzenesulfonate | 15 mg/m² |
| Compound-A | 5 mg/m² |
| Compound-E | 10 mg/m² |
| Compound-F | 20 mg/m² |

Preparation of Emulsion Protective Upper Layer and Coating Thereof

The following compounds were added to an aqueous gelatin solution and coated to give a gelatin coated amount of 0.8 g/m².

| | |
|---|---|
| Gelatin ($Ca^{++}$ content: 2,700 ppm) | 0.8 g/m² |
| Amorphous silica matting agent (average particle size: 3.5 μm, pore diameter: 25 Å, surface area: 700 m²/g) | 40 mg/m² |
| Amorphous silica matting agent (average particle size: 2.5 μm, pore diameter: 170 Å, surface area: 300 m²/g) | 10 mg/m² |
| N-Perfluorooctanesulfonyl-N-propylglycine potassium | 5 mg/m² |
| Sodium dodecylbenzenesulfonate | 30 mg/m² |
| Compound-A | 5 mg/m² |
| Solid Disperse Dye-$G_1$ | 100 mg/m² |
| Solid Disperse Dye-$G_2$ | 50 mg/m² |

Then, on the opposite side of the support, the following electroconductive layer and backing layer were simultaneously coated.

Preparation of Coating Solution for Electroconductive Layer and Coating Thereof

The following compounds were added to an aqueous gelatin solution and coated to give a gelatin coated amount of 77 mg/M².

| | |
|---|---|
| $SnO_2$/Sb (9/1 by weight, average particle size: 0.25 μm) | 200 mg/m² |
| Gelatin ($Ca^{++}$ content: 3,000 ppm) | 77 mg/m² |
| Sodium dodecylbenzenesulfonate | 10 mg/m² |
| Sodium dihexyl-α-sulfosuccinate | 40 mg/m² |
| Sodium polystyrenesulfonate | 9 mg/m² |
| Compound-A | 7 mg/m² |

Preparation of Coating Solution for Backing Layer and Coating Thereof

The following compounds were added to an aqueous gelatin solution and coated to give a gelatin coated amount of 2.92 g/m².

| | |
|---|---|
| Gelatin ($Ca^{++}$ content: 30 ppm) | 2.92 g/m² |
| Polymethyl methacrylate fine particle (average particle size: 3.4 μm) | 54 mg/m² |
| Compound-H | 140 mg/m² |
| Compound-I | 140 mg/m² |
| Compound-J | 40 mg/m² |
| Sodium dodecylbenzenesulfonate | 75 mg/m² |
| Sodium dihexyl-α-sulfosuccinate | 20 mg/m² |
| Compound-K | 5 mg/m² |
| N-Perfluorooctanesulfonyl-N-propylglycine potassium | 5 mg/m² |
| Sodium sulfate | 50 mg/m² |
| Sodium acetate | 85 mg/m² |

Support and Undercoat Layer

A first undercoat layer and a second undercoat layer each having the following composition were coated on both surfaces of a biaxially stretched polyethylene terephthalate support (thickness: 100 μm).

Undercoat First Layer

| | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound-L | 0.20 g |
| Colloidal silica (Snowtex ZL, produced by Nissan Kagaku KK, particle size: 70-100 μm) | 0.12 g |
| Water to make | 100 g |

Further, 10 wt % of KOH was added thereto and the resulting coating solution adjusted to have a pH of 6 was coated at a drying temperature of 180° C. for 2 minutes to give a dry thickness of 0.9 μm.

Undercoat Second Layer

| | |
|---|---|
| Gelatin | 1 g |
| Methyl cellulose | 0.05 g |
| Compound-M | 0.02 g |
| $C_{12}H_{25}O(CH_2CH_2O)_{10}H$ | 0.03 g |
| Compound-A | $3.5 \times 10^{-3}$ g |
| Acetic acid | 0.2 g |
| Water to make | 100 g |

The resulting coating solution was coated at a drying temperature of 170° C. for 2 minutes to give a dry thickness of 0.1 μm. Samples 701 to 718 were thus prepared.

Compound-A

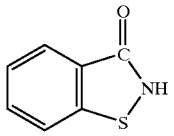

Compound-B

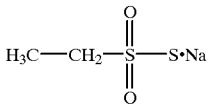

Compound-C

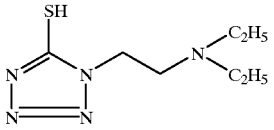

Compound-D

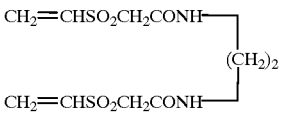

-continued

Compound-E

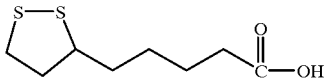

Compound-F

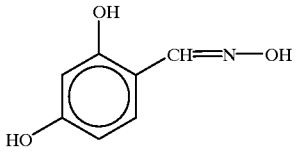

Solid Disperse Dye-$G_1$

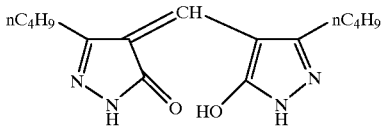

Solid Disperse Dye-$G_2$

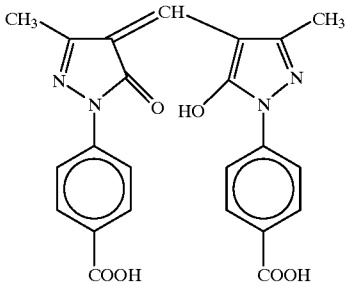

Compound-H

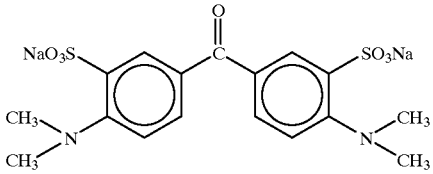

Compound-I

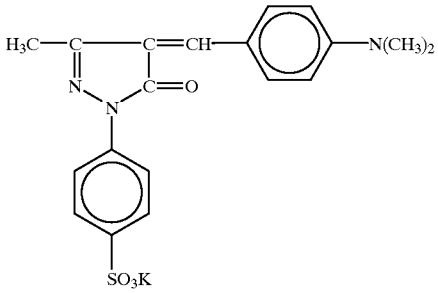

-continued

Compound-J

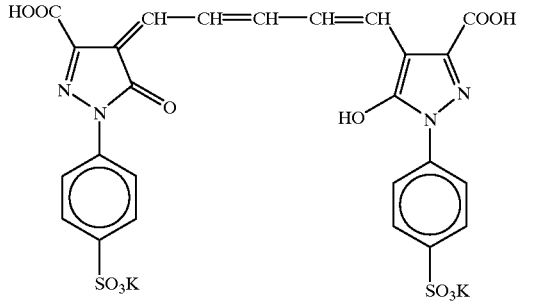

Compound-K $C_8F_{17}SO_3Li$

Core-shell Type Vinylidene Chloride Copolymer (1)

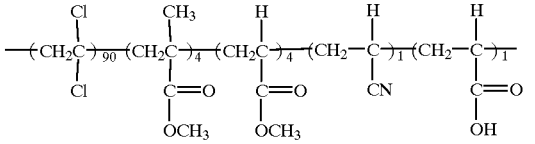

Core: VDC/MMA/MA (80 wt. %)
Shell: VDC/AN/AA (20 wt. %)
Average particle size: 70 nm -continued Compound-L

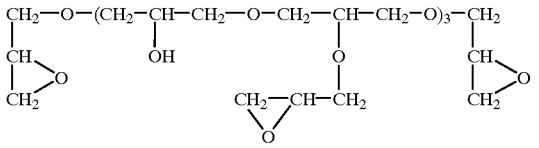

Compound-M

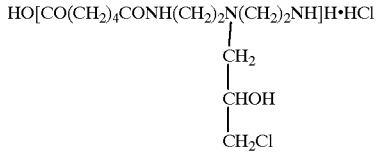

Each of the thus-obtained samples was exposed through an optical wedge in a printer, P-627FM, manufactured by Dainippon & Screen Mfg., Co., Ltd., processed with Developer 1 of Example 1 at 38° C. for 20 seconds in an automatic developing machine, FG-680AG, manufactured by Fuji Photo Film Co., Ltd., and then fixed, water washed and dried. The fixing solution used was Fixing Solution 1 of Example 1. These samples were evaluated on the sensitivity, the γ, the superimposed letter image quality, the Dmax in practical use and the storage stability $\Delta S_{1.5}$ in the same manner as in Example 1 and the results obtained are shown in Table 5.

TABLE 5

| Sample No. | Emulsion No. | Heavy Metal Kind | Heavy Metal Doped Amount (mol/mol-Ag) | Doped Amount of $K_4[Fe(CN)_6]$ (mol/mol-Ag) | Hydrazine Derivative Kind | Hydrazine Derivative Addition Amount (mol/mol-Ag) | Nucleation Accelerator Kind | Nucleation Accelerator Addition Amount (mol/mol-Ag) | Photo-graphic Properties Sensi-tivity | Photo-graphic Properties γ | Super-imposed Letter Image Quality | Dmax in Practical use | Storage Stabil-ity $\Delta S_{1.5}$ |
|---|---|---|---|---|---|---|---|---|---|---|---|---|---|
| 701 | 7A | $(NH_4)_2Rh(H_2O)Cl_5$ | $7 \times 10^{-5}$ | — | I-11 | $1.9 \times 10^{-3}$ | A-214 | $1.7 \times 10^{-3}$ | 3.50 | 8 | 2 | 2.5 | 0.02 |
| 702 | 7B | " | " | $1 \times 10^{-4}$ | — | — | — | — | 3.60 | 3 | 2 | 2.3 | 0.02 |
| 703 | " | " | " | " | — | — | A-214 | $1.7 \times 10^{-3}$ | 3.58 | 3 | 2 | 2.4 | 0.02 |
| 704 | " | " | " | " | I-11 | $1.9 \times 10^{-3}$ | — | — | 3.55 | 6 | 2 | 2.6 | 0.02 |
| 705 | " | " | " | " | " | " | A-214 | $1.7 \times 10^{-3}$ | 3.22 | 16 | 4 | 5.1 | 0.02 |
| 706 | " | " | " | " | I-16 | $2.0 \times 10^{-3}$ | " | " | 3.35 | 11 | 3 | 5.0 | 0.03 |
| 707 | " | " | " | " | I-32 | $1.9 \times 10^{-3}$ | " | " | 3.18 | 15 | 4 | 5.2 | 0.02 |
| 708 | " | " | " | " | I-11 | " | A-213 | " | 3.20 | 14 | 4 | 5.1 | 0.02 |
| 709 | " | " | " | " | " | " | A-112 | $2.1 \times 10^{-3}$ | 3.32 | 11 | 3 | 5.0 | 0.03 |
| 710 | 7C | " | $3 \times 10^{-5}$ | " | " | " | A-214 | $1.7 \times 10^{-3}$ | 3.11 | 18 | 4 | 5.2 | 0.03 |
| 711 | 7D | " | $7 \times 10^{-5}$ | $5 \times 10^{-4}$ | " | " | " | " | 3.18 | 17 | 4 | 5.2 | 0.02 |
| 712 | 7E | " | $5 \times 10^{-6}$ | $1 \times 10^{-4}$ | " | " | " | " | 1.83 | 22 | 5 | 5.3 | 0.30 |
| 713 | 7F | " | $1 \times 10^{-6}$ | " | " | " | " | " | 1.15 | 24 | 5 | 5.3 | 0.41 |
| 714 | 7G | $K_2Ru(NO)Cl_5$ | $6 \times 10^{-5}$ | — | " | " | " | " | 3.50 | 9 | 2 | 2.1 | 0.02 |
| 715 | 7H | " | " | $1 \times 10^{-4}$ | " | " | " | " | 3.10 | 18 | 4 | 5.0 | 0.02 |
| 716 | " | " | " | " | — | — | " | " | 3.62 | 4 | 2 | 2.1 | 0.02 |
| 717 | " | " | " | " | I-11 | $1.9 \times 10^{-3}$ | — | — | 3.57 | 6 | 2 | 2.4 | 0.03 |
| 718 | 7I | " | $4 \times 10^{-6}$ | " | " | " | A-214 | $1.7 \times 10^{-3}$ | 1.80 | 23 | 5 | 5.1 | 0.33 |

Sample Nos. 705 to 711 and 715 are according to the present invention.

As is clearly seen from Table 5, Sample Nos. 705 to 711 and 715 of the present invention exhibited high contrast photographic properties (γ: 10 or more), excellent superimposed letter image quality and high Dmax in practical use of 5.0 or more. Further, the storage stability was also good.

Three kinds of emulsions were prepared by changing $(NH_4)_2Rh(H_2O)Cl_5$ of Emulsion 7B to $K_3CrCN_6$, $K_3ReCl_6$ or $K_2Ir(NO)Cl_5$ and evaluated in the same manner as Emulsion 7B in Table 5 and as a result, it was confirmed that high contrast, high Dmax, high image quality and good storage stability were provided.

EXAMPLE 8

Sample Nos. 701 to 706 in Example 7 each was evaluated in the same manner as in Example 7 except for the processing (in FG-680AG) was carried out using Developer 2 of Example 2 at 38° C. for 20 seconds.

The evaluation results were such that the contrast was higher than that in Example 7 and Sample Nos. 705 and 706 of the present invention exhibited excellent superimposed letter image quality even at a pH of 9.8 and high Dmax in practical use of 5.0 or more.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer and at least one other hydrophilic colloid layer, wherein at least one of said emulsion layer and said other hydrophilic colloid layer contains at least one hydrazine derivative represented by formula (I) and at least one nucleation accelerator represented by formula (XII) or (XIV), and said emulsion layer comprises an emulsion which contains silver halide grains containing a heavy metal selected from the group consisting of Ir, Ru, Rh, Re and Cr in an amount of at least $1\times10^{-5}$ mol per mol of silver halide and having a silver chloride content of 95 mol % or more, said grains being formed under acidic conditions and then subjected to gold-sulfur sensitization, (I)

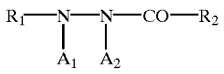

wherein $R_1$ represents an aliphatic or aromatic group substituted by a sulfonamide group, $R_2$ represents a hydrogen atom, an alkyl group, an aryl group, an unsaturated heterocyclic group, an alkoxy group, an aryloxy group, an amino group or a hydrazino group and $A_1$ and $A_2$ both represent a hydrogen atom or one represents a hydrogen atom and the other represents a substituted or unsubstituted alkylsulfonyl group, a substituted or unsubstituted arylsulfonyl group or a substituted or unsubstituted acyl group;

(XII)

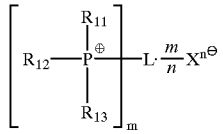

wherein $R_{11}$, $R_{12}$ and $R_{13}$ each represents an alkyl group, a cycloalkyl group, an aryl group, an alkenyl group, a cycloalkenyl group or a heterocyclic residue which may further have a substituent, m represents an integer of from 1 to 4, L represents an m-valent organic group connected to the P atom through the carbon atom, n represents an integer of from 1 to 3 and X represents an n-valent anion provided that X may be linked with L;

(XIV)

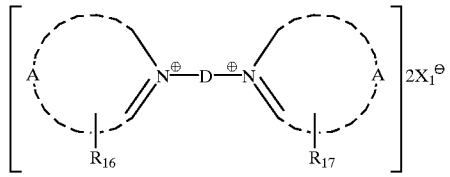

wherein A represents an organic group necessary for completing the hetero ring, D represents a divalent group, $R_{16}$ and $R_{17}$ each represents a hydrogen atom or a substituent, and $X_1$ represents an anion group provided that when an inner salt is formed, $X_1$ is not required.

2. The silver halide photographic material as claimed in claim 1, wherein at least one of the compounds represented by formulae (XVI), (XVII) and (XVIII) is added during the step of grain formation and/or gold-sulfur sensitization of said silver halide emulsion (a):

$$R—SO_2S—M \quad (XVI)$$

$$R—SO_2S—R^1 \quad (XVII)$$

$$R—SO_2S—L_1m_1—SSO_2—R^2 \quad (XVIII)$$

wherein R, $R^1$ and $R^2$, which may be the same or different, each represents an aliphatic group, an aromatic group or a heterocyclic group, M represents a cation, $L_1$ represents a divalent linking group and $m_1$ is 0 or 1, provided that the compound represented by formula (XVI), (XVII) or (XVIII) may be a polymer containing a divalent group derived from the structure represented by formula (XVI), (XVII) or (XVIII) as a repeating unit.

3. The silver halide photographic material as claimed in claim 1, wherein $R^1$ is a phenyl group which is capable of accelerating adsorption of the hydrazine derivative of formula (I) to the silver halide grain surface or is a phenyl group which contains an alkylthio group.

4. The silver halide photographic material as claimed in claim 2, wherein $R^1$ is a phenyl group which is capable of accelerating adsorption of the hydrazine derivative of formula (I) to the silver halide grain surface or is a phenyl group which contains an alkylthio group.

5. The silver halide photographic material as claimed in claim 1, wherein said nucleation accelerator is a compound represented by formula (XIV).

6. The silver halide photographic material as claimed in claim 2, wherein said nucleation accelerator is a compound represented by formula (XIV).

7. The silver halide photographic material as claimed in claim 1, wherein said heavy metal is Rh.

8. The silver halide photographic material as claimed in claim 1, wherein said heavy metal is Ru.

9. A silver halide photographic material comprising a support having thereon at least one silver halide, emulsion layer and at least one other hydrophilic colloid layer, wherein at least one of said emulsion layer and said other hydrophillic colloid layer contains at least one hydrazine derivative represented by formula (I) and at least one nucleation accelerator represented by formula (XII) or (XIV), and said emulsion layer comprises an emulsion which contains silver halide grains containing a heavy metal selected from the group consisting of Ir, Ru, Rh, Re and Cr in an amount of at least $1\times10^{-5}$ mol per mol of silver halide and having a silver chloride content of 95 mol % or more, said grains being subjected to chemical sensitizaation with at least one compound selected from the group consisting of the compounds represented by formula (VI), (VII), (VIII), (IX) or (X):

(I)

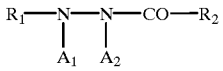

wherein $R_1$ represents an aliphatic or aromatic group substituted by a sulfonamide group, $R_2$ represents a hydrogen atom, an alkyl group, an aryl group, an unsaturated heterocyclic group, an alkoxy group, an aryloxy group, an amino group or a hydrazino group and $A_1$ and $A_2$ both represent a hydrogen atom or one represents a hydrogen atom and the other represents a substituted or unsubstituted alkylsulfonyl group, a substituted or unsubstituted arylsulfonyl group or a substituted or unsubstituted acyl group;

(XII)

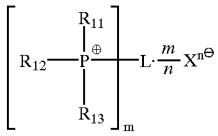

wherein $R_{11}$, $R_{12}$ and $R_{13}$ each represents an alkyl group, a cycloalkyl group, an aryl group, an alkenyl group, a cycloalkenyl group or a heterocyclic residue which may further have a substituent, m represents an integer of from 1 to 4, L represents an m-valent organic group connected to the P atom through the carbon atom, n represents an integer of from 1 to 3 and X represents an n-valent anion provided that X may be linked with L;

(XIV)

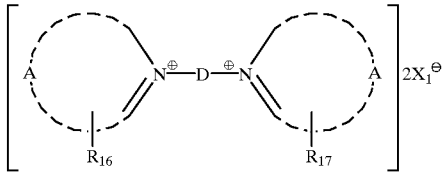

wherein A represents an organic group necessary for completing the hetero ring, D represents a divalent group, $R_{16}$ and $R_{17}$ each represents a hydrogen atom or a substituent, and $X_1$ represents an anion group provided that when an inner salt is formed, $X_1$ is not required;

(VI)

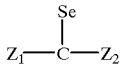

wherein $Z_1$ and $Z_2$, which may be the same or different, each represents an alkyl group, an alkenyl group, an aralkyl group, an aryl group, a heterocyclic group, $—NR_{21}(R_{22})$, $—OR_{23}$ or $—SR_{24}$, wherein $R_{21}$, $R_{22}$, $R_{23}$ and $R_{24}$, which may be the same or different, each represents an alkyl group, an aralkyl group, an aryl group or a heterocyclic group, the alkyl group, the aralkyl group, the aryl group or the heterocyclic group including the same groups as those for $Z_1$, provided that $R_2$, and $R_{22}$ may be a hydrogen atom or an acyl group;

(VII)

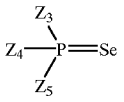

wherein $Z_3$, $Z_4$ and $Z_5$, which may be the same or different, each represents an aliphatic group, an aromatic group, a heterocyclic group, $—OR_{25}$, $—NR_{26}(R_{27})$, $—SR_{28}$, $—SeR_{29}$, $X_{11}$ or a hydrogen atom, wherein $R_{25}$, $R_{28}$ and $R_{29}$ each represents an aliphatic group, an aromatic group, a heterocyclic group, a hydrogen atom or a cation, $R_{26}$ and $R_{27}$ each represents an aliphatic group, an aromatic group, a heterocyclic group or a hydrogen atom and $X_{11}$ represents a halogen atom;

(VIII)

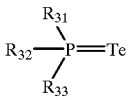

wherein $R_{31}$, $R_{32}$ and $R_{33}$ each represents an aliphatic group, an aromatic group, a heterocyclic group, $OR_{34}$, $NR_{35}$ $(R_{36})$, $SR_{37}$, $OSiR_{38}$ $(R_{39})$ $(R_{40})$, $X_{11}$ or a hydrogen atom, wherein $R_{34}$ and $R_{37}$ each represents an aliphatic group, an aromatic group, a heterocyclic group, a hydrogen atom or a cation, $R_{35}$ and $R_{36}$ each represents an aliphatic group, an aromatic group, a heterocyclic group or a hydrogen atom, $R_{38}$, $R_{39}$ and $R_{40}$ each represents an aliphatic group and $X_{11}$ represents a halogen atom;

(IX)

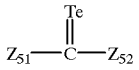

wherein $R_{51}$, represents an aliphatic group, an aromatic group, a heterocyclic group or $—NR_{53}(R_{54})$ and $R_{52}$ represents $—NR_{55}(R_{56})$, $—N$ $(R_{57})$ $N$ $(R_{58})$ $R_{59}$ or $—OR_{60}$, wherein $R_{53}$, $R_{54}$, $R_{55}$, $R_{56}$, $R_{57}$ , $R_{58}$, $R_{59}$ and $R_{60}$each represents a hydrogen atom, an aliphatic group, an aromatic group, a heterocyclic group or an acyl group, provided that $R_{51}$, and $R_{55}$, $R_{51}$and $R_{57}$, $R_{51}$ and $R_{58}$, $R_{51}$ and $R_{60}$, $R_{53}$ and $R_{55}$, $R_{53}$ and $R_{57}$, $R_{53}$ and $R_{58}$, or $R_{53}$ and $R_{60}$ may be combined with each other to form a ring;

$R_{61}—(Te)_n—R_{62}$ (X)

wherein $R_{61}$ and $R_{62}$, which may be the same or different, each represents an aliphatic group, an aromatic group, a heterocyclic group, —(C=Y')—$R_{63}$, wherein $R_{63}$ represents a hydrogen atom, an aliphatic group, an aromatic group, a heterocyclic group, $NR_{64}(R_{65})$, $OR_{66}$ or $SR_{67}$ and Y' represents an oxygen atom, a sulfur atom or $NR_{68}$, wherein $R_{64}$, $R_{65}$, $R_{66}$, $R_{67}$ and $R_{68}$ each represents a hydrogen atom, an aliphatic group, an aromatic group or a heterocyclic group, and n represents 1 or 2.

10. A silver halide photographic material comprising a support having thereon at least one silver halide emulsion layer and at least one other hydrophilic colloid layer, wherein at least one of said emulsion layer and said other hydrophilic colloid layer contains at least one hydrazine derivative represented by formula (I) and at least one nucleation accelerator represented by formula (XII) or (XIV), and said emulsion layer comprises an emulsion which contains silver halide grains containing a heavy metal selected from the group consisting of Ir, Ru, Rh, Re and Cr in an amount of at least $1\times10^{-5}$ mol per mol of silver halide and at least one iron compound and having a silver chloride content of 95 mol % or more:

(I)

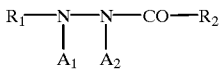

wherein $R_1$ represents an aliphatic or aromatic group substituted by a sulfonamide group, $R_2$ represents a hydrogen atom, an alkyl group, an aryl group, an unsaturated heterocyclic group, an alkoxy group, an aryloxy group, an amino group or a hydrazino group and $A_1$ and $A_2$ both represent a hydrogen atom or one represents a hydrogen atom and the other represents a substituted or unsubstituted alkylsulfonyl group, a substituted or unsubstituted arylsulfonyl group or a substituted or unsubstituted acyl group;

(XII)

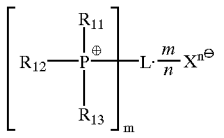

wherein $R_{11}$, $R_{12}$ and $R_{13}$ each represents an alkyl group, a cycloalkyl group, an aryl group, an alkenyl group, a cycloalkenyl group or a heterocyclic residue which may further have a substituent, m represents an integer of from 1 to 4, L represents an m-valent organic group connected to the P atom through the carbon atom, n represents an integer of from 1 to 3 and X represents an n-valent anion provided that X may be linked with L;

(XIV)

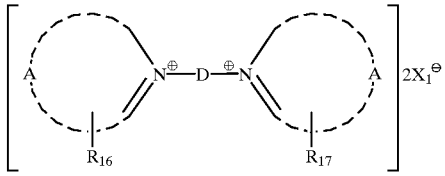

wherein A represents an organic group necessary for completing the hetero ring, D represents a divalent group, $R_{16}$ and $R_{17}$ each represents a hydrogen atom or a substituent, and $X_1$ represents an anion group provided that when an inner salt is formed, $X_1$ is not required.

11. The silver halide photographic material as claimed in claim 9, wherein at least one of the compounds represented by formulae (XVI), (XVII) and (XVII) is added during the step of grain formation and/or gold-sulfur sensitization of said emulsion:

$$R—SO_2S—M \quad (XVI)$$

$$R—SO_2S—R^1 \quad (XVII)$$

$$R—SO_2S—L_1m_1—SSO_2—R^2 \quad (XVIII)$$

wherein R, $R^1$ and $R^2$, which may be the same or different, each represents an aliphatic group, an aromatic group or a heterocyclic group, M represents a cation, $L_1$ represents a divalent linking group and $m_2$ is 0 or 1, provided that the compound represented by formula (XVI), (XVI) or (XVIII) may be a polymer containing a divalent group derived from the structure represented by formula (XVI), (XVII) or (XVII) as a repeating unit.

12. The silver halide photographic material as claimed in claim 10, wherein at least one of the compounds represented by formulae (XVI), (XVII) and (XVI) is added during the step of grain formation and/or gold-sulfur sensitization of said emulsion:

$$R—SO_2S—M \quad (XVI)$$

$$R—SO_2S—R^1 \quad (XVII)$$

$$R—SO_2S—L_1m_1—SSO_2—R^2 \quad (XVIII)$$

wherein R, $R^1$ and $R^2$, which may be the same or different, each represents an aliphatic group, an aromatic group or a heterocyclic group, M represents a cation, $L_1$ represents a divalent linking group and $m_1$ is 0 or 1, provided that the compound represented by formula (XVI), (XVII) or (XVII) may be a polymer containing a divalent group derived from the structure represented by formula (XVI), (XVII) or (XVIII) as a repeating unit.

13. The silver halide photographic material as claimed in claim 1, wherein the nucleation accelerator is represented by formula (XII).

14. The silver halide photographic material as claimed in claim 9, wherein the nucleation accelerator is represented by formula (XII).

15. The silver halide photographic material as claimed in claim 9, wherein the nucleation accelerator is represented by formula (XIV).

16. The silver halide photographic material as claimed in claim 10, wherein the nucleation accelerator is represented by formula (XII).

17. The silver halide photographic material as claimed in claim 10, wherein the nucleation accelerator is represented by formula (XIV).

18. The silver halide photographic material as claimed in claim 9, wherein $R^1$ is a phenyl group which is capable of accelerating adsorption of the hydrazine derivative of formula (I) to the silver halide grain surface or is a phenyl group which contains an alkylthio group.

19. The silver halide photographic material as claimed in claim 10, wherein $R^1$ is a phenyl group which is capable of accelerating adsorption of the hydrazine derivative of formula (I) to the silver halide grain surface or is a phenyl group which contains an alkylthio group.

20. The silver halide photographic material as claimed in claim 1, wherein the nucleation accelerator is represented by formula (XIV).

* * * * *